US006645680B2

(12) United States Patent
Abe et al.

(10) Patent No.: US 6,645,680 B2
(45) Date of Patent: Nov. 11, 2003

(54) SILVER HALIDE COLOR REVERSAL PHOTOGRAPHIC MATERIAL

(75) Inventors: Ryuji Abe, Minami-Ashigara (JP); Minoru Sato, Tokyo (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/098,503

(22) Filed: Mar. 18, 2002

(65) Prior Publication Data

US 2003/0064329 A1 Apr. 3, 2003

(30) Foreign Application Priority Data

Mar. 19, 2001 (JP) ..... 2001-079388
Mar. 21, 2001 (JP) ..... 2001-081619
Feb. 1, 2002 (JP) ..... 2002-025986

(51) Int. Cl.[7] ..... G03C 1/46

(52) U.S. Cl. ..... 430/5; 430/379; 430/407; 430/5

(58) Field of Search ..... 430/596, 379, 430/407, 567, 504

(56) References Cited

U.S. PATENT DOCUMENTS 5,248,588 A * 9/1993 Nagaoka ..... 430/605

FOREIGN PATENT DOCUMENTS

JP 2-272540 11/1990

* cited by examiner

*Primary Examiner*—Hoa Van Le
(74) *Attorney, Agent, or Firm*—Sughrue Mion, PLLC

(57) ABSTRACT

A silver halide color reversal photographic material comprising a layer capable of imparting interimage effects, this interimage effects imparting layer comprising a lightsensitive silver halide emulsion comprising silver halide grains satisfying the following conditions (i) to (iii). (i) The silver halide grains have an average silver iodide content of more than 6 to 39 mol %. (ii) Grains occupying 60% or more of a projected area of all the silver halide grains are those of triple or greater multiplicity structure having at least one layer of high silver iodide content, the silver iodide content being 8 mol % or more, which layer of high silver iodide content is one formed using silver in an amount of 15 to 80 mol % based on that used in obtaining final grains. (iii) All the silver halide grains have surfaces having an average silver iodide content of 10 mol % or less.

8 Claims, 1 Drawing Sheet

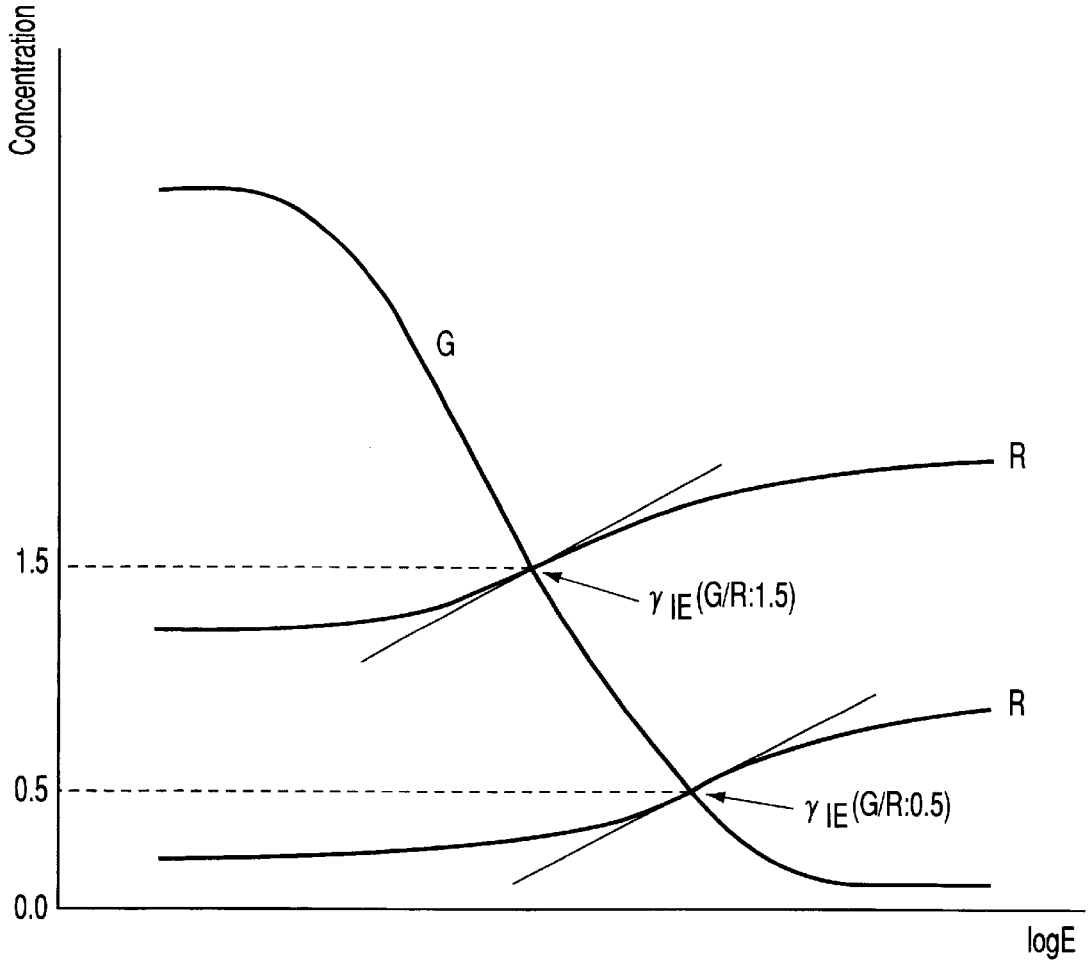
FIGURE

SILVER HALIDE COLOR REVERSAL PHOTOGRAPHIC MATERIAL

CROSS-REFERENCE TO RELATED APPLICATIONS

This application is based upon and claims the benefit of priority from the prior Japanese Patent Applications No. 2001-079388, filed Mar. 19, 2001; No. 2001-081619, filed Mar. 21, 2001; and No. 2002-025986, filed Feb. 1, 2002, the entire contents of all of which are incorporated herein by reference.

BACKGROUND OF THE INVENTION

1. Field of the Invention

The present invention relates to a silver halide color photographic material. More particularly, the present invention relates to a silver halide color reversal photographic material of enhanced color faithfulness.

2. Description of the Related Art

The appreciation of images photographed by a color reversal can be accomplished by various methods, for example, direct appreciation through transmission, projection using a projector, a color print and printing. The images are often used as an original for various print productions including printing because positive images of high quality can be obtained. From the viewpoint of an original for printing, it is expected that the images photographed by a color reversal not only have a high image quality which can be equal to expansion but also can be a color proof as a substitute for real subject. When the function as a color proof is taken into account, it is naturally required for the images photographed by a color reversal to faithfully reproduce, for example, a subject hue. However, conventional color reversal films have not necessarily fully satisfied this requirement.

Jpn. Pat. Appln. KOKAI Publication No. (hereinafter referred to as JP-A-) 61-34541 discloses a color photographic material which has interimage effects and a specified spectral sensitivity capable of realizing a faithful color reproduction. JP-A's-9-5912 and 9-211812 disclose methods of amplifying interimage effects by the use of a non-lightsensitive silver iodide. However, all the methods according to these inventions, although an improvement of faithful color reproduction can be recognized, have been unsatisfactory from the viewpoint of practical use. Moreover, JP-A's-54-118245, 62-136649, 1-66644 and 2-272540 disclose color photographic materials having an emulsion layer which substantially does not contribute to color dye formation and imparts interimage effects. However, these inventions also, although being effective in improving color reproduction, have been unsatisfactory from the viewpoint of practical use.

BRIEF SUMMARY OF THE INVENTION

It is an object of the present invention to provide a silver halide color reversal photographic material which has been strengthened with respect to interimage effects and which is excellent in color reproduction.

The object of the present invention has been attained by the following means.

(1) A silver halide color reversal photographic material comprising, on a support, at least one blue-sensitive silver halide emulsion layer containing a yellow-forming coupler, at least one green-sensitive silver halide emulsion layer containing a magenta-forming coupler and at least one red-sensitive silver halide emulsion layer containing a cyan-forming coupler, wherein the material comprises a layer capable of imparting interimage effects which comprises a light-sensitive silver halide emulsion comprising silver halide grains satisfying the following conditions (i) to (iii).

(i) The silver halide grains have an average silver iodide content of more than 6 to 39 mol %.

(ii) Grains occupying 60% or more of a projected area of all the silver halide grains are those of triple or greater multiplicity structure having at least one layer of high silver iodide content, the silver iodide content being 8 mol % or more, which layer of high silver iodide content is one formed using silver in an amount of 15 to 80 mol % based on that used in obtaining final grains.

(iii) All the silver halide grains have surfaces having an average silver iodide content of 10 mol % or less.

(2) The silver halide color reversal photographic material according to item (1) above, wherein the lightsensitive silver halide emulsion comprises silver halide grains satisfying not only the above conditions (i) to (iii) but also the following conditions (iv) and (v).

(iv) All the silver halide grains have equivalent circle diameters whose variation coefficient is 40% or less.

(v) The grains occupying 60% or more of a projected area of all the silver halide grains are tabular grains of quintuple or greater multiplicity structure wherein, with respect to a silver iodide distribution thereof, there are at least two maximums in zones extending from a grain center to grain side, a first maximum of said at least two maximums is in the range of 1 to 40% of the total silver amount which silver amount counting from the grain center to grain sides, while a second maximum of said at least two maximums is in the range of 50 to 85% of the total silver amount which silver amount counting from the grain center to grain sides.

(3) The silver halide color reversal photographic material according to item (1) or (2) above, wherein the light-sensitive silver halide emulsion has a spectral sensitivity distribution whose weight-average sensitivity wavelength $\lambda i$ is positioned intermediate between respective spectral sensitivity distribution weight-average wavelengths $\lambda b$ and $\lambda g$ of the blue-sensitive silver halide emulsion layer and the green-sensitive silver halide emulsion layer, and wherein the lightsensitive silver halide emulsion is spectrally sensitized so as to simultaneously satisfy the following relationships of formulae (1) and (2).

$$490\ \text{nm} \leqq \lambda i \leqq 560\ \text{nm} \quad (1)$$

wherein $\lambda i$ represents the weight-averaged wavelength (nm) of spectral sensitivity distribution of the lightsensitive silver halide emulsion.

$$\lambda g \leqq \lambda i + 10 \quad (2)$$

wherein $\lambda g$ represents the weight-averaged wavelength (nm) of spectral sensitivity distribution of the green-sensitive silver halide emulsion layer.

(4) The silver halide color reversal photographic material according to any of items (1) to (3) above, wherein the interimage effects imparting layer substantially does not contribute to formation of dye images.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The single FIGURE is a perspective view showing respective point-gamma values, $\gamma_{IE}$ (G/R: 0.5) and $\gamma_{IE}$ (G/R: 1.5), of density of red-sensitive emulsion layer at a point on which the color densities of red-sensitive emulsion layer and green-sensitive emulsion layer cross each other at densities of 0.5 and 1.5.

DETAILED DESCRIPTION OF THE INVENTION

The present invention will be described in detail below.

Silver halide grains contained in the emulsion (hereinafter also referred to as "emulsion of the present invention") for use in the layer capable of imparting interimage effects (interimage effects imparting layer) according to the present invention may be those having regular crystals such as cubic, octahedral or tetradecahedral crystals, those having regular crystal form such as spherical or tabular crystal form, those having crystal defects such as twin faces, or composite forms thereof.

The silver halide grains may consist of fine grains having a grain diameter of about 0.2 $\mu$m or less, or large grains having a projected area diameter of up to about 10 $\mu$m. The emulsion may be a polydisperse or monodisperse emulsion. A monodisperse emulsion is preferred.

It is especially preferred that the silver halide grains (hereinafter also referred to as "silver halide grains of the present invention") contained in the emulsion for use in the interimage effects imparting layer of the present invention consist of tabular grains. Herein, the tabular grains refer to silver halide grains having two mutually opposite and parallel is (111) principal surfaces. The tabular grains for use in the present invention have one twin face, or two or more mutually parallel twin faces. The twin face refers to a (111) face on both sides of which the ions of all the lattice points are in the relationship of reflected images.

The tabular grains, as viewed in a direction perpendicular to the principal surfaces, have triangular or hexagonal form, or circular form corresponding to rounded triangular or hexagonal form. The tabular grains have external surfaces which are parallel to each other.

Now, the distribution of silver iodide in the silver halide grains for use in the interimage effects imparting layer of the present invention will be described. Structures with respect to the distribution of silver iodide can fundamentally be determined by calculation from recipe values for the step of grain preparation. The change of silver iodide content at each interface of structures can be sharp or gentle. In the ascertainment thereof, although an analytical measuring precision must be considered, the EPMA (Electron Probe Micro Analyzer) method is generally effective in the measuring of the silver chloride or silver iodide content of each individual grain. In this method, a sample wherein emulsion grains are dispersed so as to avoid contacting thereof to each other is prepared. The sample is irradiated with electron beams to thereby emit X-rays. Analysis of the X-rays enables performing an elemental analysis of an extremely minute region irradiated with electron beams. The measuring is preferably performed while cooling the sample in order to prevent the damaging of the sample by electron beams. This method enables analyzing the intragranular silver iodide distribution. Further, by using a specimen obtained by hardening the above sample and slicing the hardened sample with the use of a microtome into extremely thin sections, the method also enables analyzing the intragranular silver iodide distribution across the tabular grain section. Still further, with respect to the silver iodide distribution, not only the presence of a maximum across a region extending from grain center to grain side but also the intragranular position of the maximum can be ascertained by the method.

The average silver iodide content of silver halide grains for use in the interimage effects imparting layer of the present invention is in the range of more than 6 to 39 mol %, preferably 8 to 20 mol %.

The silver chloride content of silver halide grains for use in the present invention is preferably 3 mol % or less, more preferably 2 mol % or less, and most preferably 1 mol % or less. It is desired that substantially no silver chloride be mixed in the silver halide grains.

The multiple structure of silver halide grains for use in the interimage effects imparting layer of the present invention will be described below.

With respect to the silver halide grains contained in the interimage effects imparting layer of the present invention, grains occupying 60% or more of a projected area of all the silver halide grains are those of triple or greater multiplicity structure having at least one layer of high silver iodide content, the silver iodide content being 8 mol % or more, which layer of high silver iodide content is one formed using silver in an amount of 15 to 80 mol % based on that used in obtaining final grains (hereinafter also referred to simply as "total silver quantity"). Herein, the terminology "structure" refers to a structure of intragranular silver iodide distribution, and the terminology "having a structure" means that, in the grains, there are both a layer portion wherein the silver iodide content is 8 mol % or more (high silver iodide layer) and a layer portion wherein the silver iodide content is less than 8 mol % (low silver iodide layer). For example, the triple structure refers to a structure consisting of, arranged in sequence from the grain center, three layers having different silver iodide contents, namely, a core (low silver iodide layer), a 1st shell (high silver iodide layer) and a 2nd shell (low silver iodide layer). Further, the grains can have a quadruple or greater multiplicity structure as long as preferably the silver iodide contents of core and individual shells and the proportion of quantity of silver used in the formation thereof basically satisfy the relationship described later. In the present invention, the arrangement of the core, 1st shell and 2nd shell corresponds to the chronological sequence of the preparation of silver halide grains. The individual layer formations may be continuously carried out in this sequence, or a washing or dispersion may be performed therebetween. That is, the intended grains may be produced by first forming cores, subsequently washing and dispersing the cores to thereby obtain an emulsion containing grains having cores only (core grains) and thereafter, with the use of the emulsion (hereinafter also referred to as "core grain emulsion") as a seed emulsion, sequentially forming the 1st shell and 2nd shell. Alternatively, an emulsion containing grains having the 1st shell already formed on the cores may be used as a seed emulsion.

When a silver halide grain of the present invention has quintuple or greater structure, with respect to a silver iodide distribution thereof, there are preferably at least two maximums on zones extending from a grain center to grain sides. Further, it is more preferably that a first maximum is in the range of 1 to 40% based on the amount of grain constituting silver while a second maximum is in the range of 50 to 85% based on the amount of grain constituting silver.

With respect to the silver halide grains of the present invention, it is preferred that the respective silver content ratios of the core, 1st shell and 2nd shell satisfy the following relationship.

Preferably, the core ratio of the silver halide grains of the present invention is in the range of 0.5 to 10 mol % based on the total silver quantity, and the average silver iodide content thereof is in the range of 0 to 2 mol %. The terminology "core ratio" used herein means the ratio of the silver quantity employed in the preparation of cores to the silver quantity employed for obtaining the final grains. The above-mentioned terminology "average silver iodide content" means the molar ratio % of the quantity of silver iodide employed in the preparation of cores to the silver quantity employed in the preparation of cores. The distribution thereof may be uniform or nonuniform. More preferably, the core ratio is in the range of 1 to 5 mol % based on the total silver quantity, and the average silver iodide content thereof is in the range of 0 to 1 mol %. The preparation of cores can be accomplished by various methods.

The cores of silver halide grains of the present invention can be prepared by methods described in, e.g., "I. Emulsion preparation and types," Research Disclosure (RD) No. 17643 (December, 1978), pp. 22 and 23; RD No. 18716 (November, 1979), page 648; RD No. 307105 (November, 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

It is also preferred to use monodisperse emulsions described in U.S. Pat. Nos. 3,574,628 and 3,655,394 and GB No. 1,413,748 as the core grain emulsion.

Tabular grains are preferably used as core grains of the present invention. The tabular grains can be prepared by, for example, any of the methods described in Cleve, Photography Theory and Practice (1930), page 131; Gutoff, Photographic Science and Engineering, vol. 14, pp. 248–257 (1970); U.S. Pat. Nos. 4,434,226, 4,414,310, 4,433,048 and 4,439,520 and GB No. 2,112,157.

The preparation of core grains fundamentally comprises a combination of three steps consisting of nucleation, ripening and growth. Performing of the growth step is optional.

In particular, when the core grains are tabular, the methods described in U.S. Pat. No. 4,797,354 and JP-A-2-838 are extremely effective in the preparation thereof.

With respect to the nucleation for tabular grains, in the step of nucleation for core grains for use in the present invention, it is extremely effective to use gelatins of low molecular weight as described in Jpn. Pat. Appln. KOKOKU Publication No. (hereinafter referred to as JP-B-) 05-060574; to use gelatins of low methionine content as described in U.S. Pat. Nos. 4,713,320 and 4,942,120; to carry out nucleation at high pBr as described in U.S. Pat. No. 4,914,014; and to carry out nucleation within a short period of time as described in JP-A-2-222940. In the ripening step, in ripening the tabular core grain emulsion, it may be effective to carry out the ripening in the presence of a low-concentration base as described in U.S. Pat. No. 5,254,453, or to carry out the ripening at a high pH as described in U.S. Pat. No. 5,013,641.

The method of forming tabular grains with the use of polyalkylene oxide compounds as described in U.S. Pat. Nos. 5,147,771, 5,147,772, 5,147,773, 5,171,659, 5,210,013 and 5,252,453 is preferably utilized in the preparation of core grains for use in the present invention.

Supplemental addition of gelatin may be effected during grain formation in order to obtain monodisperse tabular grains of high aspect ratio. Chemically modified gelatins as described in JP-A's-10-148897 and 11-143002 and gelatins of low methionine content as described in U.S. Pat. Nos. 4,713,320 and 4,942,120 are preferably used as the supplemental gelatin. Specifically, the former chemically modified gelatins are gelatins characterized by having at least two carboxyl groups newly introduced at the chemical modification of amino groups contained in the gelatins. Of the chemically modified gelatins, gelatin succinate or gelatin trimellitate is preferably used. The chemically modified gelatins are preferably added before the growth step, more preferably added immediately after the nucleation. The addition amount thereof is preferably 50% or more based on the total weight of dispersion mediums which are present during the grain formation.

The 1st shell is formed on each of the above core grains. The ratio of the 1st shell is in the range of 15 to 85 mol % based on the total silver quantity, and the average silver iodide content thereof is in the range of 8 to 39 mol %. Preferably, the ratio of the 1st shell is in the range of 20 to 60 mol % based on the total silver quantity, and the average silver iodide content thereof is in the range of 12 to 39 mol %. The inventor has found that causing the silver iodide content of the 1st shell to assume the above high value is extremely effective in the enhancement of interimage effects upon the use in color reversal lightsensitive materials. Fundamentally, the growth of the 1st shell is accomplished by adding an aqueous solution of silver nitrate and an aqueous solution of halides including an iodide and a bromide by double jet. Preferably, the aqueous solution of halides including an iodide and a bromide is used in greater dilution than that of the aqueous solution of silver nitrate. The temperature and pH of system, type of protective colloid agent such as gelatin, concentration thereof, presence of silver halide solvent, type and concentration thereof, etc. can be widely varied.

In place of the addition of an aqueous solution of silver nitrate and an aqueous solution of halides including an iodide and a bromide by double jet, it is effective to simultaneously add an aqueous solution of silver nitrate, an aqueous solution of halides including a bromide and an emulsion containing silver iodide fine grains (hereinafter also referred to as "silver iodide fine grain emulsion") as described in U.S. Pat. Nos. 4,672,027 and 4,693,964. Furthermore, it is feasible to form the 1st shell by adding an emulsion of silver iodobromide fine grains and conducting ripening thereof. In that instance, a silver halide solvent can be used.

Examples of silver halide solvents which can be used in the present invention include organic thioethers (a) described in U.S. Pat. Nos. 3,271,157, 3,531,286 and 3,574,628 and JP-A's-54-1019 and 54-158917, thiourea derivatives (b) described in JP-A's-53-82408, 55-77737 and 55-2982, silver halide solvents having a thiocarbonyl group interposed between an oxygen or sulfur atom and a nitrogen atom (c) described in JP-A-53-144319, and, as described in JP-A-54-100717, imidazoles (d), sulfites (e), ammonia (f) and thiocyanates (g).

Especially preferred silver halide solvents are thiocyanates, ammonia and tetramethylthiourea. Although the amount of added silver halide solvent depends on the type thereof, in the case of, for example, a thiocyanate, the preferred amount is in the range of $1\times10^{-4}$ to $1\times10^{-2}$ mol per mol of silver halides.

In the use of any solvent, the solvent can basically be removed by carrying out washing after the formation of the 1st shell as mentioned above.

The 2nd shell is formed on the silver halide grain comprising the above core and 1st shell. Preferably, the ratio of the 2nd shell is in the range of 10 to 60 mol % based on the total silver quantity, and the average silver iodide content of the 2nd shell is in the range of 0 to 15 mol %. More preferably, the ratio of the 2nd shell is in the range of 15 to 50 mol % based on the total silver quantity, and the average silver iodide content of the 2nd shell is in the range of 0 to 10 mol %.

Tabular grains wherein, with respect to a silver iodide distribution thereof, there are at least two maximums on zones extending from a grain center to grain sides are most preferably used as the silver halide grains of the present invention.

In the emulsion containing these tabular grains, hexagonal tabular grains whose ratio of the length of the longest side to the length of the shortest side is from 2 to 1 preferably occupy 50% or more, more preferably 70% or more, and most preferably 90% or more, of the projected area of all the grains of the emulsion.

It is preferred that the variation coefficient of equivalent circle diameters of all the grains contained in the emulsion of the present invention is 40% or less, and that the equivalent circle diameter distribution thereof is monodisperse. In the emulsion of the present invention, the variation coefficient of equivalent circle diameters of all the silver halide grains is more preferably 30% or less, still more preferably 25% or less, and most preferably 20% or less. The terminology "variation coefficient of equivalent circle diameters" used herein means a value obtained by dividing the standard deviation of a distribution of equivalent circle diameters of individual silver halide grains by the average equivalent circle diameter and multiplying the quotient by 100.

The equivalent circle diameter of silver halide grains is determined by taking a transmission electron micrograph according to the replica method. Specifically, the equivalent circle diameter is calculated as the diameter of a circle whose area is equal to the projected area of each individual grain (equivalent circle diameter).

In the preparation of tabular grains wherein, with respect to a silver iodide distribution thereof, there are at least two maximums on zones extending from a grain center to grain sides, the core preparation through the 2nd shell formation can be accomplished in the same manner as aforementioned with respect to the silver halide grains of triple structure. However, in this instance, the core ratio is preferably in the range of 1 to 10 mol % based on the total silver quantity, and the average silver iodide content thereof is in the range of 0 to 2 mol %. With respect to the 1st shell, the silver quantity ratio thereof is in the range of 1 to 40 mol %, preferably 5 to 30 mol %, based on the total silver quantity. The average silver iodide content of the 1st shell is in the range of 8 to 39 mol %, preferably 12 to 39 mol %. The ratio of the 2nd shell is preferably in the range of 10 to 60 mol % based on the total silver quantity, and the average silver iodide content of the 2nd shell is in the range of 0 to 15 mol %. More preferably, the ratio of the 2nd shell is in the range of 15 to 50 mol % based on the total silver quantity, and the average silver iodide content of the 2nd shell is in the range of 0 to 10 mol %.

The third shell is provided on the tabular grain having the above-mentioned core, the first shell and the second shell. Preferably, the ratio of the third shell is 1 mol % or more and 10 mol % or less based on the total silver amount, and the average silver iodide content is 20 mol % or more and 100 mol % or less. More preferably, the ratio of the third shell is 1 mol % or more and 5 mol % or less based on the total silver amount, and the average silver iodide content is 25 mol % or more and 100 mol % or less. The growth of the third shell on the tabular grain having the core, the first shell and the second shell is basically carried out by adding an aqueous silver nitrate solution and an aqueous halogen solution which contains an iodide and a bromide by the double jet process. Or, the aqueous silver nitrate solution and the aqueous halogen solution which contains an iodide are added by the double jet process. Or, the aqueous halogen solution which contains an iodide is added by the single jet process. The ratio of the third shell to the total silver amount in case of the last method is determined by subtracting from the ratio of the second shell to the total silver amount, by the assumption that the halogen conversion of the second shell by the iodide occurs by 100%. The composition is referred to as the silver iodide content of 100 mol %.

Any of the methods mentioned above can be used individually or in combination thereof. As cleared from the average silver iodide content of the third shell, silver iodide in addition to silver iodobromide mixed crystal can be precipitated at the formation of the third shell. In any case, silver iodide is extinguished at the next formation of the fourth shell, and wholly changed to the silver iodobromide mixed crystal.

As the preferable method of forming the third shell, there is a method of forming by adding silver iodobromide or silver iodide fine grain emulsion. Fine grains preliminarily prepared can be used as these fine grains, and more preferably, fine grains just after preparation can be used.

Firstly, a case of using fine grains preliminarily prepared is illustrated. In this case, there is a method of adding fine grains preliminarily prepared, ripening and dissolving. As the more preferable method, there is a method of adding a silver iodide fine grain emulsion, and then adding aqueous an aqueous silver nitrate solution, or an aqueous silver nitrate solution and an aqueous halogen solution. In this case, the dissolution of the fine grain emulsion is accelerated by the addition of the aqueous silver nitrate solution, but the ratio of the third shell is determined using the silver amount of the silver iodide fine grain emulsion added, and the silver iodide content is made as 100 mol %. Further, the ratio of the fourth shell is calculated using the aqueous silver nitrate solution added. It is preferable to abruptly add the silver iodide fine grain emulsion.

The abrupt addition of the silver iodide fine grain emulsion means that the silver iodide fine grain emulsion is preferably added within 10 minutes. More preferably, it means the addition within 7 minutes. The condition can be varied depending on the temperature, pBr and pH of the system added, the kind and concentration of protective colloid agents such as gelatin and the like, the presence and absence, kind and concentration of the silver halide solvent and the like, but the shorter the more preferable as described above. At addition, it is preferable that the addition of an aqueous silver salt solution such as silver nitrate and the like is not substantially carried out. It is preferable that the temperature of the system at addition is 40° C. or more and 80° C. or less, and 50° C. or more and 70° C. or less is preferable in particular.

The composition of a fine grain contained in the silver iodide fine grain emulsion may be substantially silver iodide, and silver bromide and/or silver chloride may be contained so far as it becomes a mixed crystal. 100% Silver iodide is preferable. Silver iodide can be β form, γ form, and α form or a structure similar to the α-from as described in U.S. Pat. No. 4,672,026. In the present invention, the crystalline structure is not specifically limited, but a mixture of β form and γ form and further preferably β form are used. The silver iodide fine grain emulsion treated with a usual washing step is preferably used. The silver iodide fine grain emulsion can be easily prepared by methods as described in U.S. Pat. No. 4,672,026 and the like. The method of adding an aqueous solution of silver salt and an aqueous solution of silver iodide by the double jet process, wherein the grain formation is carried out at a fixed pI value, is preferred. The terminology "pI" is the logarithm of inverse of $I^-$ ion concentration of the system. Although there is no particular limitation with respect to the temperature, pI, pH, the kind and concentration of protective colloid agents such as gelatin and the like, the presence and absence, kind and concentration of the silver halide solvent and the like, but it is advantageous in the present invention that the grain size is 0.1 μm or less, and more preferably 0.07 μm or less. Although the grain configuration cannot be fully specified because of the fine grains, it is preferred that the variation coefficient of the grain size distribution is 25% or less. When it is 20% or less in particular, the effect of the present invention is striking. The size and size distribution of fine grains are determined by placing the fine grains on a mesh for electron microscope observation and, not through the carbon replica method, directly making an observation according to the transmission technique. The reason is that, because the grain size is small, the observation by the carbon replica method causes a large measuring error. The grain size is defined as the diameter of a circle having the same projected area as that of the origin. With respect to the size distribution as well, it is determined by the use of the above diameter of a circle having the same projected area. In the present invention, the most effective fine grains have a grain size of 0.02 μm or more and 0.06 μm or less and exhibit a variation coefficient of grain size distribution of 18% or less.

After the above-mentioned grain formation, the silver iodide fine grain emulsion is preferably formed by subjecting to the usual washing described in U.S. Pat. No. 2,614,929 and the like, and the regulation of pH, pI, the concentration of protective colloid agents such as gelatin and the like, and the concentration of silver iodide contained is carried out. It is preferably that pH is 5 or more and 7 or less. The pI value is preferably set at one minimizing the solubility of silver iodide or one higher than the same. Common gelatin having an average molecular weight of about 100 thousand is preferably used as the protective colloid agent. Also, low-molecular-weight gelatin having an average molecular weight of about 20 thousand or less is preferably used. Further, there are occasions in which the use of a mixture of such gelatins having different average molecular weights is advantageous. The gelatin amount per kg of the emulsion is preferably 10 g or more and 100 g or less, and more preferably 20 g or more and 80 g or less. The silver amount based on Ag atom per kg of the emulsion is preferably 10 g or more and 100 g or less, and more preferably 20 g or more and 80 g or less. As the gelatin amount and/or silver amount, a value suitable for abruptly adding the silver iodide fine grain emulsion is preferably selected.

Although the silver iodide fine grain emulsion is generally dissolved prior to the addition, it is requisite that the agitating efficiency of the system is satisfactorily high at the time of addition. The agitation rotating speed is preferably set higher than usual. The addition of an antifoaming agent is effective for preventing the generation of foaming during the agitation. Specifically, antifoaming agents described in the embodiments of U.S. Pat. No. 5,275,929 and the like are used.

Then, as the more preferable method, a case of using fine grains just after preparation is illustrated. The detail of a mixer for forming the silver halide fine grains can be referred to the description of JP-A-10-43570.

The mixer is a stirring apparatus equipped with a stirring vessel equipped with a fixed number of feeding nozzles in which a water-soluble silver salt and a water-soluble halogen salt for being stirred are flown, and a discharge nozzle for discharging the silver halide fine grain emulsion prepared after termination of the agitation treatment; and stirring means for controlling the agitation condition of a liquid in said stirring vessel because stirring blades are driven by rotation in said stirring vessel. The fore-mentioned stirring means carries out preferably agitation and mixing by 2 or more of stirring blades driven by rotation in the stirring vessel, and at least 2 stirring blades are separately arranged at opposing positions in the stirring vessel and driven by rotation mutually to an inverse direction. The respective stirring blades constitute separately a configuration having no axis which penetrates a vessel wall by magnet coupling with external magnets arranged at the outside of the adjacent vessel wall. The respective stirring blades are rotated by driving by rotation the respective external magnets by motors arranged at the outside of the vessel. A both side double pole type magnet in which the end face of the N-pole and the end face of the S-pole are arranged so as to be parallel against its rotational central axis line and to sandwich the rotational central axis to be folded is used on one of the external magnets coupled with the stirring blades by said magnet coupling. A left and right double pole type magnet in which the N-pole face and the S-pole face are arranged at symmetrical positions with the fore-mentioned rotational central axis on a plane orthogonalized to the fore-mentioned rotational central axis line is used on the another external magnet.

A preparation method of the silver halide fine grain emulsion will be illustrated below. Specifically, (a) the rotational number of agitation, (b) the residential time, (c) the addition method and the type of protective colloid, (d) the temperature of a liquid added, (e) the concentration of the liquid added, and (f) potential will be illustrated in detail.

(a) Rotational Number of Agitation

When the opposing stirring blades are driven in said mixer, the rotational number is preferably 1000 rpm to 8000 rpm, more preferably 3000 rpm to 8000 rpm, and most preferably 4000 rpm to 8000 rpm. When it exceeds 8000 rpm, the centrifugal force of the stirring blades becomes too strong and it is not preferable because an inverse flow to the addition nozzle begins to occur. Further, the stirring blades which rotate to inverse direction may be the same rotational number, and different rotational numbers.

(b) Residential Time

A residential time t of the added liquids to be introduced in the mixer is represented by the description below.

$$t=60V/(a+b+c)$$

t: Residential time (second)

V: Volume of mixed space of mixer (mL)

a: Addition speed of silver salt solution (mL/min.)

b: Addition speed of halide salt solution (mL/min.)

c: Addition speed of protective colloid solution (mL/min.)

The residential time t is preferably 0.1 sec. to 5 sec., more preferably 0.1 sec. to 1 sec., and most preferably 0.1 sec. to 0.5 sec. When the residential time t exceeds 5 sec., it is not preferable because the silver halide fine grains once prepared in the mixer grow to be large size, and the size distribution is widened. Further, when it is less than 0.1 sec., it is not preferable because the added liquids are discharged while unreacted.

(c) Addition Method and Type of Protective Colloid

An aqueous protective colloid solution is added in the mixer, and the addition method described below is used.

a. The protective colloid solution is injected in the mixer alone. The concentration of the protective colloid is 0.5% or more, and preferably 1% or more and 20% or less. The flow rate is 20% or more and 300% or less of the sum of the flow rate of the silver salt solution and the halide solution, and preferably 50% or more and 200% or less.

b. The protective colloid solution is contained in the halide salt solution. The concentration of the protective colloid is 0.4% or more, and preferably 1% or more and 20% or less.

c. The protective colloid solution is contained in the silver salt solution. The concentration of the protective colloid is 0.4% or more, and preferably 1% or more and 20% or less. When a gelatin is used, it is better to add the silver salt solution and the halide solution just before use because a silver ion and a gelatin form a silver gelatin and this is subjected to photolysis and thermal decomposition to generate a silver colloid.

The above-mentioned methods of a to c may be individually used alone, and may be simultaneously used in combination of two or three thereof.

Further, a gelatin is generally used often as the protective colloid in the mixer which can be used in the present invention. An alkali treatment is usually used for a gelatin. In particular, it is preferable to use an alkali-processed gelatin treated with deionization treatment and/or ultrafiltration treatment which removed impurity ions and impurities. In addition to the alkali-treated gelatin, a derivative gelatin such as an acid-processed gelatin, a phthalate gelatin, a trimellitate gelatin, a succinate gelatin, a maleate gelatin, and an ester gelatin; a low-molecular-weight gelatin (a weight average molecular weight of 1,000 to 80,000: an enzyme-decomposed gelatin, an acid- and/or alkali-hydrolyzed gelatin, and a thermally decomposed gelatin are included); a high-molecular-weight gelatin (a weight average molecular weight of 110,000 to 300,000); a gelatin having a methionine content of 40 $\mu$mol/g or less; a gelatin having a tyrosine content of 20 $\mu$mol/g or less; an oxidation-processed gelatin; and a gelatin in which methionine was deactivated by alkylation can be used. A mixture of 2 or more of gelatins may be used.

It is requisite that the temperature of a solution to be added to the mixer is kept at as low temperature as possible in order to form the finer silver halide grain, but a gelatin is apt to be solidified at 35° C. or less, therefore, it is preferable to use a low-molecular-weight gelatin which is not also solidified at a low temperature. The weight average molecular weight of the low-molecular-weight gelatin is 50,000 or less, preferably 30,000 or less, and more preferably 10,000 or less. Further, since a synthetic polymer which is a synthetic colloid having the protective colloid action of the silver halide grains is not also solidified at a low temperature, it is used in the present invention. Further, a natural polymer other than gelatin can be also similarly used in the present invention. These are described in JP-B-7-111550 and the Item IX of "Research Disclosure", Vol. 176, No. 17643 (December, 1978).

(d) Temperature of Liquid Added

The temperature of a liquid added is preferably 10° C. to 60° C., 20° C. to 40° C. considering the small-sizing and the adaptability of production, and most preferably 20° C. to 30° C. Further, it is preferable to regulate the temperature of the mixer and piping portions because of the generation of reaction heat in the mixer and the prevention of ripening the formed silver halide grains.

(e) Concentration of Liquid Added

Since the above-mentioned mixer provided at the outside of the reaction vessel has no dilution by a bulk liquid in general, when a dense added liquid is used, the size of the silver halide grains formed becomes large, and the size distribution is apt to be deteriorated. However, since the above-mentioned mixer is superior in the agitation mixing in comparison with a conventional mixer, the silver halide grains having a small size and a narrow size distribution were formed even if a dense added liquid is used.

Specifically, the concentration of a liquid added is preferably 0.4 mol/litter (hereinafter, described as "L") to 1.2 mol/L, and more preferably 0.4 mol/L to 0.8 mol/L. When the concentration of a liquid added is less than 0.4 mol/L, it is not practical because the total silver amount is small because of being too thin.

(f) Potential

With respect to the potential (excessive halogen amount) of formation of the hexagonal system silver halide ultra fine grains, it is preferred to be formed at a pAg region in which solubility is small from the viewpoint of the small-sizing. Specifically, pAg is preferably 8.5 to 11.5, and further, more preferably 9.5 to 10.5.

As a result of intensively studying the above-mentioned (a) to (f), the hexagonal system silver halide ultra fine grains having an average equivalent-circle diameter of 0.008 $\mu$m to 0.019 $\mu$m were prepared.

The silver iodide ultra fine grains prepared thus are preferably fed in the reaction vessel immediately. However, "immediately" is within 30 min., preferably within 10 min., and more preferably within 1 min. Since the grain size of the silver iodide ultra fine grains becomes large in the lapse of time, it is preferable to be the shorter the better.

As described above, it may be well to continuously add the grains in order to add the silver iodide ultra fine grains formed in the mixer at the outside of the reaction vessel, into the reaction vessel, or may be well to add them after storing them in said mixer once. Further, these may be used in combination. However, when they are stored in the vessel once, the temperature is preferably 40° C. or less, and more preferably 20° C. or less. Further, the time for storing is preferably as short as possible.

As the preferable method of forming the third shell, a silver halide phase containing silver iodide can be formed while letting iodide ions preparing, using an iodide ion discharging agent described in U.S. Pat. No. 5,496,694 in place of a conventional iodide ions feeding method (a method of adding free iodide ions).

The iodide ion discharging agent discharges iodide ions by reaction with an iodide ion discharge-regulating agent (a base and/or a nucleophilic reagent), and chemical species below are preferably mentioned as the nucleophilic reagent used at this time. For example, a hydroxide ion, a sulfurous acid ion, hydroxyl amine, a thiosulfuric acid ion, a metabisulfurous acid ion, hydroxamic acids, oximes, dihydroxybenzenes, mercaptanes, sulfinates, carboxylates, ammonia, amines, alcohols, ureas, thioureas, phenols, hydrazines, hydrazides, semicarbazides, phosphines, and sulfides are mentioned.

The discharge speed and timing of the iodide ions can be controlled by controlling the concentration and addition method of a base and a nucleophilic reagent, and the temperature of reaction solution. As a preferable base, alkali hydroxide is mentioned.

The preferable concentration range of the iodide ion discharging agent and the iodide ion discharging agent for abruptly preparing the iodide ions is $1\times10^{-7}$ to 20M, more preferably $1\times10^{-5}$ to 10M, further preferably $1\times10^{-4}$ to 5M, and particularly preferably $1\times10^{-3}$ to 2M.

When the concentration exceeds 20M, it is not preferable because the iodide ion discharging agent having high molecular weight and the addition amount of the iodide ion discharging agent become too much in comparison with the volume of the grain forming vessel.

Further, when it is less than $1\times10^{-7}$ M, the reaction speed of discharging the iodide ions becomes slow, and it is not preferable because it becomes difficult to abruptly prepare the iodide ion discharging agent.

The preferable temperature range is 30 to 80° C., more preferably 35 to 75° C., and particularly preferably 35 to 60° C.

When the temperature is high temperature exceeding 80° C., the reaction speed of discharging the iodide ions becomes extremely high in general, and when it is low temperature below 30° C., the reaction speed of discharging the iodide ions becomes extremely slow in general. It is not preferred because both cases are limited in the respective use conditions.

When a base is used at discharging the iodide ions, the variation of a liquid pH may be used. At this time, the preferable range of pH for controlling the discharge speed and timing of the iodide ions is 2 to 12, more preferably 3 to 11, particularly preferably 5 to 10, and the pH after adjustment is particularly preferably 7.5 to 10.0. Hydroxide ions determined by the ion product of water act as an adjusting agent even under a neutral condition of pH 7.

Further, the nucleophilic reagent and the base may be used in combination, the pH is controlled within the above-mentioned range at this time, and the discharge speed and timing of the iodide ions may be controlled.

When iodine atoms are discharged from the iodide ion discharging agent as a form of the iodide ions, all iodine atoms may be discharged, and the portion thereof may remain without being decomposed.

The fourth shell is provided on the tabular grains having the above-mentioned core, the first shell, the second shell and the third shell. Preferably, he ratio of the fourth shell is 10 mol % or more and 50 mol % or less based on the total silver amount, and the average silver iodide content thereof is 0 mol % or more and 3 mol % or less. More preferably, the ratio of the fourth shell is 15 mol % or more and 45 mol % or less based on the total silver amount, and the average silver iodide content thereof is 0 mol % or more and 1.5 mol % or less. The growth of the fourth shell on the tabular grains having the core, the first shell, the second shell and the third shell may be carried out either to a direction increasing the aspect ratio of said tabular grains or to a direction decreasing it. The growth of the fourth shell is basically carried out by adding an aqueous halogen solution which contains an aqueous silver nitrate solution and a bromide by the double jet process. Or, the aqueous silver nitrate solution may be added by the single jet process after adding an aqueous halogen solution which contains a bromide. The temperature and pH of the system added, the kind and concentration of protective colloid agents such as gelatin and the like, the presence and absence, kind and concentration of the silver halide solvent and the like can be widely varied.

When the silver halide grain is a tabular grain, the side face connecting the (111) major faces of the final grains may be (111) faces, (100) faces, and a mixture of them, and further, may contain a face having a higher index. A tabular grain emulsion having a low ratio of (111) faces of the side face described in EU Patent No. 515894A1 is preferably used.

The emulsion of the present invention generates the emission of 575 nm which is at least ⅓ of the maximum emission intensity within a wave length range of 490 to 560 nm in addition to an induced emission peak at a wave length range of 490 to 560 nm by preferably cooling the tabular grains to less than 10° K. (in the present invention, 6° K. is selected for specific comparison) and inducing by electromagnetic ray having a wave length of 325 nm (e.g., helium-cadmium laser). Basically, the emission of 575 nm depends on the configuration of a layer having a high content of silver iodide which corresponds to the fore-mentioned third shell.

The emission intensity of 575 nm varies in accordance with the silver amount, silver iodide content and formation method of the third shell. The emission of 575 nm becomes preferably ½ and more preferably ⅔ of the maximum emission intensity within a wave length range of 490 to 560 nm by using the preferable formation method of the third shell of the present invention.

In the present invention, when silver halide grains of the present invention are tabular grains, it is preferably that the tabular grains have dislocation lines. Dislocation lines in tabular grains can be observed by a direct method performed using a transmission electron microscope at a low temperature, as described in, e.g., J. F. Hamilton, Phot. Sci. Tech. Eng., 11, 57, (1967) or T. Shiozawa, J. Soc. Phot. Sci. Japan, 3, 5, 213, (1972). That is, silver halide grains, carefully extracted from an emulsion so as not to apply any pressure by which dislocations are produced in the grains, are placed on a mesh for electron microscopic observation. Observation is performed by a transmission method while the sample is cooled to prevent damage (e.g., print out) due to electron rays. In this observation, as the thickness of a grain is increased, it becomes more difficult to transmit electron rays through it. Therefore, grains can be observed more clearly by using an electron microscope of a high voltage type (200 kV or more for a grain having a thickness of 0.25 $\mu$m). From photographs of grains obtained by the above method, it is possible to obtain the positions and the number of dislocations in each grain viewed in a direction perpendicular to the principal planes of the grain.

The number of dislocation lines is preferably 10 or more, and more preferably, 20 or more per grain. If dislocation lines are densely present or cross each other, it is sometimes impossible to correctly count dislocation lines per grain. Even in these situations, however, dislocation lines can be roughly counted to such an extent that their number is approximately 10, 20, or 30. This makes it possible to distinguish these grains from those in which obviously only a few dislocation lines are present. The average number of dislocation lines per grain is obtained as a number average by counting dislocation lines of 100 or more grains.

It is desirable that the tabular grains used in the present invention has a uniform distribution of dislocation line amount among grains. In the emulsion of the present invention, the tabular grain occupying 50% or more of the total projected areas contains 10 or more of the dislocation lines per one grain. More preferably, the tabular grain containing 10 or more of the dislocation lines occupies 70% or more, and particularly preferably 90%. When it is less than 50%, it is not preferable from the viewpoint of uniformity among grains. Dislocation lines can be introduced to, e.g., a portion near the peripheral region of a tabular grain. In this case, dislocations are substantially perpendicular to the peripheral region and produced from a position x % of the length between the center and the edge (peripheral region) of a tabular grain to the peripheral region. The value of x is preferably 10 to less than 100, more preferably, 30 to less than 99, and most preferably, 50 to less than 98. Although the shape obtained by connecting the start positions of the dislocations is almost similar to the shape of the grain, this shape is not perfectly similar but sometimes distorted. Dislocations of this type are not found in the central region of a grain. The direction of dislocation lines is crystallographically, approximately a (211) direction. Dislocation lines, however, are often zigzagged and sometimes cross each other.

Further, they may nearly uniformly have the dislocation lines over the whole region on the peripheral of the tabular grains, and may have the dislocation lines at local positions on the peripheral. Further, they may have the dislocation lines around the apex of the tabular grain. When the tabular grain has a triangular or hexagonal fringe surface, a perpendicular is drawn from a point which is X % position from the center of the fore-mentioned tabular grain on a linear line connecting the center of the tabular grain with the respective apexes, to 2 sides which form the respective apexes of the tabular grain, "around the apex of the tabular grain" is a portion surrounded between the perpendicular and the sides and a three dimensional region over the whole thickness of the grains. The value of X is 50 or more and less than 100, and preferably 75 or more and less than 100.

When the tabular grains are rounded, the respective apexes are ambiguous. In this case, a point at which 3 or 6 tangents are determined against peripheral, and a straight line connecting the junctions of respective tangents with the center of the tabular grain intercepts the peripheral of the tabular grain, can be defined as the apex.

The existing positions of the dislocation lines in the tabular grains of the silver halide emulsion of the present invention can be limited on the peripheral, on the principal plane, or at local position, and the combination thereof can be also made.

In the present invention, the proportion of grains containing the dislocation lines and the number of the dislocation lines are preferably determined by directly observing the dislocation lines with respect to at least 100 grains, more preferably 200 grains or more, and preferably determined by observing them with respect to 300 grains or more in particular.

It is preferable that the silver halide grains of the present invention have a variation coefficient of the silver iodide content distribution among grains of 20% or less. It is more preferably 15% or less, and particularly preferably 10% or less. When the forementioned variation coefficient is larger than 20%, it is not contrasty, and it is not preferable because the sensitivity at pressuring is greatly decreased. The silver iodide content of individual grain can be measured by analyzing the composition of grains one by one using an X-ray micro analyzer. The variation coefficient of the silver iodide content distribution among grains is a value defined by a relation equation, (standard deviation/average silver iodide content)×100 =variation coefficient, using the standard deviation of silver iodide content and average silver iodide content when the silver iodide content of emulsion grains of at least 100, more preferably 200 or more, and particularly preferably 300 or more was measured. The measurement of the silver iodide content of each individual grains is described in, for example, EU Patent No. 147,868. There are a case of having correlation and a case of having no correlation between the silver iodide content Yi (mol %) of each individual grains and the equivalent-circle diameter Xi ($\mu$m), but it is desirable that there is no correlation.

The average silver iodide content of the grain surface of the present invention is measured using XPS (X-ray Photoelectron Spectroscopy). Regarding the principle of the XPS method used for analyzing the silver iodide content around the surface of silver halide grains, "Spectroscopy of Electron" edited by Aihara (KYOURITU Library 16, published by KYOURITU SYUTTUPAN Co., Ltd. (1978)) can be referred. The standard measurement method of XPS is a method of irradiating Mg-K$\alpha$ as exited X-ray to silver halide made as an appropriate sample mode, and observing the intensity of the photoelectron of iodine (I) and silver (Ag) (usually, I-3d5/2, Ag-3d5/2) emitted from said silver halide. The content of iodine can be obtained by preparing the calibration line of the intensity ratio (intensity (I)/intensity (Ag)) of photoelectrons of iodine (I) and silver (Ag) using several kind of standard samples whose iodine content is known, and by determining from the calibration line. In case of the silver halide emulsion, the measurement of XPS must be carried out after decomposing and eliminating gelatin which adsorbed on the surface of the silver halide grains, by protease and the like.

That the average silver iodide content of grain surface portions in the emulsion of the present invention is 10 mol % or less has been advantageous in interimage effects exhibited upon the use in color reversal photographic materials. Preferably, the average silver iodide content of grain surface portions is 6 mol % or less.

The silver halide emulsion of the present invention can remarkably dissolve the inefficiency which occurs at enlarging the size of the forementioned grains, by preferably providing a positive hole-capturing zone in at least one portion of the inside of the silver halide grains. The positive hole-capturing zone in the present invention represents a region which has a function of capturing so-called positive holes, for example, positive holes generated in pair with photoelectrons generated by photo-excitation. Such hole-capturing zone is defined in the present invention as a zone provided by an intentional reduction sensitization.

The intentional reduction sensitization in the present invention means an operation of introducing a positive hole-capturing silver nuclei into a portion or the whole in the silver halide grains. The positive hole-capturing silver nuclei means a small silver nuclei having little developing activity, and recombination loss at an exposing process can be prevented and sensitivity can be enhanced by the silver nuclei.

As the reduction sensitizers, stannous chloride, ascorbic acid and its derivatives, amines and polyamines, hydrazine derivatives, formamidinesulfinic acid, a silane compound, a borane compound and the like are known. In the reduction sensitization of the present invention, it is possible to selectively use these known reduction sensitizers, or to use two or more types of compounds together. Preferable compounds as the reduction sensitizers are stannous chloride, thiourea dioxide, dimethylamino borane, and ascorbic acid and its derivatives. Although the addition amount of the reduction sensitizers must be so selected as to meet the emulsion manufacturing conditions, a proper amount is $10^{-7}$ to $10^{-3}$ mol per mol of a silver halide.

The reduction sensitizer is added during grain formation by dissolving thereof to water or organic solvents such as alcohols, glycols, ketones, esters and amines.

In the present invention, the positive hole-capturing silver nuclei is preferably formed by adding the reduction sensitizer after nucleation and termination of physical ripening and just before grain formation. However, the positive hole-capturing silver nuclei can be introduced on the grain surface by adding the reduction sensitizer after termination of grain formation.

When the reduction sensitizer is added during grain formation, a portion of nuclei formed can remain in the inside of the grain, but nuclei are also formed on grain surface because the portion percolates. The percolated nuclei are preferably utilized as the positive hole-capturing silver nuclei in the present invention.

In the present invention, it is preferable that the intentional reduction sensitization for forming the positive hole-capturing silver nuclei into the silver halide grains at a step on a way to grain formation is carried out in the presence of the compound of general formula (I-1) or general formula (I-2).

Although this is a speculation, it is considered that the compound of general formula (I-1) or general formula (I-2) has an action of forming only the positive hole-capturing silver nuclei in stability by preventing the oxidation of the silver nuclei caused by oxidative radicals. As a clear experimental result, when the intentional reduction sensitization is carried out at the step on a way to grain formation without the compound of general formula (II-1) or general formula (II-2), the effect of the present invention is hardly revealed.

Herein, a step after carrying out the final desalting is not included in the step on a way to grain formation. For example, a step in which the silver halide grains grow as a result by adding an aqueous silver salt solution, silver halide fine grains and the like at the step of chemical sensitization and the like, is excluded.

Formula (I-1)

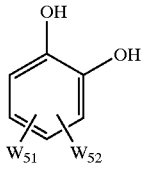

Formula (I-2)

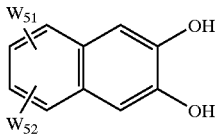

In general formulas (I-1) and (I-2), $W_{51}$ and $W_{52}$ represent a sulfo group or a hydrogen atom, provided that at least one of $W_{51}$ and $W_{52}$ represents a sulfo group. The sulfo group is a water-soluble salt such as an alkali metal salt such as sodium, potassium or the like, an ammonium salt or the like. As preferable compounds, specifically, 3,5-disulfocathecoldisodium salt, 4-sulfocathecolammonium salt, 2,3-dihydroxy-7-sulfonaphthalenesodium salt, 2,3-dihydroxy-6,7-disulfonaphthalenepotassium salt and the like are mentioned. The preferable addition amount can be varied depending on the temperature of the system added, pBr and pH, the kind and concentration of protective colloid agents such as gelatin and the like, the presence and absence, kind and concentration of the silver halide solvent and the like, but in general, 0.0005 mol to 0.5 mol, and more preferably 0.003 mol to 0.02 mol, per mol of silver halide, is used.

It is preferable to use an oxidizer for silver during the process of manufacturing emulsions of the present invention. In particular, it is essential to use an oxidizer for silver when the positive hole-capturing silver nuclei are finally formed only around the surface in the vicinity of the silver halide grains by the intentional reduction sensitization. When the intentional reduction sensitization is carried out only around the surface in the vicinity of the silver halide grains, it is deduced that it is difficult to selectively form the positive hole-capturing silver nuclei without using the oxidizer for silver. Herein, the oxidizer for silver means a compound having an effect of converting metal silver into silver ion. A particularly effective compound is the one that converts very fine silver grains, as a by-product in the process of formation of silver halide grains and chemical sensitization, into silver ion. The silver ion prepared herein may form a silver salt hard to be dissolved in water, such as a silver halide, silver sulfide, or silver selenide, or a silver salt easy to be dissolved in water, such as silver nitrate. The oxidizer for silver may be an inorganic or organic substance. Examples of the inorganic oxidizer include ozone, hydrogen peroxide and its adducts (e.g., $NaBO_2.H_2O_2.3H_2O$, $2NaCO_3.3H_2O_2$, $Na4P_2O_7.2H_2O_2$, and $2Na_2SO_4.H_2O_2.2H_2O$), a peroxy acid salt (e.g., $K_2S_2O_8$, $K_2C_2O_6$, and $K_2P_2O_8$), a peroxy complex compound (e.g., $K_2[Ti(O_2)C_2O_4].3H_2O$, $4K_2SO_4.Ti(O_2)OH.SO_4.2H_2O$, and $Na_3[VO(O_2)(C_2H_4)_2.6H_2O]$), a permanganate (e.g., $KMnO_4$), an oxyacid salt such as a chromate (e.g., $K_2Cr_2O_7$), a halogen element such as iodine and bromine, a perhalogenate (e.g., potassium periodate), a salt of a high-valence metal (e.g., potassium hexacyanoferrate(II)), and a thiosulfonate etc.

Further, examples of the organic oxidizer include quinones such as p-quinone, organic peroxides such as peracetic acid, perbenzoic acid and the like, and compounds of releasing active halogen (e.g., N-bromosuccinimide, chloramine T, and chloramine B).

Preferable oxidizers of the present invention include ozone, hydrogen peroxide and its adduct, a halogen element, and thiosulfonate as inorganic oxidizers; and quinones as organic oxidizers. Thiosulfonate described in JP-A-2-191938 and the like preferable in particular.

The addition timing of the oxidizers to the above-mentioned silver may be possible at any time before starting the intentional reduction sensitization, during the intentional reduction sensitization, and just before or just after completion of the reduction sensitization, and they may be separately added at several times. The addition amount is different depending on the type of the oxidizers, and the addition amount of $1\times10^{-7}$ to $1\times10^{-3}$ mol per mol of silver halide is preferable.

It is advantageous to use gelatin as the protective colloid used for preparing the emulsion of the present invention, and as the binder of other hydrophilic colloid layer. However, hydrophilic colloids other than that can be also used.

For example, a gelatin derivative, a graft polymer of gelatin with other polymer; proteins such as albumin, casein, and the like; cellulose derivatives such as hydroxyethyl cellulose, carboxymethyl cellulose, cellulose sulfates and the like; glucose derivatives such as sodium alginate, dextrin derivatives and the like; and many synthetic hydrophilic polymer substances such as homopolymers and copolymers such as a poly(vinyl alcohol), a partially-acetal of poly(vinyl alcohol), a poly(N-vinyl pyrrolidone), a poly(acrylic acid), a poly(methacrylic acid), a poly(acryl amide), a polyimidazole, a poly(vinyl pyrazole) and the like can be used.

As the gelatin, an acid-processed gelatin, and an enzyme-processed gelatin described in Bull. Soc. Sci. Photo. Japan, 16, 30(1966) in addition to lime-processed gelatin may be used, and the hydrolyzed product and enzyme-decomposed product of gelatin can be also used.

It is preferable that the emulsion of the present invention is washed with water for desalting, and converted to a protective colloid dispersion solution using a newly prepared dispersion. The temperature of washing can be selected in accordance with purposes, and a range of 5° C. to 50° C. is preferably selected. The pH at washing can be selected in accordance with purposes, and a range of 2 to 10 is preferably selected. A range of 3 to 8 is more preferable. The pAg at washing can be selected in accordance with purposes, and a range of 5 to 10 is preferably selected. The method of washing can be used by selecting from a noodle washing method, a dialysis method using a semi-permeable membrane, a centrifugal separation method, a coagulation sedimentation method, and an ion-exchange method. The coagulation sedimentation method can be selected from a method of using a sulfate, a method of using an organic solvent, a method of using a water-soluble polymer, a method of using a gelatin derivative and the like.

In the preparation (e.g., grain formation, desalting step, chemical sensitization, and before coating) of the emulsion of the present invention, it is preferable to make a salt of metal ion exist in accordance with purposes. The metal ion salt is preferably added during grain formation when doped into grains, and after grain formation and before completion of chemical sensitization when used to decorate the grain surface or used as a chemical sensitizer. In addition to a method of doping the salt to all the grains, a method of doping to only the core or the shell of a grain can be selected. As examples of the dopant, Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi can be used. Those metals can be added as long as they are in the form of salt that can be dissolved during grain formation, such as an ammonium salt, an acetate, a nitrate, a sulfate, a phosphate, a hydroxide, a 6-coordinated complex salt, or a 4-coordinated complex salt. For example, $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_4Fe(CN)_6$, $K_2IrCl_6$, $K_3IrCl_6$, $(NH_4)_3RhCl_6$, and $K_4Ru(CN)_6$ are mentioned. The ligand of a coordination compound can be selected from halo, aqua, cyano, cyanate, thiocyanate, nitrosyl, thionitrosyl, oxo and carbonyl. These metal can be used either singly or in the form of a combination of two or more types of them.

In the present invention, it is preferable from the viewpoint of obtaining high sensitivity and high gamma that the electron-capturing dopant having a shallow capturing level described in U.S. Pat. No. 4,937,180 is doped in at least the portion of the silver halide grains. As the compound, $K_4RU(CN)_6$, $K_4Fe(CN)_6$ and the like are mentioned. The dopant can be doped in any of the core, and the first shell to the fourth shell as the doped positions, but the fourth shell is preferable in particular.

The metal compounds are preferably dissolved in an appropriate solvent such as water, methanol, acetone and added in a form of a solution. In order to stabilize the solution, a method of adding an aqueous hydrogen halogenide (e.g., HCl and HBr) or an alkali halide (e.g., KCl, KBr and NaBr) can be used. Further, it is also possible to add an acid or alkali, if necessary. The metal compounds may be added to a reaction vessel before or during grain formation. Alternatively, the metal compounds may be added to a water-soluble silver salt (e.g., $AgNO_3$) or an aqueous alkali halide solution (e.g., NaCl, KBr and KI) and added in the from of a solution continuously during formation of silver halide grains. Furthermore, a solution of the metal compounds can be prepared independently of a water-soluble salt or an alkali halide and added continuously at a proper timing during grain formation. It is also preferable to further combine many addition methods.

It is sometimes useful to perform a method of adding a chalcogen compound during preparation of an emulsion described in U.S. Pat. No. 3,772,031. In addition to S, Se and Te, a cyanate, a thiocyanate, a selenocyanate, a carbonate, a phosphate, and an acetate may be present.

In case of the silver halide grains used in the present invention, at least one of chalcogen sensitizations such as sulfur sensitization, selenium sensitization and the like; noble metal sensitizations such as gold sensitization, palladium sensitization, and the like; and the reduction sensitization can be carried out in an arbitrary step of the production steps of the silver halide photographic emulsion. It is preferable to combine 2 or more of sensitization methods.

Various type emulsions can be prepared depending on decision at what steps chemical sensitization is carried out. There is a type of burying chemical sensitization nuclei in the inside of grains, a type of burying them at a shallow position from the grain surface, or a type of making the chemical sensitization nuclei on surface. The position of the chemical sensitization nuclei can be selected in accordance with purposes for the emulsion of the present invention, but in general, a case of making at least one of the chemical sensitization nuclei around surface in the vicinity is preferable.

One of the chemical sensitizations which can be preferably carried out in the present invention is single or a combination of chalcogen sensitization and noble metal sensitization, and can be carried out using active gelatin as described in T. H. James, "The Theory of the Photographic Process, 4$^{th}$ edition, (1977), pp. 67–76", published by Macmillan. Further, as described in "Research Disclosure Vol. 120 (April 1974), p. 12008"; "Research Disclosure Vol. 34 (June 1975), p. 13452", U.S. Pat. Nos. 2,642,361, 3,297,446, 3,772,031, 3,857,711, 3,901,714, 4,266,018, 3,904,415, and BG Patent No. 1,315,755, the chemical sensitization can be carried out using sulfur, selenium, tellurium, gold, platinum, palladium, iridium or the combination of a plural number of these sensitizers at a pAg of 5 to 10, a pH of 5 to 8 and a temperature of 30 to 80° C.

Noble metal salts such as gold, platinum, palladium, iridium and the like can be used in the noble metal sensitization, and among these, particularly, gold sensitization, palladium sensitization and a combination of both are preferable. In case of the gold sensitization, known compounds such as chloroauric acid, potassium chloroaurate, potassium chloroauric thiocyanate, gold sulfide, gold selenide and the like; mesoionic gold compound described in U.S. Pat. No. 5,220,030; and azole gold compound described in U.S. Pat. No. 5,049,484, the disclosures of which are incorporated by reference, can be used. The palladium compound means divalent salt of palladium or tetra-valent salt of palladium. The preferable palladium compound is represented by $R_2PdX_6$, and $R_2PdX_4$.

Wherein R represents a hydrogen atom, an alkali atom, or an ammonium group. X represents a halogen atom, and represents a chlorine atom, a bromine atom or an iodine atom.

Specifically, $K_2PdCl_4$, $(NH_4)_2PdCl_6$, $Na_2PdCl_4$, $(NH_4)_2PdCl_4$, $Li_2PdCl_4$, $Na_2PdCl_6$ or $K_2PdBr_4$ is preferable. The gold compound and the palladium compound are preferably used in combination with a thiocyanate or a selenocyanate.

The gold sensitization is preferably used in combination in the emulsion of the present invention. The preferable amount of the gold sensitizer is $1\times10^{-3}$ to $1\times10^{-7}$ mol per mol of silver halide, and more preferably $1\times10^{-4}$ to $5\times10^{-7}$ mol. The preferable range of the palladium compound is $1\times10^{-3}$ to $5\times10^{-7}$ mol. The preferable range of the thiocyan compound or a selenocyan compound is $5\times10^{-2}$ to $1\times10^{-6}$ mol.

As sulfur sensitizers, hypo, a thiourea-based compound, a rhodanine-based compound, and a sulfur-containing compound described in U.S. Pat. Nos. 3,857,711, 4,266,018, and 4,054,457 can be used. Chemical sensitization can be also carried out in the presence of a so-called chemical sensitization aid. As the chemical sensitization aid, compounds such as azaindene, azapyridazine, azapyrimidine and the like which are known as those suppressing the fogging in the process of the chemical sensitization and increasing sensitivity, are used. Examples of the chemical sensitization aid modifier are described in U.S. Pat. Nos. 2,131,038, 3,411,914 and 3,554,757, JP-A-58-126526, and Daffine, "Photographic Emulsion Chemistry pp. 138–143".

The preferable amount of the sulfur sensitizer used in the present invention is $1\times10^{-4}$ to $1\times10^{-7}$ mol per mol of silver halide, and more preferably $1\times10^{-5}$ to $5\times10^{-7}$ mol.

There is the selenium sensitization as the preferable method for the emulsion of the present invention. Selenium compounds disclosed in known conventional patents can be used as the selenium sensitizer used in the present invention. In general, an unstable selenium compound and/or non-unstable selenium compound is used by adding this, and stirring the emulsion at a high temperature (preferably 40° C. or more) for a fixed time. As the unstable selenium compound, compounds described in JP-B's-44-15748 and 43-13489, JP-A's-4-25832 and 4-109240 and the like are preferably used.

As the unstable selenium sensitizer, for example, isoselenocyanates (e.g., aliphatic isoselenocyanates such as allylisoselenocyanate), selenoureas, selenoamides, selenocarboxylic acids (e.g., 2-selenopropionic acid, and 2-selenobutylic acid), selenoesters, diacylselenides (e.g., bis(3-chloro-2,6-dimethoxybenzoyl)selenide), selenophosphates, phosphineselenides, and colloid type metallic selenium are mentioned.

The preferable analogous type of the unstable selenium compounds were described above, but these are not limiting compounds. With respect to the unstable selenium compounds as the sensitizer of the photographic emulsion, it is generally understood by those skilled in the art that the structure of said compounds is not so important as far as selenium is unstable, and the organic portion of the selenium sensitizer molecule supports selenium and has no allotment except for letting it exist in the emulsion in an unstable form. The unstable selenium compound having such wide concept is advantageously used in the present invention.

As the non-unstable selenium compounds used in the present invention, compounds described in JP-B's-46-4553, 52-34492 and 52-34491 are used. As the non-unstable selenium compounds, for example, selenous acid, potassium selenocyanate, selenazoles, quatery salt of selenazoles, diarylselenide, diaryldiselenide, dialkylselenide, dialkyldiselenide, 2-selenazolidinedione, 2-selenooxalidinethione, and derivatives thereof are mentioned.

These selenium sensitizers are added at chemical sensitization by being dissolved in water or organic solvents such as methanol, ethanol and the like alone or in a mix solvent. They are preferably added before starting the chemical sensitization. The selenium sensitizer used is not limited to one, and a combination of 2 or more of the above-mentioned selenium sensitizers can be used. It is preferable to use the unstable selenium sensitizer and the non-unstable selenium sensitizer in combination.

The addition amount of the selenium sensitizer used in the present invention differs depending on the activity of the selenium sensitizer used, the type and size of silver halide, the temperature and time of ripening, and the like, and preferably $1\times10^{-8}$ mol or more per mol of silver halide and more preferably $1\times10^{-7}$ mol or more and $5\times10^{-5}$ mol or less. The temperature of chemical ripening when the selenium sensitizer is used is preferably 40° C. or more and 80° C. or less. pAg and pH are arbitrary. For example, the effect of the present invention is obtained within a wide pH range of 4 to 9.

The selenium sensitization is preferably used in combination of the sulfur sensitization or the noble metal sensitization or both of them. Further, in the present invention, thiocyanate is preferably added to the silver halide emulsion at chemical sensitization. As thiocyanate, potassium thiocyanate, sodium thiocyanate, ammonium thiocyanate and the like are used. It is usually added by being dissolved in an aqueous solution or a water-soluble solvent. The addition amount is $1\times10^{-5}$ to $1\times10^{-2}$ mol per mol of silver halide, and more preferably $5\times10^{-5}$ to $5\times10^{-3}$ mol.

An appropriate amount of calcium ion and/or magnesium ion is preferably contained in the silver halide emulsion of the present invention. Thereby, graininess is made better, image quality is improved and preservation property is also made better. The range of the fore-mentioned appropriate amount is 400 to 2500 ppm based on calcium and/or 50 to 2500 ppm based on magnesium, and more preferably calcium is 500 to 2000 ppm based and magnesium is 200 to 2000 ppm. Herein, 400 to 2500 ppm based on calcium and/or 50 to 2500 ppm based on magnesium means that at least one of calcium and magnesium is in a concentration within a prescribed range. When the content of calcium or magnesium is higher than these values, inorganic salts which calcium salt, magnesium salt or gelatin or the like kept preliminarily are precipitated, and it is not preferable because it becomes the cause of trouble at manufacturing lightsensitive material. Herein, the content of calcium or magnesium is represented by mass converted to calcium atom or magnesium atom with respect to all of compounds containing calcium or magnesium such as calcium ion, magnesium ion, calcium salt, magnesium salt and the like, and represented by a concentration per unit mass of the emulsion.

The adjustment of calcium content in the silver. halide tabular grain emulsion of the present invention is preferably carried out by adding calcium salt at chemical sensitization. Gelatin usually used at production of the emulsion contains already calcium by 100 to 4000 ppm in a form of solid gelatin, and it may be adjusted by further adding calcium salt. According to requirement, after carrying out desalting (removal of calcium) from gelatin according to known methods such as a washing method, an ion-exchange method or the like, the content can be also adjusted by calcium salt. As the calcium salt, calcium nitrate and calcium chloride are preferable, and calcium nitrate is most preferable. Similarly, the adjustment of magnesium content can be carried out by adding magnesium salt at production of the emulsion. As the magnesium salt, magnesium nitrate, magnesium sulfate and magnesium chloride are preferable, and magnesium nitrate is most preferable. The quantitative method of calcium or magnesium can be determined by ICP emission spectral analysis method. Calcium and magnesium may be used alone or used in a mixture of both. Calcium is preferably contained. The addition of calcium or magnesium can be carried out at an arbitrary timing of the production steps of silver halide emulsion, but the interval from after grain formation to just after completion of spectral sensitization and chemical sensitization is preferable, and more preferably after addition of a sensitizing dye. Further, it is preferable in particular to add after addition of a sensitizing dye and before carrying out chemical sensitization.

As a particularly useful compound for reducing the fogging of the silver halide emulsion and suppressing the fogging increase at preservation, a mercaptotetrazole compound having a water-soluble group described in JP-A-4-16838 is mentioned. Further, it is disclosed in the fore-mentioned Jpn. Pat. Appln. KOKAI Publication that the preservation property is enhanced by using the combination of the mercaptotetrazole compound and a mercaptothiadiazole compound. The present inventors have studied that the disclosed technique of the fore-mentioned Jpn. Pat. Appln. KOKAI Publication and various compounds which are known as a water-soluble mercapto compound are applied to the emulsion in which selenium sensitization was carried out to the silver halide tabular emulsion having the positive hole-capturing of the present invention, but almost all of the results were accompanied with the lowering of sensitivity. After studying variously, they have found that a specific combination, namely, the use of the combination of the water-soluble mercaptotetrazole compound represented by general formula (II-1) and the water-soluble mercaptotriazole compound represented by general formula (II-2) can improve the preservation property without lowering sensitivity.

Formula (II-1)

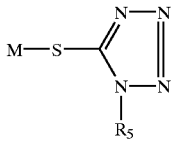

Formula (II-2)

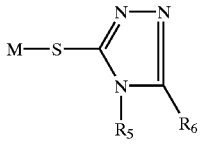

Firstly, the water-soluble mercaptotetrazole compound represented by general formula (II-1) will be illustrated.

In general formula (II-1), $R_5$ is an organic residual group substituted with at least one selected from the group consisting of —$SO_3M$, —COOM, —OH and —$NHR_2$, and specifically, an alkyl group having 1–10 carbon atoms (e.g., methyl, ethyl, propyl, hexyl and cyclohexyl), and an aryl group having 6–14 carbon atoms (e.g., phenyl and naphthyl) can be mentioned.

Each of the group represented by $R_5$ of general formula (II-1) may be further substituted, and those below are mentioned as the substituent. They are a halogen atom (fluorine, chlorine, bromine, iodine), cyano, nitro, ammonio (e.g., trimethyl ammonio), phosphonio, sulfo (including a salt), sulfino(including a salt), carboxy (including a salt), phosphono (including a salt), hydroxy, mercapto, hydradino, alkyl (e.g., methyl, ethyl, n-propyl, isopropyl, t-butyl, n-octyl, cyclopentyl and cyclohexyl), alkenyl (e.g., allyl, 2-butenyl and 3-pentenyl), alkynyl (e.g., propagyl and 3-pentynyl), aralkyl (e.g., benzyl, and phenethyl), aryl (e.g., phenyl, naphthyl and 4-methylphenyl), hetero ring (e.g., pyridyl, furyl, imidazolyl, piperidyl and morphorino), alkoxy (e.g., methoxy, ethoxy, and butyloxy), aryloxy (e.g., phenoxy and 2-naphthyloxy), alkylthio (e.g., methylthio and ethylthio), arylthio (e.g., phenylthio), amino aryl (e.g., unsubstituted amino, methylamino, dimethylamino, ethylamino and anilino), acyl (e.g., acetyl, benzoyl, formyl and pivaloyl), alkoxycarbonyl (e.g., methoxycarbonyl and ethoxycarbonyl), aryloxycarbonyl (e.g., phenoxycarbonyl), carbamoyl (e.g., unsubstituted carbamoyl, N,N-dimethylcarbamoyl, N-ethylcarbamoyl and N-phenylcarbamoyl), acyloxy (e.g., acetoxy and benzoyloxy), acylamino (e.g., acetylamino and benzoylamino), alkoxycarbonylamino (e.g., methoxycarbonylamino), aryloxycarbonylamino (e.g., phenoxycarbonylamino), ureido (e.g., inorganic ureido, N-methylureido and N-phenylureido), alkylsulfonylamino (e.g., methylsulfonylamino), arylsulfonylamino (e.g., phenylsulfonylamino), alkylsulfonyloxy (e.g., methylsulfonyloxy), arylsulfonyloxy (e.g., phenylsulfonyloxy), alkylsulfonyl (e.g., mesyl), arylsulfonyl (e.g., tosyl), alkoxysulfonyl (e.g., methoxysufonyl), aryloxysulfonyl (e.g., phenoxysulfonyl), sulfamoyl (e.g., unsubstituted sulfamoyl, N-methylsulfamoyl, N,N-dimethylsulfamoyl and N-phenylsulfamoyl), alkylsulfinyl (e.g., methylsulfinyl), arylsulfinyl (e.g., phenylsulfinyl), alkoxysulfinyl (e.g., methoxysulfinyl), aryloxysulfinyl (e.g., phenoxysulfinyl), and phosphoric amide (e.g., N,N-diethyl phosphoric amide). These groups may be further substituted. Further, when there are 2 or more substituents, they may be the same or different.

Herein, when there are 2 or more substituents of $R_5$, —$SO_3M$, —COOM, —OH and —$NHR_2$, they may be the same or different.

In general formula (II-1), $R_2$ represents a hydrogen atom, an alkyl group having 1–6 carbon atoms, —$COR_3$, —$CO_2R_3$ or —$SO_2R_3$, and $R_3$ represents a hydrogen atom, an alkyl group having 1–20 carbon atoms (e.g., methyl, ethyl, propyl, hexyl, cyclohexyl, dodecyl and octadecyl), or aryl (e.g., phenyl and naphthyl). These groups may be substituted with the substituent mentioned as the substituent of $R_5$.

In general formula (II-1), M represents a hydrogen atom, an alkali metal atom (e.g., lithium, sodium, potassium and the like), quaternary ammonium (e.g., ammonio, tetramethylammonio, benzyltrimethylammonio, tetrabutylammonio and the like), or quaternary phosphonium (e.g., tetramethylphosphonio and the like).

In general formula (II-1), $R_5$ is preferably phenyl substituted with —$SO_3M$, phenyl substituted with —COOM, phenyl substituted with —$NHR_2$, alkyl having 1–4 carbon atoms substituted with —$SO_3M$, or alkyl having 1–4 carbon atoms substituted with —COOM; $R_2$ is a hydrogen atom, alkyl having 1–4 carbon atoms, or —$COR_3$; $R_3$ is a hydrogen atom, or alkyl having 1–4 carbon atoms substituted with a hydrophilic group (e.g., carboxyl, sulfo and hydroxy); and M is a hydrogen atom, or a sodium atom. More preferably, $R_5$ is phenyl substituted with —$SO_3M$ or phenyl substituted with —COOM. Specific example of the compound represented by general formula (II-1) is shown below, but the present invention is not limited to these.

II-1-1

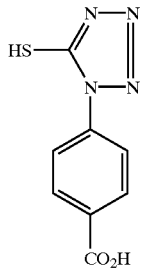

II-1-2

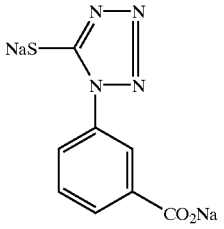

II-1-3

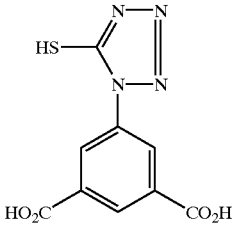

II-1-4

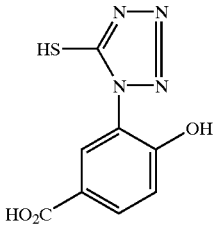

II-1-5

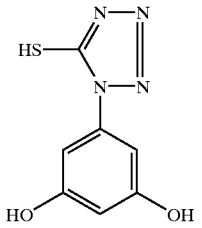

II-1-6

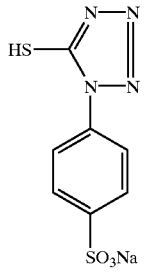

-continued

II-1-7

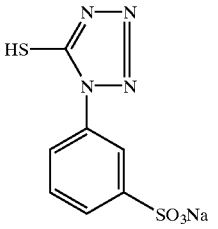

II-1-8

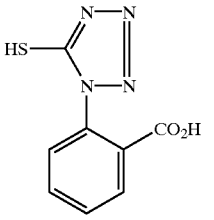

II-1-9

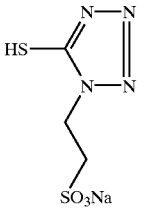

II-1-10

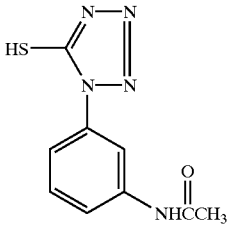

II-1-11

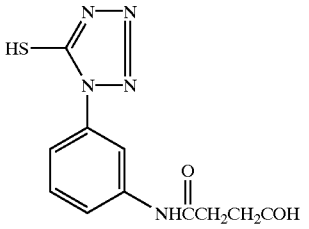

Then, the mercaptotriazole compound of general formula (II-2) will be illustrated.

M and $R_5$ of general formula (II-2) have the same meaning as M and $R_5$ of general formula (II-1).

In general formula (II-2), $R_6$ represents a hydrogen atom, an alkyl group having 1–10 carbon atoms (e.g., methyl, ethyl, propyl, hexyl, cyclohexyl and the like), or an aryl group having 6–15 carbon atoms (e.g., phenyl, naphthyl and the like), and alkyl or aryl may be substituted with the substituent mentioned as the substituent of $R_5$ of general formula (II-1).

In general formula (II-2), $R_6$ is preferably a hydrogen atom, an alkyl group having 1–4 carbon atoms, or phenyl; $R_5$ is phenyl substituted with —$SO_3M$, phenyl substituted with —COOM, phenyl substituted with —$NHR_2$, alkyl having 1–4 carbon atoms substituted with —SO3M, or alkyl having 1–4 carbon atoms substituted with —COOM; $R_2$ is a hydrogen atom, alkyl having 1–4 carbon atoms, or —$COR_3$; $R_3$ is a hydrogen atom, or alkyl having 1–4 carbon atoms substituted with a hydrophilic group (e.g., carboxyl, sulfo and hydroxy); and M is a hydrogen atom, or a sodium atom. More preferably, $R_6$ is a hydrogen atom; and $R_5$ is phenyl substituted with —$SO_3M$ or phenyl substituted with —COOM.

Specific example of the compound represented by general formula (II-2) will be shown below, but the present invention is not limited to these.

II-2-1

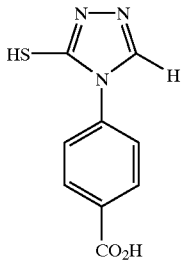

II-2-2

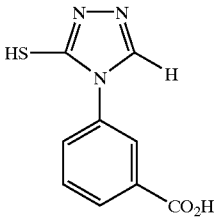

II-2-3

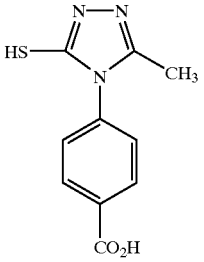

II-2-4

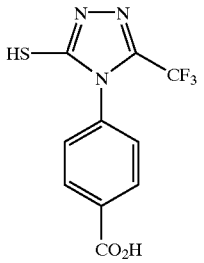

II-2-5

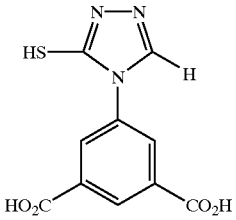

-continued

II-2-6

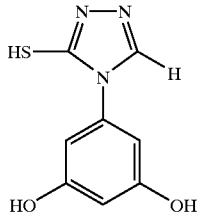

II-2-7

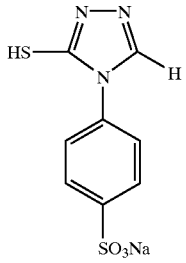

II-2-8

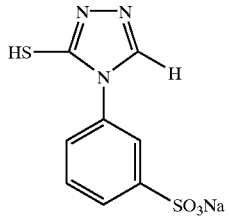

II-2-9

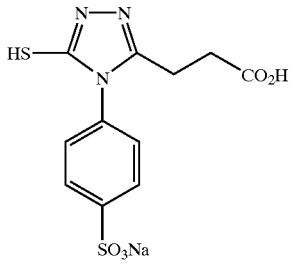

II-2-10

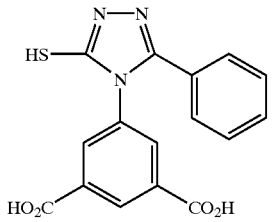

II-2-11

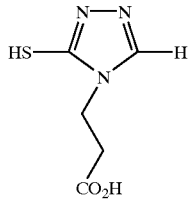

II-2-12

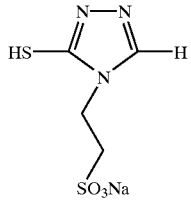

-continued

II-2-13

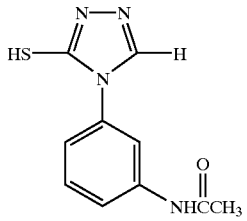

II-2-14

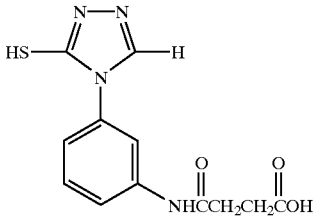

The compound represented by general formula (II-1) or general formula (II-2) is known, and can be synthesized by methods described in literatures below. John A. Montgomery, "The Chemistry of Heterocyclic Chemistry" (1981) 1,2,4-triazole, pp. 404–442, published by JOHN WILEY & SONS Co., Ltd.; S. R. Sandler, W. Karo, "Organic Functional Group Preparation" (1968), pp. 312–315, published by Academic Press Co., Ltd.; Kevin T. Pott, "COMPREHENSIVE HETEROCYCLIC COMPOUNDS" Vol. 5, pp. 761–784, 825–834, published by PERGAMON PRESS Co., Ltd.; Robert C. Elderfield, "HETEROCYCLIC COMPOUNDS", (1961), pp. 425–445, published by JOHN WILEY & SONS Co., Ltd.; Frederic R. Benson, "THE HIGH NITROGEN COMPOUNDS", (1984), pp. 640–653, published by JOHN WILEY & SONS Co., Ltd.

The compound represented by general formula (II-1) or general formula (II-2) is contained in the silver halide emulsion layer and the hydrophilic colloid layer (an intermediate layer, a surface protective layer, an yellow filter layer, an antihalation layer and the like). It is preferably contained in the silver halide emulsion layer or its adjacent layer.

The addition method of the compound to the emulsion shall be in accordance with a conventional addition method of a photographic emulsion additive. For example, it can be added as a solution by being dissolved in methyl alcohol, ethyl alcohol, methylcellosolve, acetone, water or a mix solvent thereof.

Further, the compound represented by general formula (II-1) or general formula (II-2) can be used by being added at any step of the manufacturing steps of a photographic emulsion, and can be used by being added at any step after manufacturing of an emulsion till just before coating. It is effective that the preferable addition step in the present invention is carried out just after completion of forming the silver halide grains till just after completion of chemical ripening step.

The addition amount of the compound represented by general formula (II-1) or general formula (II-2) is usually used at a range of $1\times10^{-6}$ mol to $1\times10^{-1}$ mol per mol of silver halide selenium sensitized and preferably $5\times10^{-6}$ mol to $5\times10^{-3}$ mol, in total. The molar ratio of the combination use of the compound of general formula (II-1) and the compound of general formula (II-2) is arbitrary but preferably 99.5:0.5 to 50:50. It is preferable in particular that a small amount of the compound of general formula (II-2) which is 99:1 to 70:30 is used in combination.

In the present invention, when the compounds represented by general formulas (II-1) and (I-2) are used in combination, the addition timings of the compound represented by general formula (II-1) and the compound represented by general formula (II-2) may be the same or different. For example, the compound represented by general formula (II-2) is added just after completion of forming the silver halide grains. till just before completion of chemical ripening step, and the compound represented by general formula (II-1) may be added just after completion of chemical ripening step. Further, the inverse order may be well, but the former is preferable.

Various compounds can be contained in the photographic emulsion used in the present invention in order to prevent fog in the step of manufacturing a lightsensitive material, during preservation, or during photographic processing, or to stabilize photographic performance. Namely, various compounds which were known as an antifoggant or a stabilizer, such as thiazoles (e.g., benzothiazolium salt); nitroimidazoles; nitrobenzimidazoles; chlorobenzimidazoles; bromobenzimidazoles; mercaptothiazoles; mercaptobenzothiazoles; mercaptobenzimidazoles; mercaptothisdiazoles; aminotriazoles; benzotriazoles; nitrobenzotriazoles; mercaptotetrazoles (particularly 1-phenyl-5-mercaptotetrazole); mercaptopyrimidines; mercaptotriazines; a thioketo compound such as oxadolinethione; azaindenes, for example, triazaindenes, tetrazaindenes (particularly hydroxy-substituted(1,3,3a,7)tetrazaindenes), and pentazaindenes can be added.

For example, compounds described in U.S. Pat. Nos. 3,954,474 and 3,982,947, and JP-B-52-28660 can be used. One preferable compound is described in JP-A-63-212932. Antifoggants and stabilizers can be added at any of several different timings such as before, during and after grain formation, during washing with water, during dispersion after washing, before, during and after chemical sensitization, and before coating, in accordance with the intended application. The antifoggants and stabilizers can be added during preparation of an emulsion to achieve their original fog preventing effect and stabilizing effect, and in addition, can be used for various purposes of controlling crystal habit, decreasing a grain size, decreasing the solubility of grains, controlling chemical sensitization, controlling the arrangement of dyes, and the like.

The above emulsion may be any of the surface latent image type in which latent images are mainly formed in the surface, the internal latent image type in which latent images are formed in the internal portion of grains and the type in which latent images exist in both the surface and the internal portion of grains. However, it is requisite that the emulsion be a negative type. The emulsion of the internal latent image type may specifically be, for example, a core/shell internal-latent-image type emulsion described in JP-A-63-264740. The process for preparing this core/shell internal-latent-image type emulsion is described in JP-A-59-133542. The thickness of the shell of this emulsion, although varied depending on development processing, etc., is preferably in the range of 3 to 40 nm, more preferably 5 to 20 nm.

In the present invention, although the emulsion used in the interimage effects imparting layer (namely, emulsion of the present invention) may be spectrally sensitized so as to have any spectral sensitivity distribution, it is especially preferred that the weight-average wavelength ($\lambda i$) of spectral sensitivity distribution of the interimage effects imparting layer be positioned between the respective spectral sensitivity distribution weight-average wavelengths ($\lambda b$, $\lambda g$) of the blue-sensitive layer and green-sensitive layer. The weight-averaged wavelengths $\lambda b$, $\lambda g$ and $\lambda i$ of the blue-sensitive layer, green-sensitive layer and interimage effects imparting layer are defined by the following formulae.

$$\lambda b=\int_{400}^{500}\lambda\cdot Sb(\lambda)d\lambda/\int_{400}^{500}Sb(\lambda)d\lambda$$

$$\lambda g=\int_{500}^{600}\lambda\cdot Sg(\lambda)d\lambda/\int_{500}^{600}Sg(\lambda)d\lambda$$

$$\lambda i=\int_{400}^{700}\lambda\cdot Si(\lambda)d\lambda/\int_{400}^{700}Si(\lambda)d\lambda$$

In the formulae, Sb(λ), Sg(λ) and Si(λ) represent the spectral sensitivity distributions at a color density of 0.5 of the blue-sensitive layer, green-sensitive layer and interimage effects imparting layer, respectively. λi, for separating the same from the ordinary color-sensitive layers, is determined from the result, at a blackening degree of 0.2, of black and white development of a sample obtained by coating with a single layer of the emulsion of the present invention.

It is requisite that λb satisfy the relationship: 420 nm≦λb≦500 nm. Preferably, 450 nm≦λb≦490 nm, and more preferably, 460 nm≦λb≦480 nm. It is requisite that λg satisfy the relationship: 520 nm≦λg≦580 nm. Preferably, 535 nm≦λg≦560 nm, and more preferably, 545 nm≦λg≦555 nm. It is requisite that λi satisfy the relationship: 490 nm≦λi≦560 nm, and that the layer be one exhibiting an orange color and having sensitivity to cyan light. Preferably, 510 nm≦λi≦540 nm, and more preferably, 520 nm≦λi≦535 nm. With respect to λg and λi, it is preferred that these satisfy the relationship: λg−λi≦10 nm.

For realizing the desired absorption wavelength of λi, it is preferred that the silver halide emulsion used in the layer be doped with a quinoline spectral sensitizing dye described in JP-A-5-341429 or a sensitizing dye described in JP-A-7-146525. Further, for the regulation of λi, the method of mixing the above spectral sensitizing dye with a sensitizing dye for use in the green-sensitive layer emulsion at an arbitrary ratio and adding the mixture is employed.

The absorption wavelength of the thus spectrally sensitized interimage effects imparting layer (CL layer) corresponds to a wavelength region known as "negative spectral sensitivity" with respect to the spectral sensitivity possessed by human eyes. The interimage effects imparting layer plays an important role in the realization of faithful color reproduction, which is an object of the present invention, through the imparting of interimage effects from the layer to other color-sensitive layers.

The interimage effects imparting layer, like ordinary red-sensitive, green-sensitive and blue-sensitive emulsion layers, contains color forming couplers and can produce color forming dyes through a reduction reaction of silver halides contained in the layer. With respect to formed hue, it is preferred that a color being in the complementary color relationship with the absorption wavelength of the layer be formed. Especially, in the use of the CL layer, it is most preferred that a magenta color, or two colors, which are magenta and yellow, be formed.

However, more preferably, the interimage effects imparting layer substantially does not form any color (colorless) upon development color processing. Although a coupler being in the complementary color relationship with the absorption wavelength of the interimage effects imparting layer may be contained, in that event it is preferred that the coupler be ½ or less, more preferably ⅕ or less, of all the couplers contained in the coating of lightsensitive material. From the viewpoint of completely inhibiting a dye formation, it is preferred that a colorless compound forming coupler be contained in the layer. When no color is formed as mentioned above, the layer becomes one which is present only for exerting interimage effects on other color-sensitive layers.

The magnitude of interimage effects exerted in the color reversal lightsensitive material of the present invention can be estimated by the following procedure. The estimating procedure will be described with reference to an example wherein the layer exerting interimage effects consists of a green-sensitive emulsion layer while the layer on which interimage effects are exerted consists of a red-sensitive emulsion layer.

A sample is subjected to 1/50 sec wedge exposure by green monochromatic light capable of maximizing the value of spectral sensitivity of the green-sensitive emulsion layer.

Subsequently, the sample is subjected to 1/50 sec uniform exposure by red monochromatic light capable of maximizing the value of spectral sensitivity of the red-sensitive emulsion layer. In this exposure, there are provided two stages of exposure quantities regulated so that the color density of red-sensitive emulsion layer having been irradiated only with red light became D=0.5 and D=1.5.

Thereafter, the exposed sample is developed according to the following processing conditions A.

The cyan, magenta and yellow densities of the obtained sample are measured, and the color density of each of the color-sensitive emulsion layers is determined. In the present invention, all the color densities are in terms of status A integral density. The method of determining the status A integral density is described in, for example, T. H. James, The Theory of the Photographic Process, 4th ed. (1977), chapter 18.

The obtained color densities are plotted versus the logarithm of green monochromatic light exposure quantity. The point-gamma value of density of red-sensitive emulsion layer at a point where the color densities of red-sensitive emulsion layer and green-sensitive emulsion layer cross each other at a density of 0.5 is $\gamma_{IE}$(G/R: 0.5) and provides a measure of the magnitude of interimage effects. In the same manner, the point-gamma value of density of red-sensitive emulsion layer at a point where the color densities of red-sensitive emulsion layer and green-sensitive emulsion layer cross each other at a density of 1.5 is $\gamma_{IE}$(G/R: 1.5) (see FIGURE). The point-gamma referred to in the present invention is defined by the following formula, as described in T. H. James, The Theory of the Photographic Process, 4th ed.(1977), chapter 18, page 502, and is a differential value at an arbitrary point on a characteristic curve.

$$\text{Point-gamma}=dD/d\log E.$$

In the same manner, there can be determined $\gamma_{IE}$(B/R: 0.5), $\gamma_{IE}$(B/R: 1.5), $\gamma_{IE}$(R/G: 0.5), $\gamma_{IE}$(R/G: 1.5), $\gamma_{IE}$(B/G: 0.5), $\gamma_{IE}$(B/G: 1.5), $\gamma_{IE}$(R/B: 0.5), $\gamma_{IE}$(R/B: 1.5), $\gamma_{IE}$(G/B: 0.5) and $\gamma_{IE}$(G/B: 1.5). The processing conditions are as follows.

Processing Conditions A for Estimating Interimage Effects:

| Step | Time (min) | Temp. (° C.) | Tank vol. (L) | Replenishment rate (mL/m²) |
|---|---|---|---|---|
| 1st. development | 6 | 38 | 37 | 2200 |
| 1st washing | 2 | 38 | 16 | 4000 |
| reversal | 2 | 38 | 17 | 1100 |
| color development | 6 | 38 | 30 | 2200 |
| prebleaching | 2 | 38 | 19 | 1100 |
| bleaching | 6 | 38 | 30 | 220 |
| fixing | 4 | 38 | 29 | 1100 |
| 2nd washing | 4 | 38 | 35 | 4000 |
| final rinse | 1 | 25 | 19 | 1100 |

The initial composition of each of the processing solutions is as indicated below. However, the processing solutions contain matters leached from the processed lightsensitive material.

| <1st developer> | <Tank solution> | <Replenisher> |
|---|---|---|
| Nitrilo-N,N,N-trimethylene phosphonic acid · pentasodium salt | 1.5 g | 1.5 g |
| Diethylenetriamine pentaacetic acid · pentasodium salt | 2.0 g | 2.0 g |
| Sodium sulfite | 30 g | 30 g |
| Hydroquinone · potassium monosulfonate | 20 g | 20 g |
| Potassium carbonate | 15 g | 20 g |
| Potassium bicarbonate | 12 g | 15 g |
| 1-phenyl-4-methyl-4-hydroxymethyl-3-pyrazolidone | 2.5 g | 3.0 g |
| Potassium bromide | 2.5 g | 1.4 g |
| Potassium thiocyanate | 1.2 g | 1.2 g |
| Potassium iodide | 2.0 mg | — |
| Diethyleneglycol | 13 g | 15 g |
| Water to make | 1,000 mL | 1,000 mL |
| pH | 9.60 | 9.60 |

The pH was adjusted by sulfuric acid or potassium hydroxide.

| <Reversal solution> | <Tank solution> | <Replenisher> |
|---|---|---|
| Nitrilo-N,N,N-trimethylene phosphonic acid · pentasodium salt | 3.0 g | the same as tank solution |
| Stannous chloride · dihydrate | 1.0 g | |
| p-aminophenol | 0.1 g | |
| Sodium hydroxide | 8 g | |
| Glacial acetic acid | 15 mL | |
| Water to make | 1,000 mL | |
| pH | 6.00 | |

The pH was adjusted by acetic acid or sodium hydroxide.

| <Color developer> | <Tank solution> | <Replenisher> |
|---|---|---|
| Nitrilo-N,N,N-trimethylene phosphonic acid · pentasodium salt | 2.0 g | 2.0 g |
| Sodium sulfite | 7.0 g | 7.0 g |
| Trisodium phosphate · dodecahydrate | 36 g | 36 g |
| Potassium bromide | 1.0 g | — |
| Potassium iodide | 90 mg | — |
| Sodium hydroxide | 12.0 g | 12.0 g |
| Citrazinic acid | 0.5 g | 0.5 g |
| N-ethyl-N-(β-methanesulfon amidoethyl)-3-methyl-4 aminoaniline · 3/2 sulfuric acid · monohydrate | 10 g | 10 g |
| 3,6-dithiaoctane-1,8-diol | 1.0 g | 1.0 g |
| Water to make | 1,000 mL | 1,000 mL |
| ph | 11.80 | 12.00 |

The pH was adjusted by sulfuric acid or potassium hydroxide.

| <Pre-bleaching solution> | <Tank solution> | <Replenisher> |
|---|---|---|
| Ethylenediaminetetraacetic acid · disodium salt · dihydrate | 8.0 g | 8.0 g |
| Sodium sulfite | 6.0 g | 8.0 g |
| 1-thioglycerol | 0.4 g | 0.4 g |
| Formaldehyde sodium bisulfite adduct | 30 g | 35 g |
| Water to make | 1,000 mL | 1,000 mL |
| pH | 6.3 | 6.10 |

The pH was adjusted by acetic acid or sodium hydroxide.

| <Bleaching solution> | <Tank solution> | <Replenisher> |
|---|---|---|
| Ethylenediaminetetraacetic acid · disodium salt · dihydrate | 2.0 g | 4.0 g |
| Ethylenediaminetetraacetic acid · Fe(III) · aminonium · dihydrate | 120 g | 240 g |
| Potassium bromide | 100 g | 200 g |
| Ammonium nitrate | 10 g | 20 g |
| Water to make | 1,000 mL | 1,000 mL |
| pH | 5.70 | 5.50 |

The pH was adjusted by nitric acid or sodium hydroxide.

| <Fixing solution> | <Tank solution> | <Replenisher> |
|---|---|---|
| Ammonium thiosulfate | 80 g | the same as tank solution |
| Sodium sulfite | 5.0 g | |
| Sodium bisulfite | 5.0 g | |
| Water to make | 1,000 mL | |
| pH | 6.60 | |

The pH was adjusted by acetic acid or ammonia water.

| <Stabilizer> | <Tank solution> | <Replenisher> |
|---|---|---|
| 1,2-benzoisothiazoline-3-one | 0.02 g | 0.03 g |
| Polyoxyethylene-p-monononyl phenylether (average polymerization degree = 10) | 0.3 g | 0.3 g |
| Polymaleic acid (weight average molecular weight = 2,000) | 0.1 g | 0.15 g |
| Water to make | 1,000 mL | 1,000 mL |
| pH | 7.0 | 7.0 |

In the above development process, the solution was continuously circulated and stirred in each bath. In addition, a blowing pipe having small holes 0.3 mm in diameter formed at intervals of 1 cm was attached to the lower surface of each tank to continuously blow nitrogen gas to stir the solution.

The silver halide emulsion layer capable of imparting interimage effects, although can be arranged at an arbitrary position, is preferably arranged close to a red-sensitive layer. In a layer arrangement wherein a blue-sensitive layer is disposed at the remotest position from a support and a red-sensitive layer is disposed at the closest position to the support with a green-sensitive layer disposed between the layers, as generally realized in the color reversal photographic material, the interimage effects imparting layer is preferably arranged at a position closer to the support than the blue-sensitive layer, more preferably at a position closer to the support than the green-sensitive layer, and most preferably between the red-sensitive layer and the support.

The silver halide emulsion layer capable of imparting interimage effects, and/or interlayer separating the interimage effects imparting silver halide emulsion layer from other color-sensitive layers is preferably loaded with a competing compound (compound which reacts with color developing agent oxidation products while competing with image forming couplers but does not form any dye images). The competing compound can be, for example, a reducing compound selected from among hydroquinones, catechols, hydrazines, sulfonamidophenols, etc. or a compound which couples with color developing agent oxidation products but substantially does not form color images (e.g., any of colorless compound forming couplers as disclosed in DE No. 1,155,675, GB No. 861,138 and U.S. Pat. Nos. 3,876,428 and 3,912,513, or any of couplers forming dyes which outflow during processing, as disclosed in JP-A-6-83002). The addition amount of competing compound is preferably in the range of 0.01 to 10 g, more preferably 0.10 to 5.0 g, per $m^2$ of lightsensitive material.

The lightsensitive material of the present invention comprises a support and, superimposed thereon, at least one blue-sensitive silver halide emulsion layer, green-sensitive silver halide emulsion layer and red-sensitive silver halide emulsion layer. It is preferred that these layers be provided by coating in this sequence from the remotest side from the support. However, the coating may be performed in a sequence different therefrom. In the present invention, it is preferred that the coating be performed in the sequence of, from the side close to the support, a red-sensitive silver halide emulsion layer, a green-sensitive silver halide emulsion layer and a blue-sensitive silver halide emulsion layer. Preferably, each of these color sensitive layers has a unit constitution including a plurality of light-sensitive emulsion layers with different photographic speeds. It is especially preferred that each of these color sensitive layers have a three-layer unit constitution composed of three lightsensitive emulsion layers consisting of a low-speed layer, an intermediate-speed layer and a high-speed layer arranged in this sequence from the side close to the support. These are described in, for example, JP-B-49-15495 and JP-A-59-202464.

As one of the preferable mode of the present invention, there can be mentioned the lightsensitive element in which the respective layers are coated, on a support, in order of an undercoat layer/an antihalation layer/the first intermediate layer/the red-sensitive emulsion layer unit (comprising 3 layers of a low-speed red-sensitive layer/a medium-speed red-sensitive layer/a high-speed red-sensitive layer from the near side of the support)/the second intermediate layer/the green-sensitive emulsion layer unit(comprising 3 layers of a low-speed green-sensitive layer/a medium-speed green-sensitive layer/a high-speed green-sensitive layer from the near side of the support)/the third intermediate layer/an yellow filter layer/the blue-sensitive emulsion layer unit (comprising 3 layers of a low-speed blue-sensitive layer/a medium-speed blue-sensitive layer/a high-speed blue-sensitive layer from the near side of the support)/the first protective layer/the second protective layer.

Each of the first intermediate layer, the second intermediate layer and the third intermediate layer may be one layer or 2 layers or more. The first intermediate layer is further divided into 2 or more layers, and yellow colloid is preferably contained in a layer directly adjacent to the red-sensitive layer. Similarly, the second intermediate layer has also a constitution of 2 layers or more, and yellow colloid is preferably contained in a layer directly adjacent to the green-sensitive layer. Furthermore, the fourth intermediate layer is further preferably possessed between the yellow filter layer and the blue-sensitive emulsion layer unit. Couplers and DIR compounds described in the specifications of JP-A's-61-43748, 59-113438, 59-113440, 61-20037 and 61-20038 may be contained in said intermediate layer, and a color-mixing preventive may be contained as usually used.

Further, it is preferable that the protective layer has a constitution of 3 layers of the first protective layer to the third protective layer. When the protective layer is 2 layers or 3 layers, it is preferable that silver halide fine grain having an average equivalent-sphere grain diameter of 0.10 $\mu$m or less is contained in the second protective layer. A composition of said silver halide fine grain is preferably silver bromide or silver iodobromide.

The silver halide color photographic material of the present invention may include not only the above short wave green-sensitive silver halide emulsion layer but also an arbitrary color-sensitive emulsion layer having an interimage imparting capability substantially without any color image formation as disclosed in U.S. Pat. No. 5,932,401. Moreover, an interimage effects donor layer whose spectral sensitivity distribution is different from those of principal lightsensitive layers such as BL, GL and RL layers as described in U.S. Pat. Nos. 4,663,271, 4,705,744 and 4,707,436 and JP-A's-62-160448 and 63-89850 can be disposed at a position neighboring (adjacent) or proximate to the principal lightsensitive layers.

The lightsensitive material of the present invention comprises an image forming coupler. The image forming coupler refers to a coupler which couples with an oxidation product of aromatic primary amine color developing agent to thereby form an image. forming dye. Generally, a color image is obtained by the use of a combination of yellow coupler, magenta coupler and cyan coupler.

The image forming coupler of the present invention is preferably added to a lightsensitive emulsion layer which is sensitive to light being in the complementary color relationship with the hue formed by the image forming coupler. That is, a yellow coupler is added to the blue-sensitive emulsion layer, a magenta coupler to the green-sensitive emulsion layer, and a cyan coupler to the red-sensitive emulsion layer. Furthermore, for example, in order to enhance a shadow descriptive capability, a coupler not being in any complementary color relationship may be mixed therein (for example, joint use of a cyan coupler in a green-sensitive emulsion layer).

Preferable image forming couplers for use in the lightsensitive material of the present invention include the following.

Yellow Couplers couplers represented by formulae (I) and (II) in EP No. 502,424A; couplers represented by formulae (1) and (2) in EP No. 513,496A (e.g., Y-28 on page 18); a coupler represented by formula (I) in claim 1 of EP No. 568,037A; a coupler represented by general formula (I) in column 1, lines 45 to 55, in U.S. Pat. No. 5,066,576; a coupler represented by general formula (I) in paragraph 0008 of JP-A-4-274425; couplers described in claim 1 on page 40 in EP No. 498,381A1 (e.g., D-35); couplers represented by formula (Y) on page 4 in EP No. 447,969A1 (e.g., Y-1 and Y-54); couplers represented by formulae (II) to (IV) in column 7, lines 36 to 58, in U.S. Pat. No. 4,476,219;, etc.

Magenta Couplers couplers listed in JP-A-3-39737 (e.g., L-57, L-68 and L-77); couplers listed in EP No. 456,257A (e.g., A-4-63, A-4-73 and A-4-75); couplers listed in EP No. 486,965A (e.g., M-4, M-6 and M-7); couplers listed in EP No. 571, 959A (e.g., M-45); couplers listed in JP-A-5-204106 (e.g., M-1); couplers listed in JP-A-4-362631 (e.g., M-22); couplers represented by general formula (MC-1) in JP-A-11-119393 (e.g., CA-4, CA-7, CA-12, CA-15, CA-16 and CA-18); etc.

Cyan Couplers couplers listed in JP-A-4-204843 (e.g., CX-1, 3, 4, 5, 11, 12, 14 and 15); couplers listed in JP-A-4-43345 (e.g., C-7, 10, 34, 35, (I-1) and (I-17)); couplers represented by general formulae (Ia) and (Ib) in claim 1 of JP-A-6-67385; couplers represented by general formula (PC-1) in JP-A-11-119393 (e.g., CB-1, CB-4, CB-5, CB-9, CB-34, CB-44, CB-49 and CB-51); couplers represented by general formula (NC-1) in JP-A-11-119393 (e.g., CC-1 and CC-17); etc.

These couplers can be introduced in the lightsensitive material by various known dispersing methods. The introduction can preferably be effected by the in-water oil droplet dispersing method wherein a coupler is dissolved in a high-boiling organic solvent (if necessary, in combination with a low-boiling solvent), emulsified in an aqueous solution of gelatin and added to a silver halide emulsion.

Examples of the high-boiling solvents for use in the in-water oil droplet dispersing method are listed in, for example, U.S. Pat. No. 2,322,027. With respect to a latex dispersing method as one of polymer dispersing methods, the process, effects and examples of immersion latexes are described in, for example, U.S. Pat. No. 4,199,363, DE (OLS) Nos. 2,541,274 and 2,541,230, JP-B-53-41091 and EP No. 029104A. Further, a dispersion by organic solvent soluble polymer is described in WO No. 88/00723.

Examples of the high-boiling solvents which can be employed in the above in-water oil droplet dispersing method include phthalic acid esters (e.g., dibutyl phthalate, dioctyl phthalate, dicyclohexyl phthalate, bis(2-ethylhexyl) phthalate, decyl phthalate, bis(2,4-di-tert-amylphenyl) isophthalate and bis(1,1-diethylpropyl) phthalate), esters of phosphoric acid or phosphonic acid (e.g., diphenyl phosphate, triphenyl phosphate, tricresyl phosphate, 2-ethylhexyl diphenyl phosphate, dioctyl butyl phosphate, tricyclohexyl phosphate, tri-2-ethylhexyl phosphate, tridecyl phosphate and bis(2-ethylhexyl) phenyl phosphate), benzoic acid esters (e.g., 2-ethylhexyl benzoate, 2,4-dichlorobenzoate, dodecyl benzoate and 2-ethylhexyl p-hydroxybenzoate), amides (e.g., N,N-diethyldodecanamide, N,N-diethyllaurylamide and N,N,N,N-tetrakis(2-ethylhexyl)isophthalamide), alcohols or phenols (e.g., isostearyl alcohol and 2,4-di-tert-amylphenol), aliphatic esters (e.g., dibutoxyethyl succinate, bis(2-ethylhexyl) succinate, 2-hexyldecyl tetradecanoate, tributyl citrate, diethyl azelate, isostearyl lactate and trioctyl citrate), aniline derivatives (e.g., N,N-dibutyl-2-butoxy-5-tert-octylaniline), chlorinated paraffins (paraffins of 10 to 80% chlorine content), trimesic acid esters (e.g., tributyl trimesate), dodecylbenzene, diisopropylnaphthalene, phenols (e.g., 2,4-di-tert-amylphenol, 4-dodecyloxyphenol, 4-dodecyloxycarbonylphenol and 4-(4-dodecyloxyphenylsulfonyl)phenol), carboxylic acids (e.g., 2-(2,4-di-tert-amylphenoxy)butyric acid and 2-ethoxyoctanedecanoic acid) and alkylphosphoric acids (e.g., bis(2-ethylhexyl)phosphoric acid and diphenylphosphoric acid). Besides these high-boiling solvents, it is also preferred to use, for example, compounds of JP-A-6-258803 as high-boiling solvents.

With respect to the amount of high-boiling organic solvent used in combination with the couplers, the weight ratio thereof to coupler is preferably in the range of 0 to 2.0, more preferably 0 to 1.0, and most preferably 0 to 0.4. Further, as an auxiliary solvent, an organic solvent having a boiling point of 30 to about 160° C. (e.g., ethyl acetate, butyl acetate, ethyl propionate, methyl ethyl ketone, cyclohexanone, 2-ethoxyethyl acetate or dimethylformamide) may be used in combination therewith.

With respect to the coupler content of the lightsensitive material, the total weight of yellow coupler, magenta coupler and cyan coupler is preferably in the range of 0.01 to 10 g, more preferably 0.1 to 2 g, per $m^2$ of lightsensitive material. In a light-sensitive emulsion layer of single speed, the coupler content is suitably in the range of $1\times10^{-3}$ to 1 mol, preferably $2\times10^{-3}$ to $3\times10^{-1}$ mol, per mol of silver halides.

When each lightsensitive layer has a unit constitution composed of a plurality of lightsensitive emulsion layers of different photographic speeds, the content of coupler of the present invention per mol of silver halides is preferably in the range of $2\times10^{-3}$ to $2\times10^{-1}$ mol with respect to the layer of the lowest speed, and $3\times10^{-2}$ to $3\times10^{-1}$ mol with respect to the layer of the highest speed. It is preferred to employ a layer arrangement wherein, the higher the speed of emulsion layer, the greater the amount of coupler contained in the layer.

The lightsensitive material of the present invention may further be loaded with a competing compound (compound which reacts with color developing agent oxidation products while competing with image forming couplers but does not form any dye images). The competing compound can be, for example, a reducing compound selected from among hydroquinones, catechols, hydrazines, sulfonamidophenols, etc. or a compound which couples with color developing agent oxidation products but substantially does not form color images (e.g., any of colorless compound forming couplers as disclosed in DE No. 1,155,675, GB No. 861,138 and U.S. Pat. Nos. 3,876,428 and 3,912,513 or any of couplers forming dyes which outflow during processing, as disclosed in JP-A-6-83002).

In the lightsensitive material of the present invention, a non-color-forming interlayer may be incorporated in a lightsensitive unit of single color sensitivity. Further, a compound which can be selected as the above competing compound is preferably contained in the interlayer.

For preventing the deterioration of photographic performance by formaldehyde gas, it is preferred that the lightsensitive material of the present invention be loaded with a compound capable of reacting with formaldehyde gas to thereby immobilize it as described in U.S. Pat. Nos. 4,411,987 and 4,435,503.

The emulsions other than the emulsion of the interimage effects imparting layer for use in the silver halide photographic material of the present invention will now be described. The emulsions preferably contain tabular silver halide grains having an aspect ratio of 1.5 to less than 100.

The aspect ratio of tabular grains refers to the quotient of grain diameter divided by grain thickness. The grain thickness can be easily determined by performing a vapor deposition of metal on grains, together with reference latex, in an oblique direction thereof, measuring the length of grain shadow on an electron micrograph and calculating with reference to the length of latex shadow.

In the present invention, the grain diameter refers to the diameter of a circle having the same area as the projected area of mutually parallel principal surfaces of grain (equivalent circle diameter).

The projected area of grains can be obtained by measuring the grain area on an electron micrograph and effecting a magnification correction thereto.

The diameter of tabular grains is preferably in the range of 0.3 to 5.0 μm. The thickness of tabular grains is preferably in the range of 0.05 to 0.5 μm.

The sum of respective projected areas of tabular grains for use in the present invention preferably occupies 50% or more, more preferably 80% or more, of the sum of respective projected areas of all the silver halide grains contained in the emulsion. The aspect ratio of these tabular grains occupying a given area is preferably in the range of 1.5 to less than 100, more preferably 2 to less than 20, and most preferably 2 to less than 8.

More preferred results may be attained by the use of monodisperse tabular grains. The structure of monodisperse tabular grains and the process for producing the same are as described in, for example, JP-A-63-151618. A brief description of the configuration thereof is as follows. At least 70% of the total projected area of silver halide grains is occupied by tabular silver halide grains which are shaped like a hexagon having a ratio of the length of the side with the largest length to the length of the side with the smallest length of 2 or less on a principal surface and which have two mutually parallel planes as external surfaces. Moreover, the hexagonal tabular silver halide grains are so monodispersed as to exhibit a variation coefficient of grain diameter distribution (value obtained by dividing a variation (standard deviation) of grain diameter by an average grain diameter and multiplying the quotient by 100) of 20% or less.

The tabular grains for use in the present invention more preferably have dislocation.

The dislocation of the tabular grains for use in the present invention is positioned in the zone extending to the side from a distance of x % of the length from the center to the side along the direction of the major axis of the tabular grains. This x preferably satisfies the relationship $10 \leqq x < 100$, more preferably $30 \leqq x < 98$, and most preferably $50 \leqq x < 95$. The configuration created by tying positions at which the dislocation starts is approximately similar to the grain form but is not a completely similar form and may be slightly twisted. The direction of a dislocation line approximately agrees with the direction oriented from the center to the side but is often zigzagged.

With respect to the number of dislocations of the tabular grains for use in the present invention, preferably, grains having 10 or more dislocations occupy 50% or more of the total number of grains. More preferably, grains having 10 or more dislocations occupy 80% or more of the total number of grains. Most preferably, grains having 20 or more dislocations occupy 80% or more of the total number of grains.

The process for producing tabular grains for use in the present invention will be described below.

The tabular grains for use in the present invention can be prepared according to processes improved from those described in, for example, Cleve, Photogra-phy Theory and Practice (1930), page 13; Gutuff, Photo-graphic Science and Engineering, vol. 14, p.p. 248–257 (1970); U.S. Pat. Nos. 4,434,226, 4,414,310, 4,433,048 and 4,439,520; and GB No. 2,112,157.

Any of the silver halide compositions including silver bromide, silver iodobromide, silver iodochlorobromide and silver chlorobromide may be used in the tabular silver halide grains for use in the present invention. Preferred silver halide composition is a silver iodobromide or silver iodochlorobromide containing 30 mol % or less of silver iodide.

Using gelatin of low methionine content in the step of nucleation for grain formation as described in U.S. Pat. Nos. 4,713,320 and 4,942,120, performing nucleation at a high pBr as described in U.S. Pat. 4,914,014, and performing nucleation within a short period of time as described in JP-A-2-222940 are extremely effective in the preparation of tabular grains. Performing ripening in the presence of a low-concentration base as described in U.S. Pat. No. 5,254,453 and performing ripening at a high pH as described in U.S. Pat. No. 5,013,641 may be effective in the step of ripening tabular grains.

The method of forming tabular grains with the use of polyalkylene oxide compounds as described in U.S. Pat. Nos. 5,147,771, 5,147,772, 5,147,773, 5,171,659, 5,210,013 and 5,252,453 can preferably be employed in the preparation of core grains for use in the present invention.

Supplemental addition of gelatin may be effected during the grain formation in order to obtain monodisperse tabular grains of high aspect ratio. The supplemental gelatin is preferably a chemically modified gelatin as described in JP-A's-10-148897 and 11-143002, or a gelatin of low methionine content as described in U.S. Pat. Nos. 4,713,320 and 4,942,120. In particular, the former chemically modified gelatin is a gelatin characterized in that at least two carboxyl groups have newly been introduced at a chemical modification of amino group contained in the gelatin. Gelatin succinate or gelatin trimellitate is preferably used. The chemically modified gelatin is preferably added prior to the growth step, more preferably immediately after the nucleation. The addition amount thereof is 50% or more, preferably 70% or more, based on the total weight of dispersion medium provided during grain formation.

As the silver halide solvent which can be used in the present invention, there can be mentioned the same solvents as aforementioned with respect to the silver halide grains for use in the interimage effects imparting layer.

The dislocation of tabular grains for use in the present invention is introduced by forming a high iodide phase in the internal portion of grains.

The high iodide phase refers to a silver halide solid solution containing an iodide. As the silver halide for use therein, silver iodide, silver iodobromide or silver chloroiodobromide is preferred. Silver iodide or silver iodobromide is more preferred, and silver iodide is most preferred.

The amount, in terms of silver quantity, of silver halides forming the high iodide phase is 30 mol % or less, preferably 10 mol % or less, based on the total silver quantity of grains.

It is requisite that the iodide content of a phase grown outside the high iodide phase be lower than that of the high iodide phase. The iodide content of outside phase is preferably in the range of 0 to 12 mol %, more preferably 0 to 6 mol %, and most preferably 0 to 3 mol %.

A preferred method of forming a high iodide layer comprises adding an emulsion of silver iodobromide or silver iodide fine grains. In this formation, use can be made of the same method as in the above formation of the high iodide layer of interimage effects imparting layer emulsion.

With respect to the silver halide grains which can be employed in the present invention, it is preferred that the variation coefficient of intergranular silver iodide content distribution be 20% or less. The variation coefficient is more preferably 15% or less, and most preferably 10% or less. When the variation coefficient is greater than 20%, unfavorably, a high contrast would not be obtained and, under pressure, a sensitivity decrease would be large.

With respect to the silver halide emulsion which can be employed in the present invention, the reduction sensitizing method, reduction sensitizer, oxidizer, binder for protective colloid and other hydrophilic colloid layers, desalting method, metal ion salt for use in emulsion preparation, chemical sensitization method, method of using calcium and/or magnesium and content thereof, method of using a water soluble mercaptotetrazole compound, a mercaptothiazole and other antifoggants and a photographic performance stabilizing agent and addition amount thereof can be the same as aforementioned with respect to the silver halide grains (silver halide grains of the present invention) for use in the interimage effects imparting layer.

Photographic emulsions used in the present invention can achieve high color saturation when spectrally sensitized by preferably methine dyes and the like. Usable dyes involve a cyanine dye, merocyanine dye, composite cyanine dye, composite merocyanine dye, holopolar cyanine dye, hemicyanine dye, styryl dye, and hemioxonole dye. Most useful dyes are those belonging to a cyanine dye, merocyanine dye, and composite merocyanine dye. These dyes can contain any nucleus commonly used as a basic heterocyclic nucleus in cyanine dyes. Examples are a pyrroline nucleus, oxazoline nucleus, thiazoline nucleus, pyrrole nucleus, oxazole nucleus, thiazole nucleus, selenazole nucleus, imidazole nucleus, tetrazole nucleus, and pyridine nucleus; a nucleus in which an aliphatic hydrocarbon ring is fused to any of the above nuclei; and a nucleus in which an aromatic hydrocarbon ring is fused to any of the above nuclei, e.g., an indolenine nucleus, benzindolenine nucleus, indole nucleus, benzoxadole nucleus, naphthoxazole nucleus, benzthiazole nucleus, naphthothiazole nucleus, benzoselenazole nucleus, benzimidazole nucleus, and quinoline nucleus. These nuclei can be substituted on a carbon atom.

It is possible to apply to a merocyanine dye or a composite merocyanine dye a 5- or 6-membered heterocyclic nucleus as a nucleus having a ketomethylene structure. Examples are a pyrazoline-5-one nucleus, thiohydantoin nucleus, 2-thiooxazolidine-2,4-dione nucleus, thiazolidine-2,4-dione nucleus, rhodanine nucleus, and thiobarbituric acid nucleus.

Although these sensitizing dyes can be used singly, they can also be combined. The combination of sensitizing dyes is often used for a supersensitization purpose. Representative examples of the combination are described in U.S. Pat. Nos. 2,688,545, 2,977,229, 3,397,060, 3,522,0523, 3,527,641, 3,617,293, 3,628,964, 3,666,480, 3,672,898, 3,679,4283, 3,703,377, 3,769,301, 3,814,609, 3,837,862, and 4,026,707, British Patents 1,344,281 and 1,507,803, JP-B's-43-4936 and 53-12375, and JP-A's-52-110618 and 52-109925, the disclosures of which are incorporated herein by reference.

In addition to sensitizing dyes, emulsions can contain dyes having no spectral sensitizing effect or substances not substantially absorbing visible light and presenting supersensitization.

Sensitizing dyes can be added to an emulsion at any point conventionally known to be useful during the preparation of an emulsion. Most ordinarily, sensitizing dyes are added after the completion of chemical sensitization and before coating. However, it is possible to perform the addition simultaneously with the addition of chemical sensitizing dyes to thereby perform spectral sensitization and chemical sensitization at the same time, as described in U.S. Pat. Nos. 3,628,969 and 4,225,666, the disclosures of which are incorporated herein by reference. It is also possible to perform the addition prior to chemical sensitization, as described in JP-A-58-113928, the disclosure of which is incorporated herein by reference, or before the completion of the formation of a silver halide grain precipitate to thereby start spectral sensitization. Alternatively, as disclosed in U.S. Pat. No. 4,225,666, these sensitizing dyes can be added separately; a portion of the sensitizing dyes is added prior to chemical sensitization, and the rest is added after that. That is, sensitizing dyes can be added at any timing during the formation of silver halide grains, including the method disclosed in U.S. Pat. No. 4,183,756, the disclosure of which is incorporated herein by reference.

The addition amount thereof can be in the range of $4\times10^{-6}$ to $8\times10^{-3}$ mol per mol of silver halides.

The silver halide grains other than the tabular grains used in the lightsensitive material of the present invention will be described below.

Preferred silver halide grain composition contained in photographic emulsion layers of the photographic material of the present invention is a silver iodobromide, silver iodochloride or silver iodochlorobromide containing about 30 mol % or less of silver iodide. Especially preferred silver halide grain composition is a silver iodobromide or silver iodochlorobromide containing about 1 to about 10 mol % of silver iodide.

Silver halide grains contained in each photographic emulsion may be those having regular crystals such as cubic, octahedral or tetradecahedral crystals, those having regular crystal form such as spherical or tabular crystal form, those having crystal defects such as twin faces, or composite forms thereof.

The silver halide grains may consist of fine grains having a grain diameter of about 0.2 $\mu$m or less, or large grains having a projected area diameter of up to about 10 $\mu$m. The emulsion may be a polydisperse or monodisperse emulsion.

The silver halide photographic emulsion which can be used in the present invention can be prepared by methods described in, e.g., Research Disclosure (RD) No. 17643 (December, 1978), pp. 22 and 23, "I. Emulsion preparation and types"; RD No. 18716 (November, 1979), page 648; RD No. 307105 (November, 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

It is also preferred to use monodisperse emulsions described in U.S. Pat. Nos. 3,574,628 and 3,655,394 and GB No. 1,413,748.

The crystal structure can be uniform, can have halogen compositions which are different between the inner part and the outer part thereof, or can be a layered structure. Alternatively, by an epitaxial junction, each silver halide grain can be bonded with a silver halide having a different composition, or can be bonded with a compound other than silver halide such as silver rhodanide or lead oxide. A mixture of grains having various crystal forms can also be used.

The above emulsion may be any of the surface latent image type in which latent images are mainly formed in the surface, the internal latent image type in which latent images are formed in the internal portion of grains and the type in which latent images exist in both the surface and the internal portion of grains. However, it is requisite that the emulsion be a negative type. The emulsion of the internal latent image type may specifically be, for example, a core/shell internal-latent-image type emulsion described in JP-A-63-264740. The process for producing the core/shell internal-latent-image type emulsion is described in JP-A-59-133542. The thickness of the shell of this emulsion, although varied depending on development processing, etc., is preferably in the range of 3 to 40 nm, more preferably 5 to 20 nm.

Silver halide grains having a grain surface fogged as described in U.S. Pat. No. 4,082,553, silver halide grains having a grain internal portion fogged as described in U.S. Pat. No. 4,626,498 and JP-A-59-214852 and colloidal silver can preferably be used in lightsensitive silver halide emulsion layers and/or substantially nonlightsensitive hydrophilic colloid layers. The expression "silver halide grains having a grain surface or grain internal portion fogged" refers to silver halide grains which can be developed uniformly (nonimagewise) irrespective of the nonexposed or exposed zone of lightsensitive material. The process for producing the silver halide grains having a grain surface or grain internal portion fogged is described in U.S. Pat. No. 4,626,498 and JP-A-59-214852.

The silver halides constituting internal nuclei of core/shell silver halide grains having a grain internal portion fogged may have identical halogen composition or different halogen compositions. Any of silver chloride, silver chlorobromide, silver iodobromide and silver chloroiodobromide can be used as the composition of silver halide grains having a grain surface or grain internal portion fogged. Although the grain size of these fogged silver halide grains is not particularly limited, it is preferred that the equivalent sphere diameter thereof be in the range of 0.01 to 0.75 $\mu$m, especially 0.05 to 0.6 $\mu$m. With respect to grain configuration, although there is no particular limitation and both regular grains and a polydisperse emulsion can be used, monodispersity (at least 95% of the weight or number of silver halide grains have grain sizes falling within ±40% of the average grain size) is preferred.

Equivalent-sphere average diameter means a volume weighted average of equivalent-sphere diameter of grains contained in the emulsion. Equivalent-sphere diameter of grain means diameter of sphere which has the same volume as the one thereof.

In the lightsensitive material of the present invention, a mixture of a plurality of lightsensitive silver halide emulsions which are different from each other in at least one of the properties including grain size, grain size distribution, halide composition, grain configuration and sensitivity can be used in forming any single layer.

In the process for producing the photographic material of the present invention, generally, photographically useful materials are added to each photographic coating liquid. Specifically, the addition thereof is performed to a hydrophilic colloid liquid.

In silver halide photographic emulsions of the present invention and silver halide photographic light-sensitive materials using these emulsions, it is generally possible to use various techniques and inorganic and organic materials described in Research Disclosure Nos. 308119 (1989), 37038 (1995), and 40145 (1997), the disclosures of which are herein incorporated by reference.

In addition, techniques and inorganic and organic materials usable in color photographic light-sensitive materials to which silver halide photographic emulsions of the present invention can be applied are described in portions of EP436, 938A2 and patents cited below, the disclosures of which are herein incorporated by reference.

| Items | Corresponding portions |
|---|---|
| 1) Layer configurations | page 146, line 34 to page 147, line 25 |
| 2) Silver halide emulsions usable together | page 147, line 26 to page 148 line 12 |

-continued

| Items | Corresponding portions |
|---|---|
| 3) Yellow couplers usable together | page 137, line 35 to page 146, line 33, and page 149, lines 21 to 23 |
| 4) Magenta couplers usable together | page 149, lines 24 to 28; EP421, 453A1, page 3, line 5 to page 25, line 55 |
| 5) Cyan couplers usable together | page 149, lines 29 to 33; EP432, 804A2, page 3, line 28 to page 40, line 2 |
| 6) Polymer couplers | page 149, lines 34 to 38; EP435, 334A2, page 113, line 39 to page 123, line 37 |
| 7) Colored couplers | page 53, line 42 to page 137, line 34, and page 149, lines 39 to 45 |
| 8) Functional couplers usable together | page 7, line 1 to page 53, line 41, and page 149, line 46 to page 150, line 3; EP435, 334A2, page 3, line 1 to page 29, line 50 |
| 9) Antiseptic and mildewproofing agents | page 150, lines 25 to 28 |
| 10) Formalin scavengers | page 149, lines 15 to 17 |
| 11) Other additives usable together | page 153, lines 38 to 47; EP421, 453A1, page 75, line 21 to page 84, line 56, and page 27, line 40 to page 37, line 40 |
| 12) Dispersion methods | page 150, lines 4 to 24 |
| 13) Supports | page 150, lines 32 to 34 |
| 12. 14) Film thickness · film physical properties | page 150, lines 35 to 49 |
| 15) Color development step | page 150, line 50 to page 151, line 47 |
| 16) Desilvering step | page 151, line 48 to page 152, line 53 |
| 17) Automatic processor | page 152, line 54 to page 153, line 2 |
| 18) Washing · stabilizing step | page 153, lines 3 to 37 |

The silver halide color photographic material of the present invention is a color reversal photographic material premised on a color reversal processing including a sequence of black and white development, reversal and color development steps.

The entire color reversal processing of the present invention will be described below. First, the black and white development (1st development) as the first step will be described.

Known developing agents can be used in the black and white developer. Dihydroxybenzenes (e.g., hydroquinone and hydroquinonemonosulfonates), 3-pyrazolidones (e.g., 1-phenyl-3-pyrazolidone and 1-phenyl-4-methyl-4-hydroxymethyl-3-pyrazolidone), aminophenols (e.g., N-methyl-p-aminophenol and N-methyl-3-methyl-p-aminophenol), ascorbic acid, and isomers and derivatives thereof can be used individually or in combination as the developing agent. Preferred developing agents are potassium hydroquinonemonosulfonate and sodium hydroquinonemonosulfonate. The addition amount of these developing agents is in the range of about $1\times10^{-5}$ to 2 mol per liter of developer.

A preservative can be used in the black and white developer of the present invention, if necessary. A sulfite or a bisulfite is generally used as the preservative. The addition amount thereof is in the range of 0.01 to 1 mol/lit., preferably 0.1 to 0.5 mol/lit. Ascorbic acid is also an effective preservative, and the preferred addition amount thereof is in the range of 0.01 to 0.5 mol/lit. Furthermore, use can be made of hydroxylamines of the general formula (I) of JP-A-3-144446, saccharides, o-hydroxyketones and hydrazines. The addition amount thereof is 0.1 mol/lit. or less.

The pH value of the black and white developer for use in the present invention is preferably in the range of 8 to 12, most preferably 9 to 11. Various buffers can be used for maintaining an appropriate pH value. As preferred buffers, there can be mentioned, for example, carbonates, phosphates, borates, 5-sulfosalicylates, hydroxybenzoates, glycine salts, N,N-dimetylglycine salts, leucine salts, norleucine salts, guanine salts, 3,4-dihydroxyphenylalanine salts, alanine salts, aminobutyrates, valine salts and lysine salts. In particular, the use of carbonates, borates and 5-sulfosalicylates is preferred from the viewpoint of capability of maintaining the above pH range and low cost. These buffers may be used individually or in combination. Further, an acid and/or an alkali may be added to the black and white developer in order to obtain an intended pH value.

As the acid, there can be employed organic and inorganic water-soluble acids, examples of which include sulfuric acid, nitric acid, hydrochloric acid, acetic acid, propionic acid and ascorbic acid. As the alkali, various hydroxides and ammonium salts can be added to the black and white developer. Examples thereof include potassium hydroxide, sodium hydroxide, aqueous ammonia, triethanolamine and diethanolamine.

The black and white developer for use in the present invention preferably contains a silver halide solvent as a development accelerator. For example, any of a thiocyanate, a sulfite, a thiosulfate, 2-methylimidazole and a thioether compound described in JP-A-57-63580 is preferably used as the development accelerator. It is preferred that the addition amount of these compounds be approximately in the range of 0.005 to 0.5 mol/lit. As other development accelerators, there can be mentioned, for example, various quaternary amines, polyethylene oxides, 1-phenyl-3-pyrazolidones, primary amines and N,N,N',N'-tetramethyl-p-phenylenediamines.

As a dissolution auxiliary incorporated in the black and white developer for use in the present invention, there can be employed diethylene glycol, propylene glycol and other polyethylene glycols and further amines such as diethanolamine and triethanolamine. Moreover, not only a quaternary ammonium salt as a sensitizer but also various surfactants and a film hardener can be added to the black and white developer.

In the step of black and white development according to the present invention, various antifoggants may be added for preventing development fogging. Not only alkali metal halides such as sodium chloride, potassium chloride, potassium bromide, sodium bromide and potassium iodide but also organic antifoggants can preferably be used as the antifoggant. As organic antifoggants, there can be employed, for example, nitrogenous heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole and hydroxyazaindolizine; mercapto-substituted heterocyclic compounds such as 1-phenyl-5-mercaptotetrazole, 2-mercaptobenzimidazole and 2-mercaptobenzothiazole; and mercapto-substituted aromatic compounds such as thiosalicylic acid. These antifoggants include those leached from the color reversal lightsensitive material during the processing thereof and accumulated in the black and white developer.

Of these compounds, the addition concentration of iodides is approximately in the range of $5\times10^{-6}$ to $5\times10^{-4}$ mol/lit. Bromides can also preferably be used in fogging prevention. The concentration thereof is preferably in the range of approximately 0.001 to 0.1 mol/lit, more preferably 0.01 to 0.05 mol/lit.

Further, a swelling inhibitor (e.g., inorganic salt such as sodium sulfate or potassium sulfate) and a hard water softener can be added to the black and white developer of the present invention.

As the hard water softener, there can be employed compounds of various structures such as an aminopolycarboxylic acid, an aminopolyphosphonic acid, a phosphonocarboxylic acid and an organic-inorganic phosphonic acid. Examples thereof are as follows, to which, however, the available hard water softeners are not limited.

Examples of the hard water softeners include ethylenediaminetetraacetic acid, nitrilotriacetic acid, hydroxyethyliminodiacetic acid, propylenediaminetetraacetic acid, diethylenetriaminepentaacetic acid, triethylenetetraminehexaacetic acid, nitrilo-N,N,N-trimethylenephosphonic acid, ethylenediamine-N,N,N',N'-tetramethylenephosphonic acid and 1-hydroxyethylidene-1,1-diphosphonic acid. These hard water softeners may be used in combination. The addition amount thereof is preferably in the range of 0.1 to 20 g/lit., more preferably 0.5 to 10 g/lit.

The standard processing time of black and white development is 6 min. Sensitization and desensitization can be effected by appropriately changing the processing time. The processing time is generally changed within the range of 2 to 18 min. The processing temperature is in the range of 20° to 50° C., preferably 33° to 45° C. The quantity of replenisher fed for the black and white developer is approximately in the range of 100 to 5000 ml, preferably 200 to 2500 ml, per $m^2$ of lightsensitive material.

In the processing of the present invention, the lightsensitive material after the black and white development is washed and/or rinsed according to necessity, and is sequentially subjected to reversal processing and color development processing.

Although the washing or rinsing may be accomplished with the use of one bath only, it is preferred to carry out the washing or rinsing by a multistage countercurrent system wherein two or more tanks are employed with the intent to reduce the quantity of replenisher. Herein, the washing refers to means wherein a relatively large amount of water is supplied, while the rinsing refers to means wherein the quantity of replenisher is reduced to other processing bath levels. The quantity of replenisher fed for washing water is preferably in the range of approximately 3 to 20 lit. per $m^2$ of lightsensitive material. On the other hand, the quantity of replenisher fed for the rinsing bath is approximately in the range of 50 ml to 2 lit., preferably 100 to 500 ml, per $m^2$ of lightsensitive material. The amount of water used in the rinsing is far smaller than in the washing.

According to necessity, an oxidizer, a chelating agent, a buffer, a germicide, a brightening agent, etc. can be added to the rinsing bath of the present invention.

The resultant lightsensitive material is subjected to a reversal bath or photo-fogging step. A chemical fogging agent is added to the reversal bath. As the chemical fogging agent, there can be employed known fogging agents, for example, stannous ion complex salts such as stannous ion/organophosphate complex salts (U.S. Pat. No. 3,617,282), stannous ion/organophosphonocarboxylate complex salts (JP-B-56-32616) and stannous ion/aminopolycarboxylate complex salts (U.S. Pat. No. 1,209,050); stannous ion complex salts of chelating agents represented by the general formula (II) or (III) in JP-A-11-109573; and boric compounds such as boron hydride compounds (U.S. Pat. No. 2,984,567) and heterocyclic aminoborane compounds (GB No. 1,011,000). The pH value of the reversal bath widely ranges from the acid region to the alkali region, depending on the type of fogging agent. The pH value is in the range of 2 to 12, frequently 2.5 to 10, and especially 3 to 9.

The concentration of tin (II) ions in the reversal bath is in the range of $1\times10^{-3}$ to $5\times10^{-2}$ mol/lit., preferably $2\times10^{-3}$ to $1.5\times10^{-2}$ mol/lit.

Further, for increasing the solubility of tin (II) chelates, it is preferred that the reversal bath contain propionic acid, acetic acid or an alkylenedicarboxylic acid compound represented by the general formula (I) in JP-A-11-109572. Still further., it is preferred that the reversal bath contain, as a germicide, a sorbate or a quaternary ammonium compound described in U.S. Pat. No. 5,811,225.

The processing time in the reversal bath is in the range of 10 sec to 3 min, preferably 20 sec to 2 min, and more preferably 30 to 90 sec. The temperature of the reversal bath preferably falls within the temperature range of any of the first development, subsequent rinsing or washing and color development baths, or within the temperature ranges of these baths. The temperature of the reversal bath is generally in the range of 20 to 50° C., preferably 33 to 45° C.

The appropriate quantity of replenisher fed for the reversal bath is in the range of 10 ml to 2000 ml, preferably 200 to 1500 ml, per $m^2$ of lightsensitive material.

Since the tin (II) chelate of the reversal bath is effective over a wide range of pH value, there is no particular need for adding a pH buffer. However, it is permitted to add an acid, alkali or salt for imparting pH buffering properties, for example, an organic acid such as citric acid or malic acid; an inorganic acid such as boric acid, sulfuric acid or hydrochloric acid; or an alkali carbonate, an alkali hydroxide, borax or potassium metaborate. Further, according to necessity, a hard water softener such as an aminopolycarboxylic acid, a swelling inhibitor such as sodium sulfate and an antioxidizing agent such as p-aminophenol may be added to the reversal bath.

The lightsensitive material after processing with the reversal bath is subjected to color development. The color developer for use in the color development processing of the present invention is an alkaline aqueous solution containing an aromatic primary amine color developing agent as a principal component. As this color developing agent, p-phenylenediamine compounds are preferably used. As representative examples of the p-phenylenediamine compounds, there can be mentioned 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline and 3-methyl-4-amino-N-ethyl-N-β-methoxyethylaniline; and, derived therefrom, sulfates, hydrochlorides, phosphates, p-toluenesulfonates, tetraphenylborates and p-(t-octyl)benzenesulfonates. These developing agents may be used in combination according to necessity. The addition amount thereof is preferably in the range of approximately 0.005 to 0.1 mol/lit., more preferably 0.01 to 0.05 mol/lit.

The pH value of the color developer for use in the present invention is preferably in the range of 8 to 13, more preferably 10.0 to 12.5, and most preferably 11.5 to 12.3. Various buffers are used for maintaining the above pH value.

As buffers having a buffering region at pH 8.0 or over for use in the present invention, there can be employed, for example, carbonates, phosphates, borates, 5-sulfosalicylates, tetraborates, hydroxybenzoates, glycine salts, N,N-dimetylglycine salts, leucine salts, norleucine salts, guanine salts, 3,4-dihydroxyphenylalanine salts, alanine salts, aminobutyrates, 2-amino-2-methyl-1,3-propanediol salts, valine salts, proline salts, trishydroxyaminomethane salts and lysine salts. In particular, carbonates, phosphates and 5-sulfosalicylates have advantages such as high solubility, high buffering capability at a high pH region wherein the pH value is 10.0 or over, no detriment (being free from stain, etc.) to photographic performance when added to the color developer, and low cost, so that the use of these buffers is especially preferred.

As specific examples of these buffers, there can be mentioned sodium carbonate, potassium carbonate, sodium bicarbonate, potassium bicarbonate, trisodium phosphate, tripotassium phosphate, disodium phosphate, dipotassium phosphate, dipotassium 5-sulfosalicylate, disodium 5-sulfosalicylate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate). Of these, trisodium phosphate, tripotassium phosphate, disodium phosphate, dipotassium phosphate, dipotassium 5-sulfosalicylate and disodium 5-sulfosalicylate are preferred.

These buffers may be added individually or in combination to the color developer. The pH value can be adjusted to an intended one by the addition of an alkali agent or an acid.

The addition amount of buffer to the color developer (total amount when buffers are used in combination) is preferably 0.1 mol/lit. or more, most preferably in the range of 0.1 to 0.4 mol/lit.

Furthermore, various development accelerators may be used in the present invention according to necessity.

As the development accelerator, there may be employed various pyridinium compounds and other cationic compounds, cationic dyes, such as phenosafranine, and neutral salts, such as thallium nitrate and potassium nitrate, as described in U.S. Pat. No. 2,648,604, JP-B-44-9503 and U.S. Pat. No. 3,171,247; nonionic compounds, such as polyethylene glycols and derivatives thereof and polythioethers, as described in JP-B-44-9304 and U.S. Pat. Nos. 2,533,990, 2,531,832, 2,950,970 and 2,577,127; and thioether compounds described in U.S. Pat. No. 3,201,242.

Also, according to necessity, use can be made of benzyl alcohol and, as a solvent therefor, diethylene glycol, triethanolamine, diethanolamine, etc. However, it is preferred to minimize the use thereof from the viewpoint of environmental imposition, liquid solubility, tar occurrence, etc.

The color developer can contain the same silver halide solvent as used in the black and white developer. For example, a thiocyanate, 2-methylimidazole or a thioether compound described in JP-A-57-63580 can be contained. Especially, 3,6-dithiaoctane-1,8-diol is preferred.

In the color development step of the present invention, although it is not needed to prevent development fogging, various antifoggants may be contained in the color developer for the purpose of ensuring the constancy of solution composition and performance in the event of running while conducting color film replenishment. In this color development step, as the antifoggant, there can preferably be employed not only alkali metal halides such as potassium chloride, sodium chloride, potassium bromide, sodium bromide and potassium iodide but also organic antifoggants. As organic antifoggants, there can be employed, for example, nitrogenous heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole and hydroxyazaindolizine; mercapto-substituted heterocyclic compounds such as 1-phenyl-5-mercaptotetrazole, 2-mercaptobenzimidazole and 2-mercaptobenzothiazole; and mercapto-substituted aromatic compounds such as thiosalicylic acid. These antifoggants include those leached from the color reversal lightsensitive material during the processing thereof and accumulated in the color developer.

Various preservatives can be used in the color developer of the present invention.

Hydroxylamines and sulfites can be used as representative preservatives, of which sulfites are preferred. The addition amount of these preservatives is in the range of about 0 to 0.1 mol/lit.

The color developer for use in the present invention may contain organic preservatives in place of the above hydroxylamines and sulfites (in ionic form).

Herein, the organic preservative refers to all the organic compounds which, when added to the processing solutions for color photographic material, reduce the rate of deterioration of aromatic primary amine color developing agents. That is, the organic preservative refers to organic compounds capable of preventing the oxidation of color developing agents by air, etc. Especially effective organic preservatives can be provided by, for example, hydroxylamine derivatives (excluding hydroxylamine), hydroxamic acids, hydrazines, hydrazides, phenols, α-hydroxyketones, α-aminoketones, saccharides, monoamines, diamines, polyamines, quaternary ammonium salts, nitroxy radicals, alcohols, oximes, diamide compounds and condensed-ring amines. These are disclosed in, for example, JP-B-48-30496, JP-A's-52-143020, 63-4235, 63-30845, 63-21647, 63-44655, 63-53551, 63-43140, 63-56654, 63-58346, 63-43138, 63-146041, 63-44657 and 63-44656, U.S. Pat. Nos. 3,615,503 and 2,494,903, and JP-A's-1-97953, 1-186939, 1-186940, 1-187557 and 2-306244. As other preservatives, there may be used according to necessity, for example, various metals described in JP-A's-57-44148 and 57-53749, salicylic acids described in JP-A-59-180588, amines described in JP-A's-63-239447, 63-128340, 1-186939 and 1-187557, alkanolamines described in JP-A-54-3532, polyethyleneimines described in JP-A-56-94349 and aromatic polyhydroxy compounds described in, for example, U.S. Pat. No. 3,746,544. Especially, the addition of alkanolamines such as triethanolamine, dialkylhydroxylamines such as N,N-diethylhydroxylamine and N,N-di(sulfoethyl)hydroxylamine, hydrazine derivatives (excluding hydrazine) such as N,N-bis(carboxymethyl) hydrazine and aromatic polyhydroxy compounds, a representative example of which is sodium catechol-3,5-disulfonate, is preferred.

The addition amount of these organic preservatives is preferably in the range of approximately 0.02 to 0.5 mol/lit., more preferably 0.05 to 0.2 mol/lit. These organic preservatives may be used in combination according to necessity.

Furthermore, the color developer of the present invention can contain an organic solvent such as diethylene glycol or triethylene glycol; a dye forming coupler; a competing coupler such as citrazinic acid, J-acid or H-acid; a nucleating agent such as sodium borohydride; an auxiliary developing agent such as 1-phenyl-3-pyrazolidone; a thickening agent; and chelating agents, for example, ethylenediaminetetraacetic acid, nitrilotriacetic acid, cyclohexanediaminetetraacetic acid, hydroxyethyliminodiacetic acid, iminodiacetic acid, N-hydroxymethylethylenediaminetriacetic acid, diethylenetriaminepentaacetic acid, triethylenetetraminehexaacetic acid and other aminopolycarboxylic acids whose representative examples are compounds described in JP-A-58-195845, 1-hydroxyethylidene-1,1'-diphosphonic acid, organophosphonic acids described in Research Disclosure No. 18170 (May, 1979), aminotris(methylenephosphonic acid), ethylenediamine-N,N,N',N'-tetramethylenephosphonic acid and other aminophosphonic acids, and phosphonocarboxylic acids described in JP-A's-52-102726, 53-42730, 54-121127, 55-4024, 55-4025, 55-126241, 55-65955 and 55-65956 and Research Disclosure No. 18170 (May, 1979). The addition amount of these chelating agents is in the range of approximately 0.05 to 20 g/lit., preferably 0.1 to 5 g/lit. These chelating agents may be used in combination according to necessity.

Still further, various surfactants such as alkylsulfonic acids, arylsulfonic acids, aliphatic carboxylic acids, aromatic carboxylic acids and polyalkyleneimines may be added to the color developer according to necessity.

With respect to the color developer which can be used in the present invention, the processing temperature is in the range of 20 to 50° C., preferably 33 to 45° C. The processing time is in the range of 20 sec to 10 min, preferably 2 to 6 min. The smaller the quantity of replenisher, the greater the preference, as long as the activity of color developer can be maintained. The appropriate quantity of replenisher is in the range of 100 to 3000 ml, preferably 400 to 2200 ml, per $m^2$ of lightsensitive material.

Subsequently, the color reversal lightsensitive material having undergone the color development is desilvered. The desilvering step generally comprises the following sequence of treatments.

(Color development)—conditioning—bleach—fixing
(Color development)—washing—bleach fixing
(Color development)—bleach—fixing
(Color development)—washing—bleach—washing—fixing
(Color development)—bleach—washing—fixing
(Color development)—washing—bleach-fix
(Color development)—conditioning—bleach-fix
(Color development)—bleach-fix
(Color development)—washing—bleach—bleach-fix
(Color development)—bleach—bleach-fix
(Color development)—washing—bleach—bleach-fix—fixing.

Of these, the 1st, 2nd, 3rd and 7th steps are preferred.

In these processing steps, the method of replenishing may be conventional one wherein the replenisher for each bath is individually fed to the processing bath concerned. In the steps 9 and 10, however, it is practicable to introduce any bleaching solution overflow into the bleach-fix bath and replenish the bleach-fix bath with a fixing solution composition only. On the other hand, in the step 11, the method of replenishing may comprise introducing any bleaching solution overflow into the bleach-fix solution, also introducing any fixing solution overflow into the bleach-fix solution by a countercurrent system and overflowing both from the bleach-fix bath.

It is an aminopolycarboxylic acid iron (III) complex salt that now most generally used as a bleaching agent in the bleaching bath or bleach-fix bath of the present invention. As representative examples of suitable aminopolycarboxylic acids and salts thereof, there can be mentioned:

A-1 ethylenediaminetetraacetic acid,
A-2 ethylenediaminetetraacetic acid disodium salt,
A-3 ethylenediaminetetraacetic acid diammonium salt,
A-4 diethylenetriaminepentaacetic acid,
A-5 cyclohexanediaminetetraacetic acid,
A-6 cyclohexanediaminetetraacetic acid disodium salt,
A-7 iminodiacetic acid,
A-8 1,3-diaminopropanetetraacetic acid,
A-9 methyliminodiacetic acid,
A-10 hydroxyethyliminodiacetic acid,
A-11 (glycol ether)diaminetetraacetic acid,
A-12 ethylenediaminetetrapropionic acid,
A-13 N-(2-carboxyethyl)iminodiacetic acid,
A-14 ethylenediaminedipropionic acid,
A-15 β-alaninediacetic acid,
A-16 ethylenediaminedimalonic acid,
A-17 ethylenediaminedisuccinic acid, and
A-18 propylenediaminedisuccinic acid.

The aminopolycarboxylic acid ferric complex salt may be used in the form of a complex salt, or alternatively a ferric salt and an aminopolycarboxylic acid may be added to thereby form a ferric ion complex salt in the solution. Further, only one type, or two or more types of aminopolycarboxylic acids may be used. In any instances, the aminopolycarboxylic acid may be used in excess of the amount needed to form the ferric ion complex salt.

The above bleaching solution or bleach-fix solution containing the ferric ion complex may further contain complex salts of ions of metals other than iron, such as cobalt and copper.

The addition amount of these bleaching agents is in the range of 0.02 to 0.5 mol, preferably 0.05 to 0.3 mol, per liter of bath having bleaching capability.

Various bleaching and fixing accelerators can be added to the bleaching bath or bleach-fix bath of the present invention.

As examples of such bleaching accelerators, there can be mentioned various mercapto compounds as described in U.S. Pat. No. 3,893,858, GB No. 1,138,842 and JP-A-53-141623; compounds having disulfide bonds as described in JP-A-53-95630; thiazolidine derivatives as described in JP-B-53-9854; isothiourea derivatives as described in JP-A-53-94927; thiourea derivatives as described in JP-B's-45-8506 and 49-26586; thioamide compounds as described in JP-A-49-42349; and dithiocarbamic acid salts as described in JP-A-55-26506. As further examples of such bleaching accelerators, there can be mentioned alkylmercapto compounds unsubstituted or substituted with a hydroxyl group, a carboxyl group, a sulfonate group, an amino group (may have a substituent such as an alkyl group or an acetoxyalkyl group), etc. Examples thereof include trithioglycerol, α, α'-thiodipropionic acid and δ-mercaptobutyric acid. Still further, use can be made of compounds described in U.S. Pat. No. 4,552,834.

When it is intended to add the above compound having a mercapto group or disulfide bond in its molecule, thiazolidine derivative or isothiourea derivative to the conditioning solution or bleaching solution, the appropriate addition amount, although varied depending on the type of photographic material to be processed, processing temperature and desired processing time, is in the range of $1\times10^{-5}$ to $1\times10^{-1}$ mol, preferably $1\times10^{-4}$ to $5\times10^{-2}$ mol, per liter of processing solution.

The bleaching solution for use in the present invention can contain not only the bleaching agent and above compounds but also a re-halogenating agent such as a bromide, for example, potassium bromide, sodium bromide or ammonium bromide, or a chloride, for example, potassium chloride, sodium chloride or ammonium chloride. Furthermore, additives whose customary use in bleaching solutions is known, for example, a nitrate such as sodium nitrate or ammonium nitrate, and at least one inorganic or organic acid or salt thereof having pH buffering capability such as boric acid, borax, sodium metaborate, acetic acid, sodium acetate, sodium carbonate, potassium carbonate, phosphorous acid, phosphoric acid, sodium phosphate, citric acid, sodium citrate or tartaric acid can be mixed into the bleaching solution for use in the present invention.

It is preferred that the solution having bleaching capability, in the use thereof, exhibit a pH value of 4.0 to 8.0, especially 5.0 to 7.0.

Water soluble silver halide solvents, for example, a thiosulfate such as sodium thiosulfate or ammonium thiosulfate, a thiocyanate such as sodium thiocyanate, ammonium thiocyanate or potassium thiocyanate, a thioether compound such as ethylenebisthioglycolic acid or 3,6-dithia-1,8-octanediol and a thiourea can be used individually or in combination as a fixing agent in the bleach-fix solution. Further, use can be made of, for example, a special bleach-fix solution comprising a combination of a fixing agent with a large amount of a halide such as potassium iodide, etc., as described in JP-A-55-155354. The amount of these fixing agents is in the range of 0.1 to 3 mol, preferably 0.2 to 2 mol, per liter of bath having fixing capability.

When a fixer is employed in the present invention, known fixing agents, namely, water soluble silver halide solvents, for example, a thiosulfate such as sodium thiosulfate or ammonium thiosulfate, a thiocyanate such as sodium thiocyanate, ammonium thiocyanate or potassium thiocyanate, a thioether compound such as ethylenebisthioglycolic acid or 3,6-dithia-1,8-octanediol and a thiourea can be used individually or in combination as the fixing agent therein. The concentration of fixing agent is in the range of 0.1 to 3 mol, preferably 0.2 to 2 mol, per liter of fixer. Besides the above additives, for example, a sulfite (e.g., sodium sulfite, potassium sulfite or ammonium sulfite), a bisulfite or a hydroxylamine, hydrazine or aldehyde compound bisulfite adduct (e.g., acetaldehyde sodium bisulfite adduct) can be added as a preservative to the solution having fixing capability. Also, sulfinic acids (e.g., benzenesulfinic acid) and ascorbic acid are effective preservatives. Furthermore, various brightening agents, antifoaming agents, surfactants, polyvinylpyrrolidone, bactericidal agents, antifungal agents and organic solvents such as methanol can be added to the solution having fixing capability.

In the present invention, the quantity of replenisher fed for the bleaching solution, the fixing solution, the bleach-fix solution or the like, although arbitrarily set as long as the function of relevant processing bath can be fulfilled, is preferably in the range of 30 to 2000 ml, more preferably 50 to 1000 ml, per $m^2$ of lightsensitive material.

The processing temperature is preferably in the range of 20 to 50° C., more preferably 33 to 45° C. The processing time is in the range of 10 sec to 10 min, preferably 20 sec to 6 min.

Generally, washing and/or stabilizing is performed after the desilvering such as fixing or bleach-fix. Although the stabilizing solution generally contains an image stabilizer, it is not always necessary to contain the image stabilizer. The solution not containing any image stabilizer may be called a rinsing solution (cleaning solution) to distinguish the same from the solution containing the image stabilizer.

The amount of water used in the washing step can be set within a wide range, depending on the properties (for example, attributed to the employed material of coupler, etc.) and usage of lightsensitive material, temperature of washing water, number of washing tanks (number of stages) and other various conditions. Of these, the relationship between the number of washing tanks and the amount of water with respect to the multistage countercurrent system can be determined by the method described in Journal of the Society of Motion Picture and Television Engineers, vol. 64, pp. 248 to 253 (May, 1955). It is generally preferred that the number of stages employed in the multistage countercurrent system be in the range of 2 to 15, especially 2 to 10.

The multistage countercurrent system, although the amount of washing water can be largely reduced, is likely to invite such a problem that the residence time of water in tanks is increased to thereby cause growth of bacteria with the result that the resultant suspended matter sticks to the lightsensitive material. The method of JP-A-62-288838 in which the amount of calcium and magnesium is decreased can be very effectively employed as a countermeasure to such a problem. Alternatively, use can be made of isothiazolone compounds and cyabenzazoles described in JP-A-57-8542; chlorinated bactericides such as sodium chloroisocyanurate described in JP-A-61-120145; benzotriazoles and copper ion described in JP-A-61-267761; and germicides described in "Chemistry of Antibacterial Mildewproofing Agents" written by Hiroshi Horiguchi and published by Sankyo Shuppan (1986), "Microorganism Sterilization, Pasteurization & Mildewproofing Technology" edited by the Hygienic Technology Association and published by the Industrial Technology Association (1982) and "Antibacterial Mildewproofing Agent Cyclopedia" edited by the Antibacterial Mildewproofing Society of Japan (1986).

Moreover, a surfactant as a dewatering agent and a chelating agent, for example, EDTA as a hard water softener can be added to the washing water, stabilizing solution or rinsing solution.

The surfactant can be any of polyethylene glycol nonionic surfactants, polyhydric alcohol nonionic surfactants, alkylbenzenesulfonate anionic surfactants, higher alcohol sulfate anionic surfactants, alkylnaphthalenesulfonate anionic surfactants, quaternary ammonium salt cationic surfactants, amine salt cationic surfactants, amino salt amphoteric surfactants and betaine amphoteric surfactants. These surfactants can be used individually or in combination. Also, use can be made of siloxane surfactants and fluorinated surfactants described in. U.S. Pat. No. 5,716,765.

Among nonionic surfactants, nonionic surfactants of alkylpolyethylene oxides, alkylphenoxypolyethylene oxides and alkylphenoxypolyhydroxypropylene oxides are preferably employed. An alkyl-polyethylene oxide (5 to 12) alcohol having 8 to 15 carbon atoms is especially preferred.

For increasing the dissolution of surfactants, it is preferred that the relevant solution contain a solubilizing agent, for example, an amine such as diethanolamine or triethanolamine, or a glycol such as diethylene glycol or propylene glycol.

It is preferred that a chelating agent as heavy metal scavenger be added to the stabilizer or rinsing solution, from the viewpoint that the stability of solution is enhanced and that any contamination can be reduced. As the chelating agent, there can be employed the same compounds as added to the above developer and bleaching solution.

An antibacterial/mildewproofing agent is preferably added to the stabilizer or rinsing solution of the present invention in order to prevent the occurrence of bacteria and mildew. Commercially available antibacterial/mildewproofing agents can be used. Further, a surfactant, a brightening agent and a film hardener can be added to the stabilizer or rinsing solution.

The pH value of each of the stabilizer, rinsing solution and washing water according to the present invention is in the range of 4 to 9, preferably 5 to 8. The processing temperature and processing time, although can be set in variation depending on, for example, the properties and usage of lightsensitive material, are generally in the range of 15 to 45° C. and 20 sec to 10 min, preferably 25 to 40° C. and 30 sec to 4 min, respectively. The anti-contamination effect of the stabilizer or rinsing solution of the present invention is striking when the desilvering is directly followed by processing with the use of the stabilizer or rinsing solution without performing washing.

The quantity of replenisher fed for the stabilizer or rinsing solution of the present invention is preferably in the range of 200 to 2000 mL per $m^2$ of lightsensitive material. The overflow solution resulting from the above washing and/or stabilizer replenishing can be recycled to desilvering and other steps.

Ion exchange or ultrafiltration may be effected for reducing the amount of washing water consumed. Ultrafiltration is preferred. The processing solutions of the present invention are applied at 10 to 50° C. Although generally the temperature of 33 to 38° C. is standard, the temperature can be raised so as to expedite the processing and reduce the processing time. Contrarily, the temperature can be lowered so as to accomplish the enhancement of image quality and the improvement of processing solution stability.

In the processing of lightsensitive material according to the method of the present invention, when stabilization is directly performed without being preceded by washing, use can be made of any of the known techniques of, for example, JP-A's-57-8543, 58-14834 and 60-220345. It is also a preferable mode to use a chelating agent such as 1-hydroxyethylidene-1,1-diphosphonic acid or ethylenediaminetetramethylenephosphonic acid and a magnesium or bismuth compound.

The lightsensitive material having undergone the washing and/or stabilizing step is dried. The lightsensitive material immediately after washing through the washing bath is subjected to absorption of water by means of, for example, squeeze rollers or cloth so as to reduce the drag-in of water to image film, thereby enabling expediting the drying. With respect to means for improvement on the drier side, naturally, the drying can be expedited by, for example, raising the drying temperature, or changing the morphology of blasting nozzle so as to intensify drying blasts. Further, as described in JP-A-3-157650, the drying can be expedited by regulating the blasting angle of drying air to lightsensitive material or by a method of expelling exhausts.

EXAMPLE 1

The present invention will be described in detail below with reference to the following Examples which however in no way limit the scope of the invention.

Gelatin Used in Preparation of Silver Halide Emulsion and Production Thereof

Gelatin-1: common alkali-treated ossein gelatin prepared from bullock bone as a raw material, and containing —$NH_2$ groups which were not chemically modified;

Gelatin-2: gelatin obtained by adding succinic anhydride to an aqueous solution of gelatin-1 at 50° C. and at a pH value of 9.0 to thereby effect a chemical reaction, removing any remaining succinic acid and drying, which gelatin contained —$NH_2$ groups chemically modified at a numerical ratio of 95%; and Gelatin-3: gelatin obtained by causing an enzyme to act on gelatin-1 to thereby reduce the molecular weight thereof to an average molecular weight of 15,000, deactivating the enzyme and drying, the gelatin containing —$NH_2$ groups which were not chemically modified.

All the above gelatins-1 to 3 were deionized and adjusted so that the pH value exhibited by a 5% aqueous solution thereof at 35° C. was 6.0.

Production of Emulsion EM-1

Preparation of Core 1200 mL of an aqueous solution containing 0.8 g of KBr and 1.0 g of the above gelatin-3, while maintaining the temperature thereof at 35° C., was agitated (preparation of the 1st solution). 40 mL of aqueous solution Ag-1 (containing 8.2 g of $AgNO_3$ per 100 mL), 30 mL of aqueous solution X-1 (containing 7.7 g of KBr per 100 mL) and 30 mL of aqueous solution G-1 (containing 6.6 g of the same low-molecular-weight gelatin of 15,000 molecular weight as used in the 1st solution per 100 mL) were added thereto at constant flow rates over a period of 30 :sec by the triple jet method (Addition 1). Thereafter, 1.4 g of KBr was added, and the mixture was heated to 65° C. and ripened. Just before the completion of the ripening, 300 mL of aqueous solution G-2 (containing 11.0 g of the above gelatin-2 per 100 mL) was added thereto.

Subsequently, aqueous solution X-2 (containing 30.0 g of KBr per 100 mL) and 380 mL of aqueous solution Ag-2 (containing 30.0 g of $AgNO_3$ per 100 mL) were added thereto over a period of 38 min by the double jet method. During the period, the addition of aqueous solution Ag-2 was performed while increasing the flow rate so that the final flow rate was 2.5 times the initial flow rate, and the addition of aqueous solution X-2 was performed while maintaining the pAg value of bulk emulsion solution in the reaction vessel at 8.50 (Addition 2).

Formation of 1st Shell

Then, aqueous solution X-3. (containing 14.8 g of KBr and 7.0 g of KI per 100 mL) and 140 mL of aqueous solution Ag-3 (containing 30.0 .g of $AgNO_3$ per 100 mL) were added thereto over a period of 8 min by the double jet method. During the period, the addition of aqueous solution Ag-3 was performed while increasing the flow rate so that the final flow rate was 1.1 times the initial flow rate, and the addition of aqueous solution X-3 was performed so that the pAg value of bulk emulsion solution in the reaction vessel was maintained at 8.50 (Addition 3).

Formation of 2nd Shell

Further, aqueous solution X-4 (containing 30.9 g of KBr per 100 mL) and 156 mL of aqueous solution Ag-4 (containing 32.0 g of $AgNO_3$ per 100 mL) were added thereto over a period of 22 min by the double jet method.

The resultant mixture was desalted by the customary flocculation method, and water, NaOH and the above gelatin-1 were added under agitation so as to adjust the pH and pAg at 56° C. to 5.8 and 8.8, respectively.

The thus obtained emulsion was composed of silver halide tabular grains having (111) faces as parallel principal surfaces which exhibited an equivalent sphere average grain diameter of 0.6 $\mu$m, an average of principal surface equivalent circle diameter of 1.2 $\mu$m, an average of grain thickness of 0.1 $\mu$m, an average of aspect ratio of 12.0, a variation coefficient of equivalent sphere diameter of 15.0% and an average of silver iodide content of 4.0 mol %. The silver iodide content of silver halide grain surface measured by the XPS method was 2.0 mol %.

Moreover, the intragranular silver iodide distribution was determined by the EPMA method. As a result, it was recognized that a high silver iodide layer of 8 mol % or more silver iodide content was present in grains occupying 60% or more of the total projected area of all the grains.

Thereafter, the following sensitizing dyes Exs-1 and Exs-2 were added in a molar ratio of 50:50, and, further, potassium thiocyanate, chloroauric acid, sodium thiosulfate and N,N-dimethylselenourea were sequentially added to the obtained emulsion to thereby effect the optimum chemical sensitization. The chemical sensitization was terminated by adding the following water soluble mercapto compound EMR-1 in an amount of $3.6\times10^{-4}$ mol per mol of silver halide. With respect to the emulsion EM-1, the optimum chemical sensitization was accomplished when the addition amount of the above sensitizing dyes was $8.7\times10^{-4}$ mol per mol of silver halide.

Exs-1

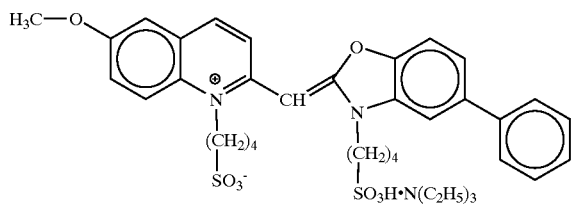

Exs-2

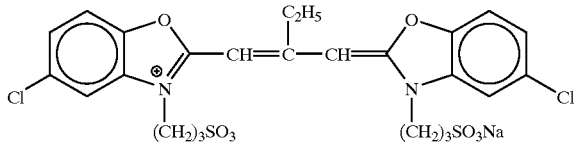

Production of Emulsions EM-2 to -6

Emulsions EM-2 to -6 were produced in the same manner as the emulsion EM-1, except that the addition amounts of aqueous solutions Ag-2 to Ag-4 and X-2 to X-4 were changed. The average I content of each 1st shell was changed by changing the amount of KI added to aqueous solution X-3. In that event, however, the amount of KBr was regulated so that the halogen concentration of aqueous solution X-3 was kept unchanged. Further, the addition amounts of chloroauric acid, sodium thiosulfate, N,N-dimethylselenourea and sensitizing dyes Exs-1 and Exs-2 were changed so as to attain the optimum chemical sensitization of each of the emulsions. With respect to the sensitizing dyes Exs-1 and Exs-2, the molar ratio thereof was rendered constant.

Production of Emulsion EM-7

Preparation of Core 1200 mL of an aqueous solution containing 0.8 g of KBr and 0.9 g of the above gelatin-3, while maintaining the temperature thereof at 35° C., was agitated (preparation of the 1st solution). 40 mL of aqueous solution Ag-1 (containing 8.2 g of $AgNO_3$ per 100 mL), 30 mL of aqueous solution X-1 (containing 7.7 g of KBr per 100 mL) and 30 mL of aqueous solution G-1 (containing 6.6 g of the same low-molecular-weight gelatin of 15,000 molecular weight as used in the 1st solution per 100 mL) were added thereto at constant flow rates over a period of 30 sec by the triple jet method (Addition 1). Thereafter, 1.4 g of KBr was added, and the mixture was heated to 65° C. and ripened. Just before the completion of the ripening, 150 mL of aqueous solution G-2 (containing 11.0 g of the above gelatin-2 per 100 mL) was added thereto.

Subsequently, aqueous solution X-2 (containing 30.0 g of KBr per 100 mL) and 15 mL of aqueous solution Ag-2 (containing 30.0 g of $AgNO_3$ per 100 mL) were added thereto over a period of 2.5 min by the double jet method. During the period, the addition of aqueous solution Ag-2 was performed while increasing the flow rate so that the final flow rate was 2.5 times the initial flow rate, and the addition of aqueous solution X-2 was performed while maintaining the pAg value of bulk emulsion solution in the reaction vessel at 8.50 (Addition 2).

Formation of 1st Shell

Then, aqueous solution X-3 (containing 14.8 g of KBr and 7.0 g of KI per 100 mL) and 250 mL of aqueous solution Ag-3 (containing 30.0 g of $AgNO_3$ per 100 mL) were added thereto over a period of 33 min by the double jet method. During the period, the addition of aqueous solution Ag-3 was performed while increasing the flow rate so that the final flow rate was 1.3 times the initial flow rate, and the addition of aqueous solution X-3 was performed so that the pAg value of bulk emulsion solution in the reaction vessel was maintained at 8.50 (Addition 3).

Formation of 2nd Shell

Further, aqueous solution X-4 (containing 30.0 g of KBr per 100 mL) and 180 mL of aqueous solution Ag-4 (containing 30.0 g of $AgNO_3$ per 100 mL) were added thereto over a period of 15 min by the double jet method. The addition of aqueous solution X-4 was performed so that the pAg value of bulk emulsion solution in the reaction vessel was maintained at 6.8 (Addition 4).

Formation of 3rd Shell

Thereafter, 0.0025 g of sodium benzenethiosulfonate and 125 mL of aqueous solution G-3 (containing 12.0 g of the above gelatin-1 per 100 mL) were added in sequence at one-minute intervals. Then, 13.0 g of KBr was added so that the pAg value of bulk emulsion solution in the reaction vessel became 9.00. Further, 80.8 g of silver iodide fine grain emulsion (containing 13.0 g of silver iodide fine grains of 0.047 $\mu$m average diameter per 100 g) was added.

Formation of 4th Shell

From 2 min later, aqueous solution X-4 and 358 mL of aqueous solution Ag-4 were added by the double jet method. The aqueous solution Ag-4 was added at a constant flow rate over a period of 25 min. The aqueous solution X-4 was added so as to maintain the pAg value of bulk emulsion solution in the reaction vessel at 9.00 for the first 6 min, and added so as to maintain the pAg value of bulk emulsion solution in the reaction vessel at 8.4 for the subsequent 19 min (Addition 5).

The resultant mixture was desalted by the customary flocculation method, and water, NaOH and the above gelatin-1 were added under agitation so as to adjust the pH and pAg at 56° C. to 6.4 and 8.6, respectively.

The thus obtained emulsion was composed of silver halide tabular grains having (111) faces as parallel principal surfaces which exhibited an equivalent sphere average grain diameter of 0.6 $\mu$m, an average of principal surface equivalent circle diameter of 0.94 $\mu$m, an average of grain thickness of 0.16 $\mu$m, an average of aspect ratio of 5.7, a variation coefficient of equivalent sphere diameter of 18.2% and an average of silver iodide content of 10.0 mol %. The silver iodide content of silver halide grain surface measured by the XPS method was 6.4 mol %.

Moreover, the intragranular silver iodide distribution was determined by the EPMA method. As a result, it was recognized that a high silver iodide layer of 8 mol % or more silver iodide content was present in grains occupying 60% or more of the total projected area of all the grains. It was further recognized that, in the silver iodide distribution, there were two maximums across a region extending from grain center to grain side, the silver quantity at the first maximum being in the range of 1 to 40% based on the quantity of silver constituting the grain entirety while the silver quantity at the second maximum being in the range of 50 to 85% based on the quantity of silver constituting the grain entirety.

Thereafter, the above sensitizing dyes Exs-1 and Exs-2 were added in a molar ratio of 75:25, and, further, potassium thiocyanate,. chloroauric acid, sodium thiosulfate and N,N-dimethylselenourea were sequentially added to the obtained emulsion to thereby effect the optimum chemical sensitization. The chemical sensitization was terminated by adding the following water soluble mercapto compound EMR-1 in an amount of $3.6\times10^{-4}$ mol per mol of silver halide. With respect to the emulsion EM-7, the optimum chemical sensitization was accomplished when the addition amount of the above sensitizing dyes was $6.8\times10^{-4}$ mol per mol of silver halide.

Production of Emulsion EM-8

Preparation of Core 1200 mL of an aqueous solution containing 1.1 g of KBr and 60.0 g of the above gelatin-1, while maintaining the temperature thereof at 72° C., was agitated (preparation of the 1st solution). Subsequently, 50. mL of a 10% ammonium nitrate solution and 10 mL of a 10% NaOH solution were added, and aqueous solution X-1 (containing 4.0 g of KBr per 100 mL) and 240 mL of aqueous solution Ag-1 (containing 4.0 g of $AgNO_3$ per 100 mL) were added thereto over a period of 10 min by the double jet method. The addition of aqueous solution X-1 was performed while maintaining the pAg value of bulk emulsion solution in the reaction vessel at 7.0 (Addition 1).

Thereafter, aqueous solution X-2 (containing 20.0 g of KBr per 100 mL) and 270 mL of aqueous solution Ag-2 (containing 20.0.g of $AgNO_3$ per 100 mL) were added thereto over a period of 20 min by the double jet method. The addition of aqueous solution X-2 was performed while maintaining the pAg value of bulk emulsion solution in the reaction vessel at 6.60 (Addition 2).

Formation of 1st Shell

Then, aqueous solution X-3 (containing 7.5 g of KBr and 3.5 g of KI per 100 mL) and 165 mL of aqueous solution Ag-3 (containing 14.0 g of $AgNO_3$ per 100 mL) were added thereto over a period of 40 min by the double jet method. During the period, the addition of aqueous solution X-3 was performed so that the pAg value of bulk emulsion solution in the reaction vessel was maintained at 6.60 (Addition 3).

Formation of 2nd Shell

Further, aqueous solution X-2 and 288 mL of aqueous solution Ag-2 were added thereto over a period of 20 min by the double jet method. During the period, the addition of aqueous solution X-2 was performed so that the pAg value of bulk emulsion solution in the reaction vessel was maintained at 6.60 (Addition 4).

The resultant mixture was desalted by the customary flocculation method, and water, NaOH and the above gelatin-1 were added under agitation so as to adjust the pH and pAg at 56° C. to 6.4 and 8.8, respectively.

The thus obtained emulsion was composed of silver halide cubic grains which exhibited an equivalent sphere average grain diameter of 0.6 $\mu$m, a variation coefficient of 11.0% and an average of silver iodide content of 10.0 mol %. The silver iodide content of silver halide grain surface measured by the XPS method was 2.0 mol %.

Moreover, the intragranular silver iodide distribution was determined by the EPMA method. As a result, it was recognized that a high silver iodide layer of 8 mol % or more silver iodide content was present in grains occupying 60% or more of the total projected area of all the grains.

Thereafter, potassium thiocyanate, chloroauric acid, sodium thiosulfate and N,N-dimethylselenourea were sequentially added to the obtained emulsion to thereby effect the optimum chemical sensitization. The chemical sensitization was terminated by adding the following water soluble mercapto compound EMR-2 in an amount of $4.5\times10^{-4}$ mol per mol of silver halide. Further, the following sensitizing dyes Exs-1 and Exs-2 were added in a molar ratio of 75:25. With respect to the emulsion EM-10, the optimum chemical sensitization was accomplished when the addition amount of the above sensitizing dyes was $5.5\times10^{-4}$ mol per mol of silver halide.

Production of Emulsions EM-9 and -10

Emulsions EM-9 and -10 were produced in the same manner as the emulsions EM-6 and -7, respectively, except that, in the chemical sensitization of emulsion, the sensitizing dyes Exs-3 and Exs-4 were employed in a molar ratio of 50:50, and that the addition amounts thereof were optimized.

Exs-3

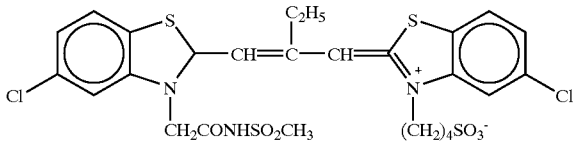

-continued

Exs-4

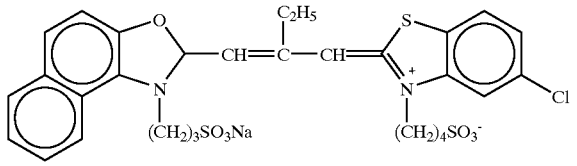

Production of Emulsions EM-11 and -12

Emulsions EM-11 and -12 were produced in the same manner as the emulsions EM-6 and -7, respectively, except that, in the chemical sensitization of emulsion, the sensitizing dyes Exs-5 and Exs-6 were employed in a molar ratio of 90:10, and that the addition amounts thereof were optimized.

Exs-5

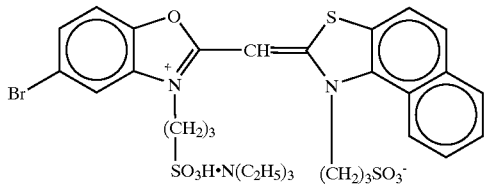

Exs-6

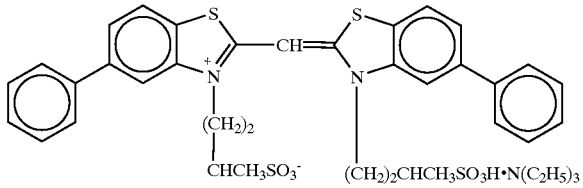

The characteristics of the emulsions EM-1 to EM-12 are listed in Tables 1 and 2.

TABLE 1

| Emulsion | Characteristics | Equivalent-sphere average diameter (μm) | Variation coefficient (%) | Surface silver iodide content (mol %) | Weight-average wavelength of spectral sensitivity λi (nm) |
|---|---|---|---|---|---|
| EM-1 | Monodisperse tabular grain Aspect ratio 12.0 | 0.6 | 15.0 | 2.1 | 535 |
| EM-2 | Monodisperse tabular grain Aspect ratio 8.5 | 0.6 | 16.0 | 3.1 | 535 |
| EM-3 | Monodisperse tabular grain Aspect ratio 6.3 | 0.6 | 17.1 | 6.0 | 535 |
| EM-4 | Monodisperse tabular grain Aspect ratio 10.6 | 0.6 | 15.5 | 12.8 | 535 |
| EM-5 | Monodisperse tabular grain Aspect ratio 6.1 | 0.6 | 17.6 | 5.7 | 535 |
| EM-6 | Monodisperse tabular grain Aspect ratio 5.0 | 0.6 | 18.1 | 6.1 | 535 |
| EM-7 | Monodisperse tabular grain Aspect ratio 5.7 | 0.6 | 18.2 | 6.4 | 535 |
| EM-8 | Monodisperse cubic grain | 0.6 | 11.0 | 2.0 | 535 |
| EM-9 | Monodisperse tabular grain Aspect ratio 5.0 | 0.6 | 18.1 | 6.1 | 643 |
| EM-10 | Monodisperse tabular grain Aspect ratio 5.7 | 0.6 | 18.2 | 6.4 | 643 |
| EM-11 | Monodisperse tabular grain Aspect ratio 5.0 | 0.6 | 18.1 | 6.1 | 450 |
| EM-12 | Monodisperse tabular grain Aspect ratio 5.7 | 0.6 | 18.2 | 6.4 | 450 |

TABLE 2

(continued from Table 1)

| Emulsion | Silver quantity ratio (mol % of each layer, based on total silver quantity of grain) | I distribution (Silver iodide content of each layer/mol %) | Average silver iodide content (mol %) | Remark |
|---|---|---|---|---|
| EM-1 | Core/1st shell/2nd shell 44/16/40 | Core/1st shell/2nd shell 0/25/0 | 4.0 | Comp. |
| EM-2 | Core/1st shell/2nd shell 6/79/15 | Core/1st shell/2nd shell 0/7.8/0 | 6.2 | Comp. |
| EM-3 | Core/1st shell/2nd shell 3/85/12 | Core/1st shell/2nd shell 0/12/0 | 10.0 | Comp. |
| EM-4 | Core/1st shell/2nd shell 50/40/10 | Core/1st shell/2nd shell 0/25/0 | 10.0 | Comp. |
| EM-5 | Core/1st shell/2nd shell 3/40/57 | Core/1st shell/2nd shell 0/25/0 | 10.0 | Inv. |
| EM-6 | Core/1st shell/2nd shell 3/47/57 | Core/1st shell/2nd shell 0/32/0 | 15.0 | Inv. |
| EM-7 | Core/1st shell/2nd shell/3rd shell/4th shell 3/28/20/3/46 | Core/1st shell/2nd shell/3rd shell/4th shell 0/25/0/100/0 | 10.0 | Inv. |
| EM-8 | Core/1st shell/2nd shell 44/16/40 | Core/1st shell/2nd shell 0/25/0 | 10.0 | Inv. |
| EM-9 | Core/1st shell/2nd shell 3/47/57 | Core/1st shell/2nd shell 0/32/0 | 15.0 | Inv. |
| EM-10 | Core/1st shell/2nd shell/3rd shell/4th shell 3/28/20/3/46 | Core/1st shell/2nd shell/3rd shell/4th shell 0/25/0/100/0 | 10.0 | Inv. |
| EM-11 | Core/1st shell/2nd shell 3/47/57 | Core/1st shell/2nd shell 0/32/0 | 15.0 | Inv. |
| EM-12 | Core/1st shell/2nd shell/3rd shell/4th shell 3/28/20/3/46 | Core/1st shell/2nd shell/3rd shell/4th shell 0/25/0/100/0 | 10.0 | Inv. |

Formation of Sample 101

(i) Formation of Triacetyl Cellulose Films

Triacetyl cellulose was dissolved (13% as a mass) in dichloromethane/methanol=92/8 (mass ratio) by normal solvent casting, and triphenyl phosphate and biphenyldiphenyl phosphate as plasticizers were added at a mass ratio of 2:1 such that the total amount was 14% with respect to the triacetyl cellulose, thereby forming a film by a band method. The thickness of the support after drying was 97 μm.

(ii) Contents of Undercoat Layer

Two surfaces of each of the above triacetyl cellulose films were coated with an undercoat solution having the following composition. Each number represents a mass contained per liter (to be referred to as L hereinafter) of the undercoat solution.

Before this undercoating was performed, the two surfaces of each film were subjected to a corona discharge treatment.

| | |
|---|---|
| Gelatin | 10.0 g |
| Salicylic acid | 0.5 g |
| Glycerin | 4.0 g |
| Acetone | 700 milliliters (to be referred to as mL hereinafter) |
| Methanol | 200 mL |
| Dichloromethane | 80 mL |
| Formaldehyde | 0.1 mg |
| Water to make | 1.0 L |

(iii) Application of Back Layer by Coating

One surface of the undercoated support was coated with back layers described below.

| | |
|---|---|
| 1st layer Binder: acid-processed gelatin (isoelectric point 9.0) | 1.00 g |
| Polymer latex: P-2 (average grain size 0.1 μm) | 0.13 g |
| Polymer latex: P-3 (average grain size 0.2 μm) | 0.23 g |
| Ultraviolet absorbent U-1 | 0.030 g |
| Ultraviolet absorbent U-3 | 0.010 g |
| Ultraviolet absorbent U-4 | 0.020 g |
| High-boiling organic solvent Oil-2 | 0.030 g |
| Surfactant W-3 | 0.010 g |
| Surfactant W-6 | 3.0 mg |
| 2nd layer Binder: acid-processed gelatin (isoelectric point 9.0) | 3.10 g |
| Polymer latex: P-3 (average grain size 0.2 μm) | 0.11 g |
| Ultraviolet absorbent U-1 | 0.030 g |
| Ultraviolet absorbent U-3 | 0.010 g |
| Ultraviolet absorbent U-4 | 0.020 g |
| High-boiling organic solvent Oil-2 | 0.030 g |
| Surfactant W-3 | 0.010 g |
| Surractant W-6 | 3.0 mg |
| Dye D-2 | 0.10 g |
| Dye D-10 | 0.12 g |
| Potassium sulfate | 0.25 g |
| Calcium chloride | 0.5 mg |
| Sodium hydroxide | 0.03 g |
| 3rd layer Binder: acid-processed gelatin (isoelectric point 9.0) | 3.30 g |
| Surfactant W-3 | 0.020 g |
| Potassium sulfate | 0.30 g |
| Sodium hydroxide | 0.03 g |
| 4th layer Binder: lime-processed gelatin | 1.15 g |
| 1:9 copolymer of methacrylic acid and methylmethacrylate (average grain size 2.0 μm) | 0.040 g |
| 6:4 copolymer of methacrylic acid and methylmethacrylate (average grain size 2.0 μm) | 0.030 g |
| Surfactant W-3 | 0.060 g |

-continued

| | | |
|---|---|---|
| Surfactant W-2 | | 7.0 mg |
| Hardener H-1 | | 0.23 g |

(iv) Application of Lightsensitive Emulsion Layer by Coating

The following lightsensitive emulsion layers were applied to the side opposite to that coated with the back layer, thereby obtaining sample 101. The figures given below indicate the addition amount per $m^2$. The effects of added compounds are not limited to the described usage.

| | | |
|---|---|---|
| 1st layer: Antihalation layer | | |
| Black colloidal silver | | 0.20 g |
| Gelatin | | 2.40 g |
| Ultraviolet absorbent U-1 | | 0.15 g |
| Ultraviolet absorbent U-3 | | 0.15 g |
| Ultraviolet absorbent U-4 | | 0.10 g |
| Ultraviolet absorbent U-5 | | 0.10 g |
| High-boiling organic solvent Oil-1 | | 0.10 g |
| High-boiling organic solvent Oil-2 | | 0.10 g |
| High-boiling organic solvent Oil-5 | | 0.010 g |
| Dye D-4 | | 1.0 mg |
| Dye D-8 | | 2.5 mg |
| Fine-crystal solid dispersion of dye E-1 | | 0.05 g |
| 2nd layer: First interlayer | | |
| Gelatin | | 0.50 g |
| High-boiling organic solvent Oil-4 | | 0.010 g |
| High-boiling organic solvent Oil-7 | | 2.0 mg |
| Dye D-7 | | 4.0 mg |
| 3rd layer: Interlayer (interimage effects imparting layer) | | |
| Gelatin | | 0.49 g |
| Compound Cpd-M | | 0.10 g |
| Compound Cpd-K | | 2.0 mg |
| High-boiling organic solvent Oil-6 | | 0.010 g |
| Ultraviolet absorbent U-1 | | 0.10 g |
| 4th layer: Second interlayer | | |
| Gelatin | | 0.80 g |
| Compound Cpd-D | | 0.020 mg |
| Compound Cpd-M | | 0.080 g |
| High-boiling organic solvent Oil-3 | | 0.010 g |
| High-boiling organic solvent Oil-6 | | 0.050 g |
| High-boiling organic solvent Oil-8 | | 0.100 g |
| 5th layer: Low-speed red-sensitive emulsion layer | | |
| Emulsion A | silver | 0.10 g |
| Emulsion B | silver | 0.20 g |
| Emulsion C | silver | 0.20 g |
| Silver iodobromide emulsion, surface and internal thereof are fogged in advance. (cubic, average silver iodide content 1 mol %, equivalent-sphere average diameter 0.06 μm) | silver | 0.010 g |
| Gelatin | | 0.70 g |
| Coupler C-1 | | 0.15 g |
| Coupler C-2 | | 7.0 mg |
| Coupler C-3 | | 7.0 mg |
| Coupler C-10 | | 3.0 mg |
| Coupler C-11 | | 2.0 mg |
| Ultraviolet absorbent U-3 | | 0.010 g |
| Compound Cpd-I | | 0.020 g |
| Compound Cpd-D | | 3.0 mg |
| Compound Cpd-J | | 2.0 mg |
| Compound Cpd-L | | 3.0 mg |
| High-boiling organic solvent Oil-10 | | 0.030 g |
| Additive P-1 | | 5.0 mg |
| 6th layer: Medium-speed red-sensitive emulsion layer | | |
| Emulsion C | silver | 0.15 g |
| Emulsion D | silver | 0.15 g |
| Gelatin | | 0.70 g |
| Coupler C-1 | | 0.15 g |
| Coupler C-2 | | 7.0 mg |
| Coupler C-10 | | 3.0 mg |
| Compound Cpd-D | | 3.0 mg |
| Ultraviolet absorbent U-3 | | 0.010 g |
| High-boiling organic solvent Oil-10 | | 0.030 g |
| Additive P-1 | | 7.0 mg |
| 7th layer: High-speed red-sensitive emulsion layer | | |
| Emulsion E | silver | 0.15 g |
| Emulsion F | silver | 0.20 g |
| Gelatin | | 1.30 g |
| Coupler C-1 | | 0.60 g |
| Coupler C-2 | | 0.015 g |
| Coupler C-3 | | 0.030 g |
| Coupler C-10 | | 5.0 mg |
| Ultraviolet absorbent U-1 | | 0.010 g |
| Ultraviolet absorbent U-2 | | 0.010 g |
| High-boiling organic solvent Oil-6 | | 0.030 g |
| High-boiling organic solvent Oil-9 | | 0.020 g |
| High-boiling organic solvent Oil-10 | | 0.050 g |
| Compound Cpd-D | | 5.0 mg |
| Compound Cpd-K | | 1.0 mg |
| Compound Cpd-F | | 0.030 g |
| Additive P-1 | | 0.010 g |
| Additive P-4 | | 0.030 g |
| 8th layer: third interlayer | | |
| Gelatin | | 1.40 g |
| Additive P-2 | | 0.15 g |
| Dye D-5 | | 0.020 g |
| Dye D-9 | | 6.0 mg |
| Compound Cpd-A | | 0.050 g |
| Compound Cpd-D | | 0.030 g |
| Compound Cpd-I | | 0.010 g |
| Compound Cpd-M | | 0.090 g |
| Compound Cpd-O | | 3.0 mg |
| Compound Cpd-P | | 5.0 mg |
| High-boiling organic solvent Oil-6 | | 0.100 g |
| High-boiling organic solvent Oil-3 | | 0.010 g |
| Ultraviolet absorbent U-1 | | 0.010 g |
| Ultraviolet absorbent U-3 | | 0.010 g |
| 9th layer: Low-speed green-sensitive emulsion layer | | |
| Emulsion G | silver | 0.25 g |
| Emulsion H | silver | 0.30 g |
| Emulsion I | silver | 0.25 g |
| Silver iodobromide emulsion, surface and internal thereof are fogged in advance. (cubic, average silver iodide content 1 mol %, equivalent-sphere average diameter 0.06 μm) | silver | 0.010 g |
| Gelatin | | 1.30 g |
| Coupler C-4 | | 0.20 g |
| Coupler C-5 | | 0.050 g |
| Coupler C-6 | | 0.020 g |
| Compound Cpd-A | | 5.0 mg |
| Compound Cpd-B | | 0.030 g |
| Compound Cpd-D | | 5.0 mg |
| Compound Cpd-F | | 0.010 g |
| Compound Cpd-E | | 5.0 mg |
| Compound Cpd-G | | 2.5 mg |
| Compound Cpd-K | | 1.0 mg |
| Ultraviolet absorbent U-6 | | 5.0 mg |
| High-boiling organic solvent Oil-2 | | 0.25 g |
| Additive P-1 | | 5.0 mg |
| 10th layer: Medium-speed green-sensitive emulsion layer | | |
| Emulsion I | silver | 0.30 g |
| Emulsion J | silver | 0.30 g |
| Internally fogged silver bromide emulsion (cubic, average equivalent-sphere grain size 0.11 μm) | silver | 5.0 mg |
| Gelatin | | 0.70 g |
| Coupler C-4 | | 0.25 g |
| Coupler C-5 | | 0.050 g |
| Coupler C-6 | | 0.020 g |
| Compound Cpd-A | | 5.0 mg |
| Compound Cpd-B | | 0.030 g |
| Compound Cpd-F | | 0.010 g |
| Compound Cpd-G | | 2.0 mg |

-continued

| | | |
|---|---|---|
| High-boiling organic solvent Oil-2 | | 0.20 g |
| High-boiling organic solvent Oil-9 | | 0.050 g |
| 11th layer: High-speed green-sensitive emulsion layer | | |
| Emulsion K | silver | 0.40 g |
| Gelatin | | 0.80 g |
| Coupler C-4 | | 0.30 g |
| Coupler C-5 | | 0.080 g |
| Coupler C-7 | | 0.050 g |
| Compound Cpd-A | | 5.0 mg |
| Compound Cpd-B | | 0.040 g |
| Compound Cpd-E | | 0.010 g |
| High-boiling organic solvent Oil-2 | | 0.20 g |
| High-boiling organic solvent Oil-9 | | 0.050 g |
| 12th layer: Yellow filter layer | | |
| Gelatin | | 1.00 g |
| Compound Cpd-C | | 0.010 g |
| Compound Cpd-M | | 0.10 g |
| High-boiling organic solvent Oil-1 | | 0.020 g |
| High-boiling organic solvent Oil-6 | | 0.10 g |
| Fine-crystal solid dispersion of dye E-2 | | 0.25 g |
| 13th layer: Interlayer | | |
| Gelatin | | 0.40 g |
| Compound Cpd-Q | | 0.20 g |
| 14th layer: Low-speed blue-sensitive emulsion layer | | |
| Emulsion L | silver | 0.15 g |
| Emulsion M | silver | 0.20 g |
| Emulsion N | silver | 0.10 g |
| Internally fogged silver bromide emulsion (cubic, equivalent-sphere average grain size 0.11 μm) | silver | 3.0 mg |
| Gelatin | | 0.80 g |
| Coupler C-8 | | 0.020 g |
| Coupler C-9 | | 0.30 g |
| Coupler C-10 | | 5.0 mg |
| Compound Cpd-B | | 0.10 g |
| Compound Cpd-I | | 8.0 mg |
| Compound Cpd-K | | 1.0 mg |
| Compound Cpd-M | | 0.010 g |
| Ultraviolet absorbent U-6 | | 0.010 g |
| High-boiling organic solvent Oil-2 | | 0.010 g |
| 15th layer: Medium-speed blue-sensitive emulsion layer | | |
| Emulsion N | silver | 0.20 g |
| Emulsion O | silver | 0.20 g |
| Gelatin | | 0.80 g |
| Coupler C-8 | | 0.020 g |
| Coupler C-9 | | 0.25 g |
| Coupler C-10 | | 0.010 g |
| Compound Cpd-B | | 0.10 g |
| Compound Cpd-N | | 2.0 mg |
| High-boiling organic solvent Oil-2 | | 0.010 g |
| 16th layer: High-speed blue-sensitive emulsion layer | | |
| Emulsion P | silver | 0.20 g |
| Emulsion Q | silver | 0.25 g |
| Gelatin | | 2.00 g |
| Coupler C-3 | | 5.0 mg |
| Coupler C-8 | | 0.10 g |
| Coupler C-9 | | 1.00 g |
| Coupler C-10 | | 0.020 g |

-continued

| | | |
|---|---|---|
| High-boiling organic solvent Oil-2 | | 0.10 g |
| High-boiling organic solvent Oil-3 | | 0.020 g |
| Ultraviolet absorbent U-6 | | 0.10 g |
| Compound Cpd-B | | 0.20 g |
| Compound Cpd-N | | 5.0 mg |
| Compound Cpd-E | | 5.0 mg |
| 17th layer: 1st protective layer | | |
| Gelatin | | 1.00 g |
| Ultraviolet absorbent U-1 | | 0.15 g |
| Ultraviolet absorbent U-2 | | 0.050 g |
| Ultraviolet absorbent U-5 | | 0.20 g |
| Compound Cpd-O | | 5.0 mg |
| Compound Cpd-A | | 0.030 g |
| Compound Cpd-H | | 0.20 g |
| Dye D-1 | | 8.0 mg |
| Dye D-2 | | 0.010 g |
| Dye D-3 | | 0.010 g |
| High-boiling organic solvent Oil-3 | | 0.10 g |
| 18th layer: 2nd protective layer | | |
| Colloidal silver | silver | 2.5 mg |
| Silver iodobromide fine grain emulsion (equivalent-sphere average grain size 0.06 μm, silver iodide content 1 mol %) | silver | 0.10 g |
| Gelatin | | 0.80 g |
| Ultraviolet absorbent U-1 | | 0.030 g |
| Ultraviolet absorbent U-6 | | 0.030 g |
| High-boiling organic solvent Oil-3 | | 0.010 g |
| 19th layer: 3rd protective layer | | |
| Gelatin | | 1.00 g |
| Polymethylmethacrylate (average grain size 1.5 μm) | | 0.10 g |
| 6:4 copolymer of methylmethacrylate and methacrylic acid (average grain size 1.5 μm) | | 0.15 g |
| Silicone oil SO-1 | | 0.20 g |
| Surfactant W-1 | | 3.0 mg |
| Surfactant W-2 | | 8.0 mg |
| Surfactant W-3 | | 0.040 g |
| Surfactant W-7 | | 0.015 g |

In addition to the above compositions, additives F-1 to F-8 were added to all emulsion layers. Also, a gelatin hardener H-1 and surfactants W-3, W-4, W-5, and W-6 for coating and emulsification were added to each layer.

Furthermore, phenol, 1,2-benzisothiazoline-3-one, 2-phenoxyethanol, phenethylalcohol, and p-benzoic butylester were added as antiseptic and mildewproofing agents.

Emulsions employed in sample 101 are listed in tables 3–5 below.

In the sample 101, the weight-averaged wavelength of spectral sensitivity distribution of red-sensitive emulsion layer was 640 nm; the weight-averaged wavelength of spectral sensitivity distribution of green-sensitive emulsion layer was 550 nm; and the weight-averaged wavelength of spectral sensitivity distribution of blue-sensitive emulsion layer was 460 nm.

TABLE 3

Silver bromoiodide emulsions used in Sample 101

| Emulsion | Characteristics | Equivalent-sphere average diameter (μm) | Variation coefficient (%) | Average silver iodide content (mol %) | Halogen composition structure of silver halide grain | Silver iodide content of grain surface (mol %) | Other characteristics ① | ② | ③ | ④ | ⑤ |
|---|---|---|---|---|---|---|---|---|---|---|---|
| A | Monodisperse tetradecahedral grain | 0.24 | 9 | 3.5 | Triple | 1.5 | | ○ | ○ | ○ | |
| B | Monodisperse (111) tabular grain Average aspect ratio 2.0 | 0.25 | 10 | 3.5 | Quadruple | 1.5 | | ○ | | ○ | ○ |
| C | Monodisperse (111) tabular grain Average aspect ratio 2.0 | 0.30 | 19 | 3.0 | Triple | 1.5 | ○ | ○ | | ○ | ○ |
| D | Monodisperse (111) tabular grain Average aspect ratio 3.0 | 0.35 | 21 | 4.8 | Triple | 2.0 | ○ | ○ | | | ○ |
| E | Monodisperse (111) tabular grain Average aspect ratio 3.0 | 0.50 | 10 | 2.0 | Quadruple | 1.5 | ○ | ○ | | | ○ |
| F | Monodisperse (111) tabular grain Average aspect ratio 4.5 | 0.65 | 12 | 1.6 | Triple | 1.0 | ○ | ○ | | | ○ |
| G | Monodisperse cubic grain | 0.20 | 10 | 3.5 | Quadruple | 1.5 | | | ○ | ○ | |
| H | Monodisperse cubic grain | 0.24 | 12 | 4.9 | Quadruple | 2.1 | | | | ○ | |
| I | Monodisperse (111) tabular grain Average aspect ratio 4.0 | 0.30 | 12 | 3.5 | Quintuple | 2.5 | ○ | ○ | | ○ | ○ |
| J | Monodisperse (111) tabular grain Average aspect ratio 5.0 | 0.45 | 21 | 3.0 | Quadruple | 2.2 | ○ | ○ | | | ○ |
| K | Monodisperse (111) tabular grain Average aspect ratio 5.5 | 0.60 | 13 | 2.7 | Triple | 1.3 | ○ | ○ | | | ○ |

TABLE 4

(continued from Table 3)
Silver bromoiodide emulsions used in Sample 101

| Emulsion | Characteristics | Equivalent-sphere average diameter (μm) | Variation coefficient (%) | Average silver iodide content (mol %) | Halogen composition structure of silver halide grain | Silver iodide content of grain surface (mol %) | Other characteristics ① | ② | ③ | ④ | ⑤ |
|---|---|---|---|---|---|---|---|---|---|---|---|
| L | Monodisperse tetradecahedral grain | 0.31 | 9 | 5.0 | Triple | 6.0 | | | ○ | ○ | |
| M | Monodisperse tetradecahedral grain | 0.31 | 9 | 5.0 | Triple | 5.5 | | | | ○ | |
| N | Monodisperse (111) tabular grain Average aspect ratio 3.0 | 0.33 | 13 | 2.2 | Quadruple | 3.2 | ○ | ○ | | ○ | ○ |
| O | Monodisperse (111) tabular grain Average aspect ratio 3.0 | 0.43 | 9 | 2.2 | Quadruple | 1.0 | ○ | ○ | | ○ | ○ |
| P | Monodisperse (111) tabular grain Average aspect ratio 6.0 | 0.75 | 21 | 2.0 | Triple | 0.5 | ○ | ○ | | | ○ |
| Q | Monodisperse (111) tabular grain Average aspect ratio 6.0 | 0.90 | 8 | 1.0 | Quadruple | 0.5 | ○ | ○ | | | ○ |

Other characteristics)
① A reduction sensitizer was added during grain formation.
② A selenium sensitizer was used as an after-ripening chemical.
③ A rhodium salt was added during grain formation.
④ Subsequently after-ripening, 10% silver nitrate based on silver molar ratio to the emulsion grain at that time and its equimolar potassium bromide were added and the shell formation was carried out.

TABLE 4-continued (continued from Table 3)

Silver bromoiodide emulsions used in Sample 101

| Emulsion | Characteristics | Equivalent-sphere average diameter (μm) | Variation coefficient (%) | Average silver iodide content (mol %) | Halogen composition structure of silver halide grain | Silver iodide content of grain surface (mol %) | Other characteristics ① | ② | ③ | ④ | ⑤ |
|---|---|---|---|---|---|---|---|---|---|---|---|

⑤ It was observed by a transmission electron microscope that 10 or more of dislocation lines per one grain exist in average.

Further, all of the lightsensitive emulsions were post-ripened using sodium thiosulfate, potassium thiocyanate and sodium chloroaurate.

Further, an iridium salt was appropriately added during grain formation.

Further, a chemically modified gelatin in which a portion of the amino group of gelatin was converted to phthalic amide was added to the emulsion B, C, E, H, J, N and Q.

TABLE 5

Spectral sensitization of emulsions A to Q

| Emulsion | Added sensitizing dye | Addition amount (g) per mol of silver halide | Addition timing of sensitizing dye |
|---|---|---|---|
| A | S-1 | 0.04 | Subsequently to after-ripening |
| | S-2 | 0.20 | Subsequently to after-ripening |
| | S-3 | 0.20 | Subsequently to after-ripening |
| | S-4 | 0.01 | Subsequently to after-ripening |
| B | S-2 | 0.60 | Prior to after-ripening |
| | S-3 | 0.10 | Prior to after-ripening |
| | S-4 | 0.01 | Prior to after-ripening |
| C | S-2 | 0.50 | Prior to after-ripening |
| | S-3 | 0.08 | Prior to after-ripening |
| | S-4 | 0.01 | Prior to after-ripening |
| D | S-2 | 0.43 | Prior to after-ripening |
| | S-3 | 0.09 | Prior to after-ripening |
| | S-4 | 0.01 | Prior to after-ripening |
| E | S-2 | 0.30 | Prior to after-ripening |
| | S-3 | 0.07 | Prior to after-ripening |
| | S-4 | 0.01 | Prior to after-ripening |
| F | S-2 | 0.25 | Prior to after-ripening |
| | S-3 | 0.05 | Prior to after-ripening |
| | S-4 | 0.01 | Prior to after-ripening |
| G | S-5 | 0.70 | Subsequently to after-ripening |
| | S-7 | 0.10 | Subsequently to after-ripening |
| | S-8 | 0.10 | Subsequently to after-ripening |
| H | S-5 | 0.30 | Subsequently to after-ripening |
| | S-6 | 0.30 | Subsequently to after-ripening |
| | S-7 | 0.06 | Subsequently to after-ripening |
| | S-8 | 0.06 | Subsequently to after-ripening |

TABLE 6

(continued from Table 5)

| Emulsion | Added sensitizing dye | Addition amount (g) per mol of silver halide | Addition timing of sensitizing dye |
|---|---|---|---|
| I | S-5 | 0.50 | Prior to after-ripening |
| | S-7 | 0.08 | Prior to after-ripening |
| | S-8 | 0.08 | Prior to after-ripening |
| J | S-5 | 0.40 | Prior to after-ripening |
| | S-7 | 0.10 | Prior to after-ripening |
| | S-8 | 0.10 | Prior to after-ripening |
| K | S-6 | 0.50 | Prior to after-ripening |
| | S-7 | 0.13 | Prior to after-ripening |
| | S-8 | 0.13 | Prior to after-ripening |
| L, M | S-10 | 0.90 | Prior to after-ripening |
| | S-11 | 0.12 | Prior to after-ripening |
| | S-12 | 0.12 | Prior to after-ripening |
| N | S-10 | 0.65 | Prior to after-ripening |
| | S-11 | 0.11 | Prior to after-ripening |
| | S-12 | 0.11 | Prior to after-ripening |

TABLE 6-continued (continued from Table 5)

| Emulsion | Added sensitizing dye | Addition amount (g) per mol of silver halide | Addition timing of sensitizing dye |
|---|---|---|---|
| O | S-10 | 0.50 | Prior to after-ripening |
| | S-11 | 0.18 | Prior to after-ripening |
| P | S-10 | 0.30 | Prior to after-ripening |
| | S-11 | 0.06 | Prior to after-ripening |
| | S-12 | 0.06 | Prior to after-ripening |
| Q | S-9 | 0.26 | Prior to after-ripening |
| | S-11 | 0.05 | Prior to after-ripening |
| | S-12 | 0.05 | Prior to after-ripening |

Compounds employed in the formation of individual layers of the sample 101 are listed below.

C-1

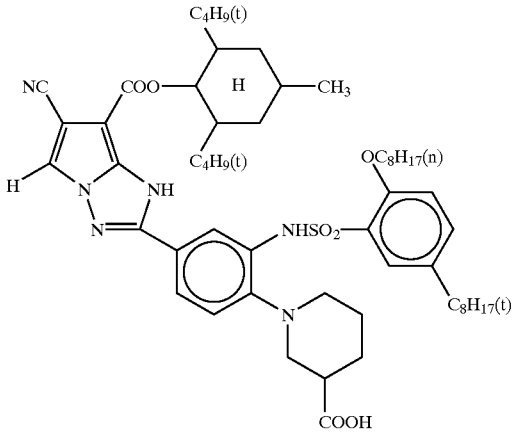

C-2

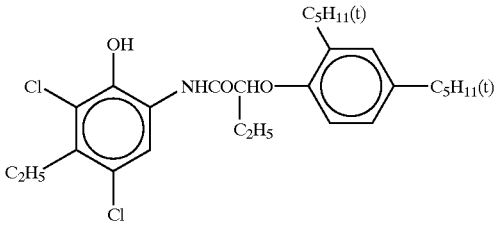

C-3

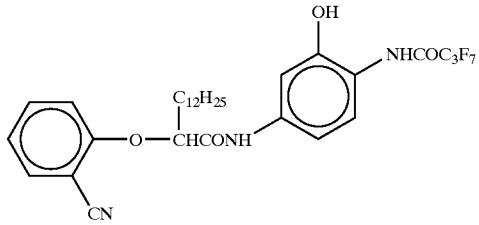

C-4

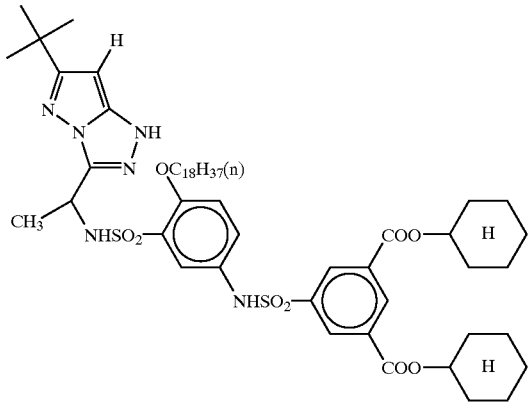

C-5

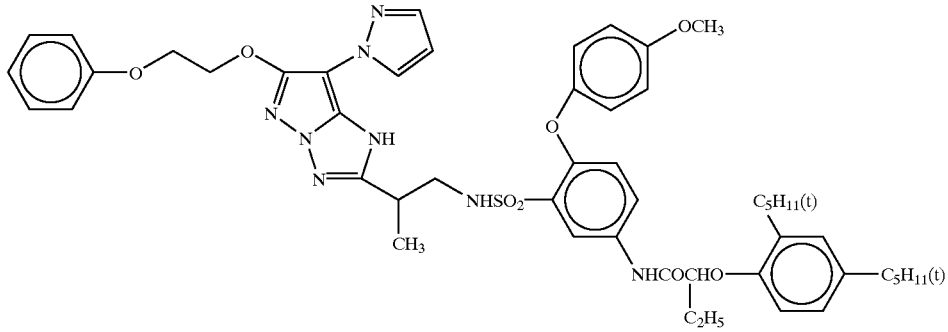

-continued
C-6
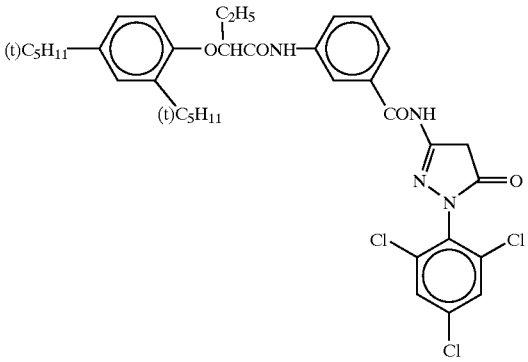
C-7
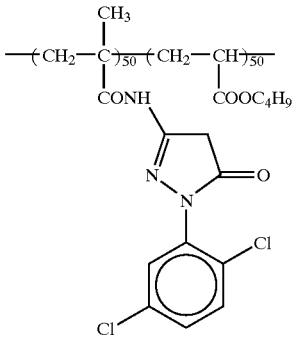
Numbers represent mass%
Average molecular weight: about 25,000
C-8
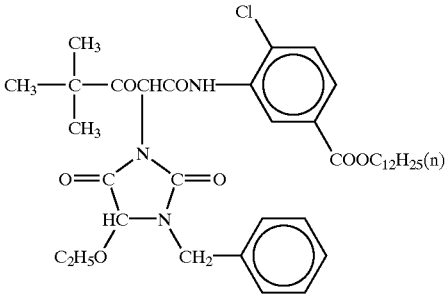
C-9
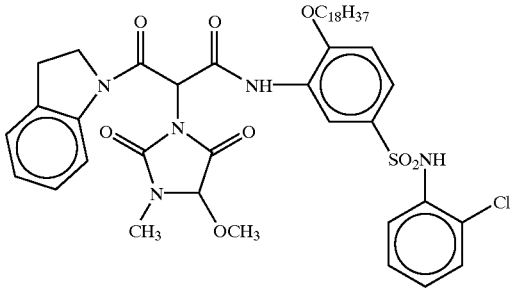
C-10
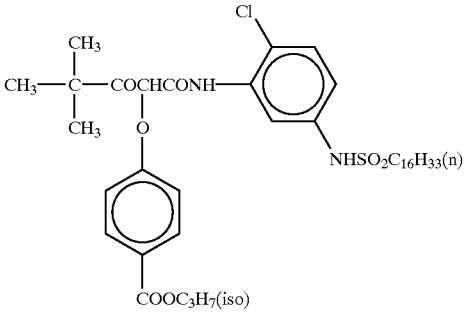
C-11
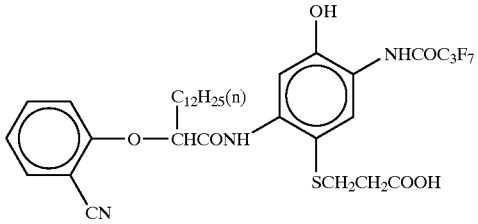
Oil-1
Tri-n-hexyl phosphate
Oil-2
Tricresyl phosphate
Oil-3
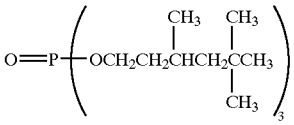
Bis (2-ethylhexyl) succinate
Oil-4
Tricyclohexyl phosphate
Oil-5
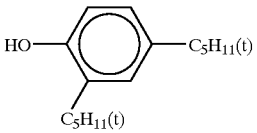
Oil-6
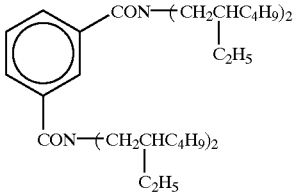
Oil-7
Oil-8
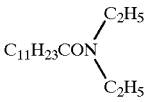

-continued
Oil-9
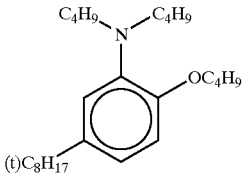
Oil-10
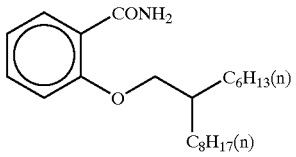
Cpd-A
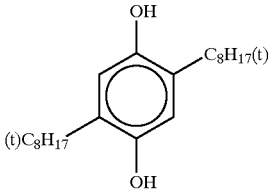
Cpd-B
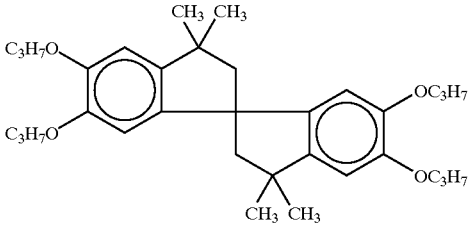
Cpd-C
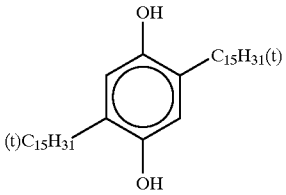
Cpd-D
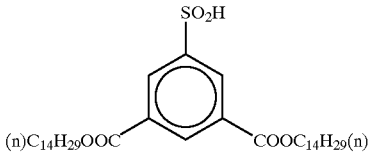
Cpd-E
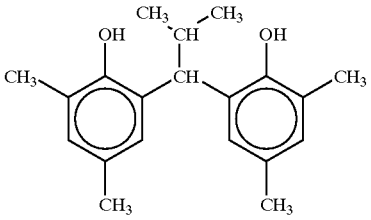
Cpd-F
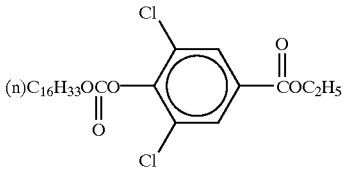
Cpd-G
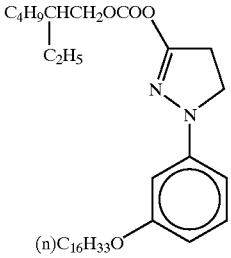
Cpd-H
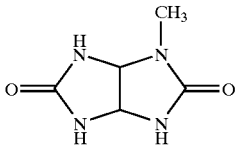
Cpd-I
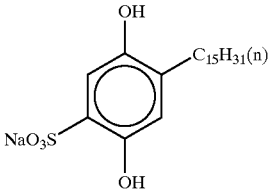
Cpd-J
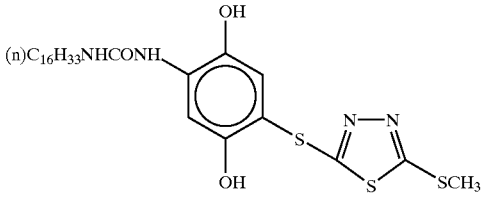
Cpd-K
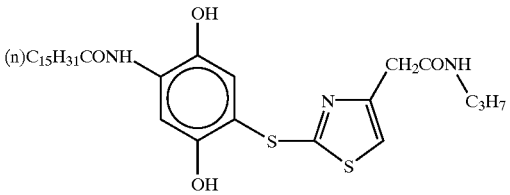
Cpd-L
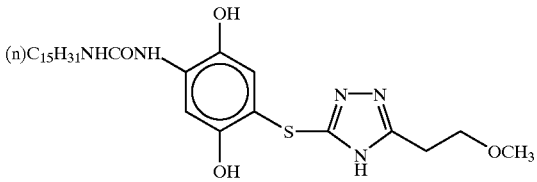

-continued
Cpd-M
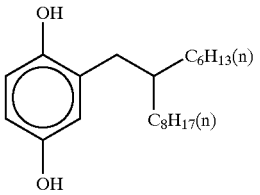
Cpd-N
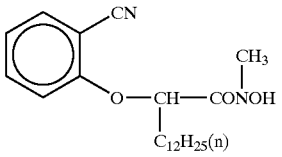
Cpd-O
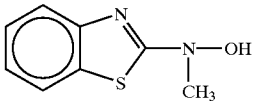
Cpd-P
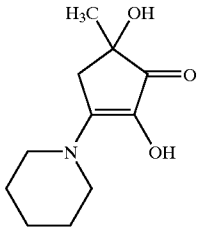
Cpd-Q
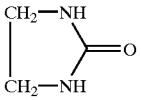
U-1
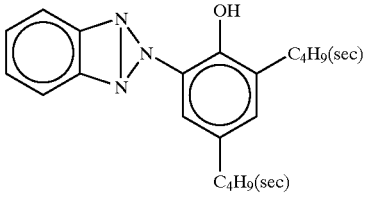
U-2
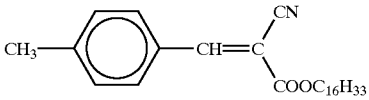
U-3
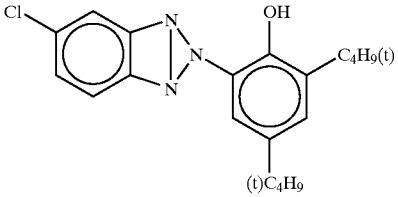
U-4
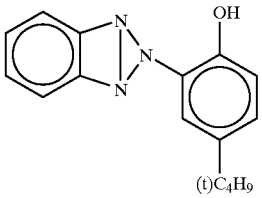
U-5
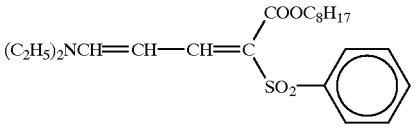
U-6
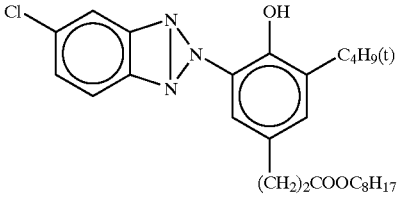
S-1
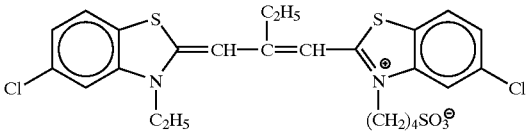
S-2
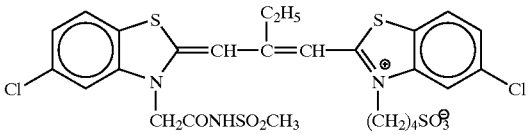
S-3
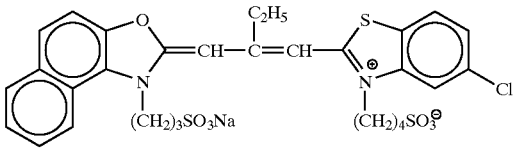

-continued
S-4
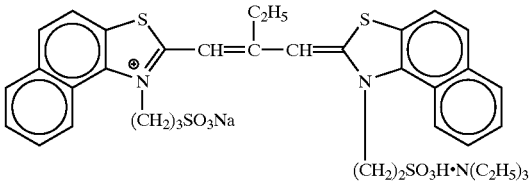
S-5
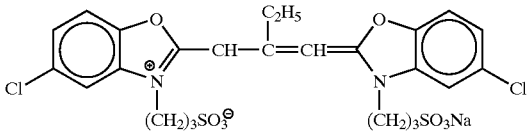
S-6
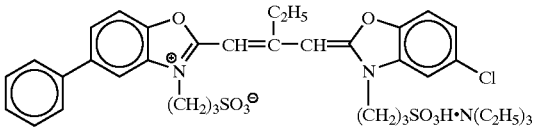
S-7
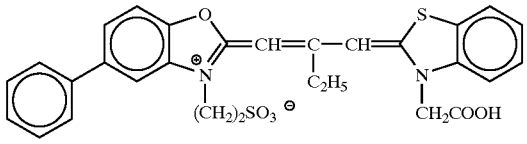
S-8
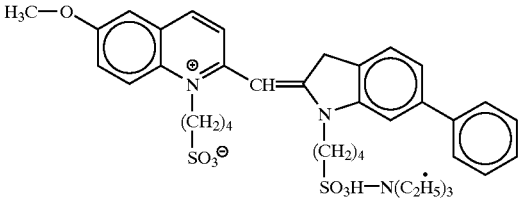
S-9
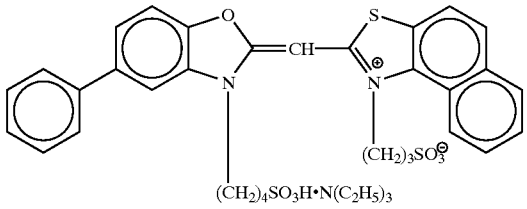
S-10
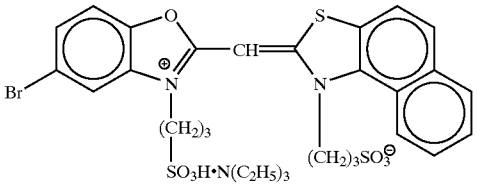
S-11
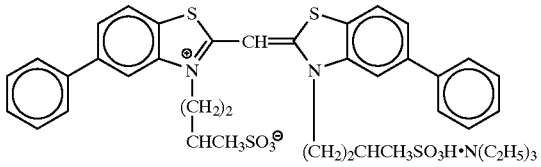
S-12
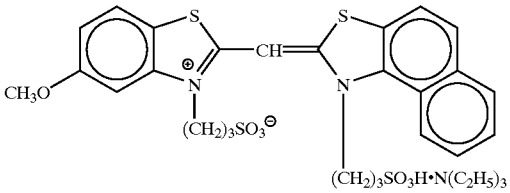
S-16
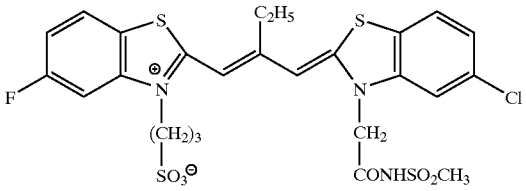
S-17
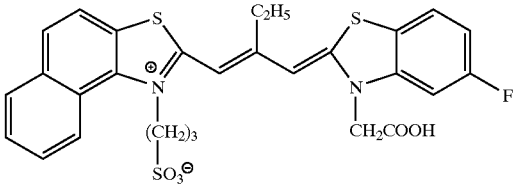
D-1
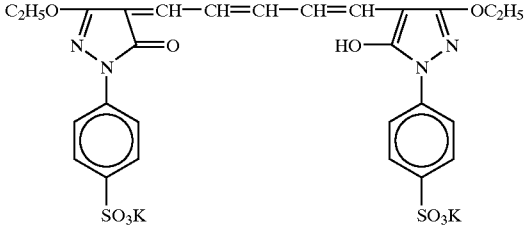
D-2
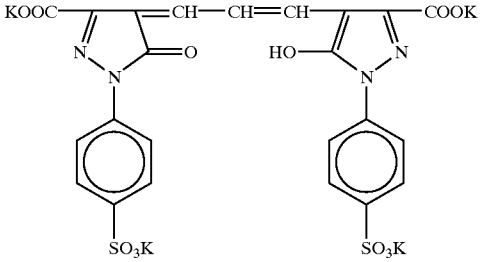
D-3
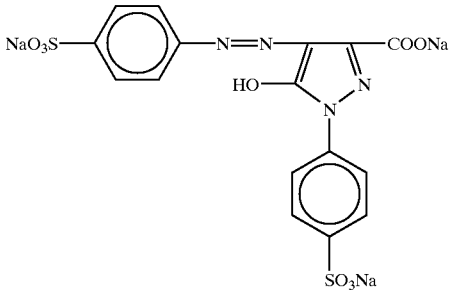

-continued
D-4
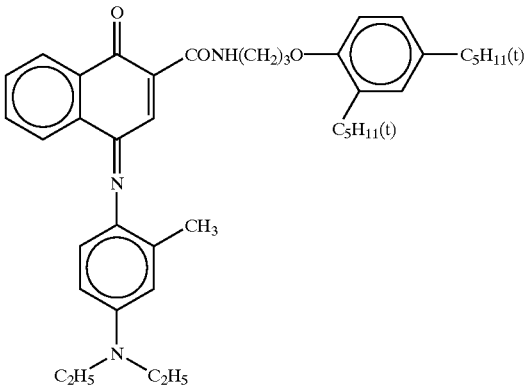
D-5
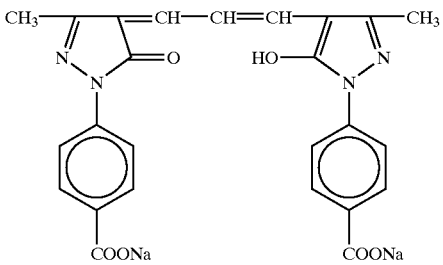
D-7
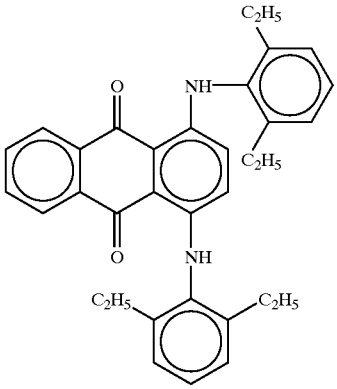
D-8
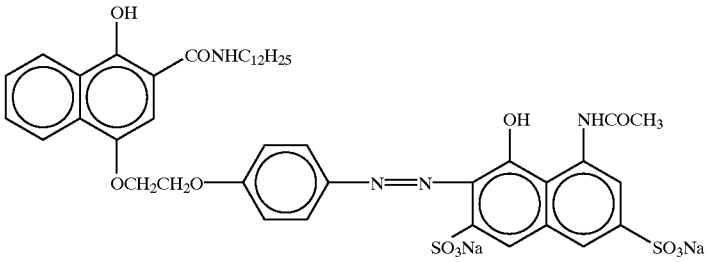
D-9
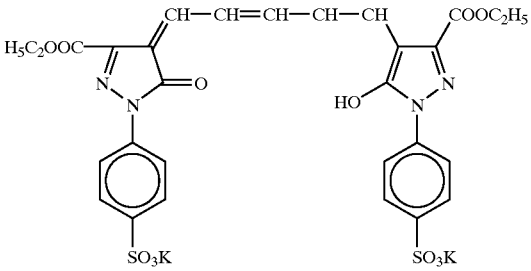
D-10
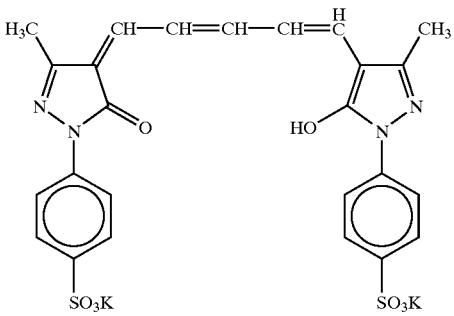
E-1
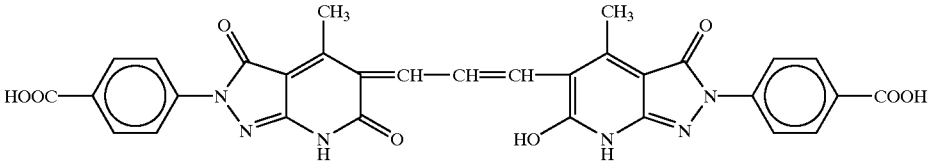

-continued
E-2
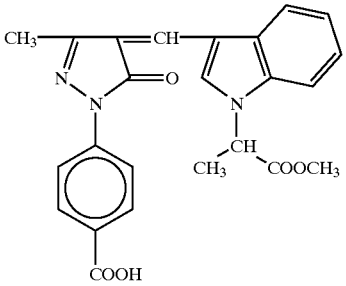
H-1
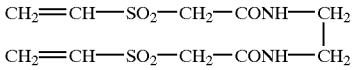
W-1
$C_8F_{17}SO_2NHCH_2CH_2OCH_2CH_2\overset{\oplus}{N}(CH_3)_3$
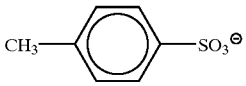
W-2
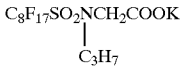
W-3
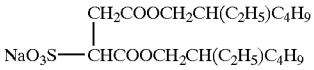
W-4
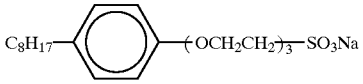
W-5
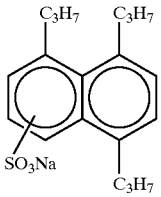
W-6
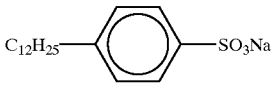
W-7
$C_8F_{17}SO_3Li$
P-1
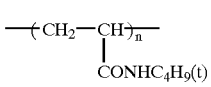
(n = 100 ~ 1000)
P-2
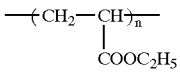
(n = 100 ~ 1000)
P-3
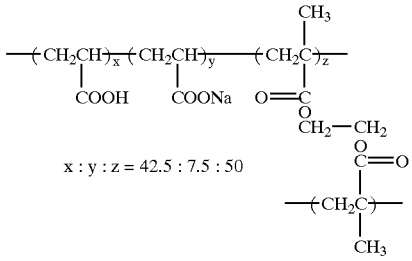
x : y : z = 42.5 : 7.5 : 50
P-4
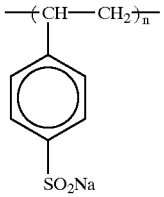
(n = 100 ~ 1000)
F-1
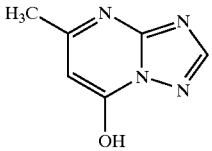
F-2
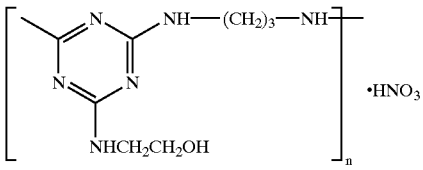
(n = 3 ~ 4)
F-3
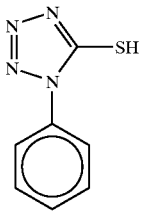

-continued

F-4

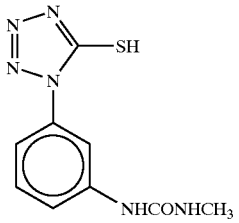

F-5

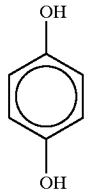

F-6

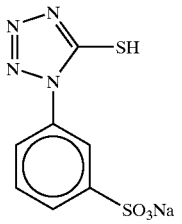

F-7

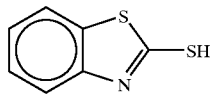

F-8

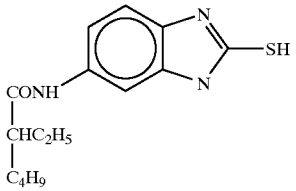

F-9

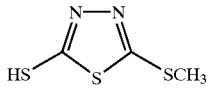

SO-1

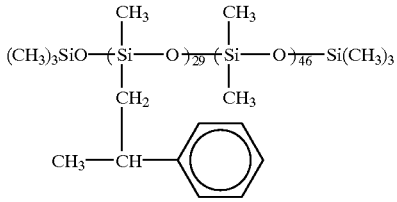

Preparation of Dispersions of Organic Solid Disperse Dyes

Preparation of Fine-crystal Solid Dispersion of Dye E-1

100 g of Pluronic F88 (an ethylene oxide-propylene oxide block copolymer) manufactured by BASF CORP. and water were added to a wet cake of the dye E-1 (the net weight of E-1 was 270 g), and the resultant material was stirred to make 4,000 g. Next, the Ultra Visco Mill (UVM-2) manufactured by Imex K.K. was filled with 1,700 mL of zirconia beads with an average grain size of 0.5 mm, and the slurry was milled through the UVM-2 at a peripheral speed of approximately 10 m/sec and a discharge rate of 0.5 L/min for 2 hrs. The beads were filtered out, and water was added to dilute the material to a dye concentration of 3%. After that, the material was heated to 90° C. for 10 hrs for stabilization. The average grain size of the obtained fine dye grains was 0.30 $\mu$m, and the grain size distribution (grain size standard deviation ×100/average grain size) was 20%.

Preparation of Fine-crystal Solid Dispersion of Dye E-2

Water and 270 g of W-4 were added to 1,400 g of a wet cake of E-2 containing 30 mass % of water, and the resultant material was stirred to form a slurry having an E-2 concentration of 40 mass %. Next, the Ultra Visco Mill (UVM-2) manufactured by Imex K.K. was filled with 1,700 mL of zirconia beads with an average grain size of 0.5 mm, and the slurry was milled through the UVM-2 at a peripheral speed of approximately 10 m/sec and a discharge rate of 0.5 L/min for 8 hr, thereby obtaining a solid fine-grain dispersion of E-2. This dispersion was diluted to 2.0 mass % by ion exchange water to obtain a fine-crystal solid dispersion. The average grain size was 0.15 $\mu$m.

The film thickness of sample 101 was 26.5 $\mu$m, and, after being swelled with 25° C. $H_2O$, was 47.8 $\mu$m.

In the sample 101, the 3rd layer corresponds to the interimage effects imparting layer of the present invention, and the 4th layer corresponds to the nonlightsensitive layer with capability of color mixing inhibition. Monoalkylhydroquinone (Cpd-M) as a color mixing inhibitor was added to the 4th layer in an amount of 310 mg/m$^2$, and the thickness of the 4th layer was 2.3 $\mu$m.

Preparation of Samples 102 to 113

Sample 102 was prepared in the same manner as the sample 101, except that, in the 3rd layer, the emulsion EM-1 was used so that the silver quantity was 0.60 g/m$^2$, and the gelatin was used in an amount of 0.42 g/m$^2$.

Samples 103 to 113 were prepared in the same manner as the sample 102, except that the emulsion EM-1 was replaced by the emulsions EM-2 to EM-12, respectively. The emulsions were used so that the silver coating amounts were identical to each other. The emulsions used in the samples 101 to 113 are listed in Table 7.

TABLE 7

| Sample name | Emulsion name | Coating amount ($g/m^2$) | Remark |
|---|---|---|---|
| 101 | — | 0.0 | Comparative example |
| 102 | EM-1 | 0.6 | Comparative example |
| 103 | EM-2 | 0.6 | Comparative example |
| 104 | EM-3 | 0.6 | Comparative example |
| 105 | EM-4 | 0.6 | Comparative example |
| 106 | EM-5 | 0.6 | Present invention |
| 107 | EM-6 | 0.6 | Present invention |
| 108 | EM-7 | 0.6 | Present invention |
| 109 | EM-8 | 0.6 | Present invention |
| 110 | EM-9 | 0.6 | Present invention |
| 111 | EM-10 | 0.6 | Present invention |
| 112 | EM-11 | 0.6 | Present invention |
| 113 | EM-12 | 0.6 | Present invention |

TABLE 8

| Sample name | γIE (G/R:0.5) | γIE (G/R:1.5) | γIE (R/G:0.5) | γIE (R/G:1.5) | γIE (B/R:0.5) | γIE (B/R:1.5) | |
|---|---|---|---|---|---|---|---|
| 101 | 0.05 | 0.07 | 0.02 | 0.06 | 0.04 | 0.06 | Comparative example |
| 102 | 0.08 | 0.10 | — | | — | — | Comparative example |
| 103 | 0.08 | 0.09 | — | | — | — | Comparative example |
| 104 | 0.09 | 0.10 | — | | — | — | Comparative example |
| 105 | 0.11 | 0.09 | — | | — | — | Comparative example |
| 106 | 0.23 | 0.30 | — | | — | — | Present invention |
| 107 | 0.32 | 0.33 | — | | — | — | Present invention |
| 108 | 0.25 | 0.38 | — | | — | — | Present invention |
| 109 | 0.21 | 0.29 | — | | — | — | Present invention |
| 110 | — | — | 0.24 | 0.26 | — | — | Present invention |
| 111 | — | — | 0.20 | 0.29 | — | — | Present invention |
| 112 | — | — | — | — | 0.17 | 0.20 | Present invention |
| 113 | — | — | — | — | 0.14 | 0.22 | Present invention |

Estimation of Interimage Effects

With respect to the sample 101, $\gamma_{IE}$(G/R: 0.5) and $\gamma_{IE}$(G/R: 1.5) being point-gamma values indicating the magnitude of interimage effects exerted by the green-sensitive emulsion layer on the red-sensitive emulsion layer were measured in the following manner.

First, the sample was subjected to 1/50 sec wedge exposure by green monochromatic light capable of maximizing the value of spectral sensitivity of green-sensitive emulsion layer. Subsequently, the sample was subjected to uniform exposure by red monochromatic light capable of maximizing the value of spectral sensitivity of red-sensitive emulsion layer. In this exposure, the exposure time was 1/50 sec, and there were provided two stages of exposure quantities regulated so that the color density of red-sensitive emulsion layer having been irradiated only with red light became D=0.5 and D=1.5. Thereafter, the exposed sample was developed according to the above processing conditions A, and the cyan, magenta and yellow color densities of obtained sample were determined in terms of status A integral density. The obtained color densities were plotted versus the logarithm of green monochromatic light exposure quantity, and the point-gamma value $\gamma_{IE}$(G/R: 0.5) of density of red-sensitive emulsion layer at a point where the color densities of red-sensitive emulsion layer and green-sensitive emulsion layer crossed each other at a density of 0.5 was determined. In the same manner, the point-gamma value $\gamma_{IE}$(G/R: 1.5) of density of red-sensitive emulsion layer at a point where the color densities of red-sensitive emulsion layer and green-sensitive emulsion layer crossed each other at a density of 1.5 was determined. Similarly, the point-gamma values $\gamma_{IE}$(R/G: 0.5), $\gamma_{IE}$(R/G: 1.5), $\gamma_{IE}$(B/R: 0. 5) and $\gamma_{IE}$(B/R: 1.5) were determined by changing the monochromatic light for wedge exposure and the monochromatic light for uniform exposure.

Similarly, there were determined the point-gamma values $\gamma_{IE}$(G/R: 0.5) and $\gamma_{IE}$(G/R: 1.5) of each of the samples 102 to 109, the point-gamma values $\gamma_{IE}$(R/G: 0.5) and $\gamma_{IE}$(R/G: 1.5) of each of the samples 110 and 111, and the point-gamma values $\gamma_{IE}$(B/R: 0.5) and $\gamma_{IE}$(B/R: 1.5) of each of the samples 112 and 113. The results are listed in Table 8.

Estimation Results

It is apparent from Table 7 that the interimage effects can be enhanced by the present invention.

EXAMPLE 2

Production of Emulsion EM-13

Emulsion EM-13 was produced in the same manner as the emulsion EM-7, except that, in the chemical sensitization, the molar ratio of sensitizing dye Exs-1 to Exs-2 was changed to 25:75, and that the addition amounts thereof were optimized.

The characteristics of the emulsions EM-7 and EM-13 are listed in Tables 9 and 10.

TABLE 9

| Emulsion | Characteristics | Equivalent-sphere average diameter (μm) | Variation coefficient (%) | Surface silver iodide content (mol %) | Weight-average wavelength of spectral sensitivity λi (nm) | λg–λc (nm) |
|---|---|---|---|---|---|---|
| EM-7 | Monodisperse tabular grain Aspect ratio 5.7 | 0.6 | 18.2 | 6.4 | 535 | 15 |
| EM-13 | Monodisperse tabular grain Aspect ratio 5.7 | 0.6 | 18.2 | 6.4 | 545 | 5 |

TABLE 10

(continued from Table 9)

| Emulsion | Silver quantity ratio (mol % of each layer, based on total silver quantity of grain) | I distribution (Silver iodide content of each layer/mol %) | Average silver iodide content (mol %) | Remark |
|---|---|---|---|---|
| EM-1 | Core/1st shell/2nd shell/3rd shell/4th shell 3/28/20/3/46 | Core/1st shell/2nd shell/3rd shell/4th shell 0/25/0/100/0 | 10.0 | Inv. |
| EM-2 | Core/1st shell/2nd shell/3rd shell/4th shell 3/28/20/3/46 | Core/1st shell/2nd shell/3rd shell/4th shell 0/25/0/100/0 | 10.2 | Inv. |

Preparation of Sample 201

Sample 201 was prepared in the same manner as the sample 101, except that, in the 3rd layer, the emulsion EM-13 was used so that the silver quantity was 0.60 g/m$^2$, and the gelatin was used in an amount of 0.42 g/m$^2$.

Preparation of Samples 202 and 203

Samples 202 and 203 were prepared in the same manner as the samples 108 and 201, respectively, except that, to the 3rd layer, the couplers C-4 and C-9 were added in an amount of 0.05 g/m$^2$ 1 and 0.1 g/m$^2$, respectively.

Preparation of Sample 204

Sample 204 was prepared in the same manner as the sample 108, except that, to the 3rd layer, fine grain silver iodide emulsion (equivalent sphere average grain diameter: 0.06 μm) was added so as to be in coexistent form in an amount of 0.06 g/m$^2$ in terms of silver quantity. The characteristics of the samples 201 to 204 and samples 101 and 108 are listed in Table 11.

TABLE 11

| Sample No. | Emulsion name | Coating amount (g/m$^2$) | Coating amount of coupler in 3rd layer (g/m$^2$) C-4 | C-9 | Silver iodide fine grain of 3rd layer | Remark |
|---|---|---|---|---|---|---|
| 101 | — | 0.0 | — | — | — | Comp. |
| 108 | EM-7 | 0.6 | — | — | — | Inv. |
| 201 | EM-13 | 0.6 | — | — | — | Inv. |
| 202 | EM-7 | 0.6 | 0.05 | 0.10 | — | Inv. |
| 203 | EM-13 | 0.6 | 0.05 | 0.10 | — | Inv. |
| 204 | EM-7 | 0.6 | — | — | 0.06 | Inv. |

Each of the samples 201 to 204 and samples 101 and 108 was cut into 60 mm width Brownie size, processed, charged in a Brownie camera, and used to photograph a Macbeth color chart under daylight with an appropriate exposure. Further, the following development processing was carried out, and the color reproduction was estimated by visual inspection.

Delicate variation of color reproduction was estimated by measuring the RGB densities of photographed image, plotting the same on a Lab chromaticity diagram and identifying a relative positional relationship with the chromaticity plot of color of Macbeth chart per se.

Estimation Result

With respect to the sample 108, not only was the saturation of green apparently high but also the separation of green and yellow green was excellent as compared with those of the sample 101.

With respect to the sample 201, the saturation of green was apparently higher than that of the sample 101. However, the separation of green and yellow green, although slightly enhanced as compared with that of the sample 101, was unsatisfactory as compared with that of the sample 108.

With respect to the sample 202, not only was the saturation of green apparently high but also the separation of green and yellow green was excellent as compared with those of the sample 101. However, the saturation of green was slightly lower than that of the sample 108.

With respect to the sample 203, the saturation of green was apparently higher than that of the sample 101. However, the saturation of green was slightly lower than that of the sample 201.

With respect to the sample 204, not only was the saturation of green apparently high but also the separation of green and yellow green was excellent as compared with those of the sample 101. Further, the saturation of green was significantly higher than that of the sample 108.

EXAMPLE 3

Samples 301 to 303 were prepared in the same manner as the sample 108 of Example 1, except that the sensitizing dyes added to the emulsions A to F used in the 5th to 7th layers were changed as specified in Tables 12 and 13. In the table, λrn represents the weight-averaged wavelength (nm) of spectral sensitivity distribution of each emulsion.

TABLE 12

| Sample | Emulsion | Layer | Added sensitizing dye and addition amount thereof (g) per mol of silver halide | | | | | | λrn |
|---|---|---|---|---|---|---|---|---|---|
| | | | S-1 | S-2 | S-3 | S-4 | S-16 | S-17 | (nm) |
| Sample 108 | A | Low-speed red-sensitive emulsion layer (5th layer) | 0.04 | 0.20 | 0.20 | 0.01 | 0.00 | 0.00 | 630 |
| | B | Low-speed red-sensitive emulsion layer (5th layer) | 0.00 | 0.60 | 0.10 | 0.01 | 0.00 | 0.00 | 640 |
| | C | Low-speed and Medium speed red-sensitive emulsion layer (5th layer and 6th layer) | 0.00 | 0.50 | 0.08 | 0.01 | 0.00 | 0.00 | 640 |
| | D | Medium-speed red-sensitive emulsion layer (6th layer) | 0.00 | 0.43 | 0.09 | 0.01 | 0.00 | 0.00 | 640 |
| | E | High-speed red-sensitive emulsion layer (7th layer) | 0.00 | 0.30 | 0.07 | 0.01 | 0.00 | 0.00 | 640 |
| | F | High-speed red-sensitive emulsion layer (7th layer) | 0.00 | 0.25 | 0.05 | 0.01 | 0.00 | 0.00 | 645 |
| Sample 301 | A | Low-speed red-sensitive emulsion layer (5th layer) | 0.00 | 0.00 | 0.00 | 0.01 | 0.19 | 0.18 | 630 |
| | B | Low-speed red-sensitive emulsion layer (5th layer) | 0.00 | 0.00 | 0.00 | 0.01 | 0.40 | 0.25 | 630 |
| | C | Low-speed and Medium speed red-sensitive emulsion layer (5th layer and 6th layer) | 0.00 | 0.00 | 0.00 | 0.01 | 0.33 | 0.21 | 630 |
| | D | Medium-speed red-sensitive emulsion layer (6th layer) | 0.00 | 0.00 | 0.00 | 0.01 | 0.30 | 0.19 | 630 |
| | E | High-speed red-sensitive emulsion layer (7th layer) | 0.00 | 0.00 | 0.00 | 0.01 | 0.21 | 0.13 | 630 |
| | F | High-speed red-sensitive emulsion layer (7th layer) | 0.00 | 0.00 | 0.00 | 0.01 | 0.17 | 0.11 | 630 |

TABLE 13

(continued from Table 12)

| Sample | Emulsion | Layer | Added sensitizing dye and addition amount thereof (g) per mol of silver halide | | | | | | λrn |
|---|---|---|---|---|---|---|---|---|---|
| | | | S-1 | S-2 | S-3 | S-4 | S-16 | S-17 | (nm) |
| Sample 302 | A | Low-speed red-sensitive emulsion layer (5th layer) | 0.00 | 0.00 | 0.00 | 0.01 | 0.15 | 0.22 | 620 |
| | B | Low-speed red-sensitive emulsion layer (5th layer) | 0.00 | 0.00 | 0.00 | 0.01 | 0.27 | 0.38 | 620 |
| | C | Low-speed and Medium speed red-sensitive emulsion layer (5th layer and 6th layer) | 0.00 | 0.00 | 0.00 | 0.01 | 0.22 | 0.31 | 620 |
| | D | Medium-speed red-sensitive emulsion layer (6th layer) | 0.00 | 0.00 | 0.00 | 0.01 | 0.20 | 0.28 | 620 |
| | E | High-speed red-sensitive emulsion layer (7th layer) | 0.00 | 0.00 | 0.00 | 0.01 | 0.14 | 0.20 | 620 |
| | F | High-speed red-sensitive emulsion layer (7th layer) | 0.00 | 0.00 | 0.00 | 0.01 | 0.11 | 0.16 | 620 |
| Sample 303 | A | Low-speed red-sensitive emulsion layer (5th layer) | 0.00 | 0.00 | 0.00 | 0.01 | 0.15 | 0.22 | 620 |
| | B | Low-speed red-sensitive emulsion layer (5th layer) | 0.00 | 0.00 | 0.00 | 0.01 | 0.27 | 0.38 | 620 |

TABLE 13-continued (continued from Table 12)

| Sample | Emulsion | Layer | Added sensitizing dye and addition amount thereof (g) per mol of silver halide S-1 | S-2 | S-3 | S-4 | S-16 | S-17 | λrn (nm) |
|---|---|---|---|---|---|---|---|---|---|
| | C | Low-speed and Medium speed red-sensitive emulsion layer (5th layer and 6th layer) | 0.00 | 0.00 | 0.00 | 0.01 | 0.33 | 0.21 | 630 |
| | D | Medium-speed red-sensitive emulsion layer (6th layer) | 0.00 | 0.00 | 0.00 | 0.01 | 0.30 | 0.19 | 630 |
| | E | High-speed red-sensitive emulsion layer (7th layer) | 0.00 | 0.00 | 0.00 | 0.01 | 0.28 | 0.07 | 640 |
| | F | High-speed red-sensitive emulsion layer (7th layer) | 0.00 | 0.00 | 0.00 | 0.01 | 0.23 | 0.05 | 640 |

Each of the obtained samples was cut into 60 mm width Brownie size, processed, charged in a Brownie camera, and used to photograph a Macbeth color chart under daylight. Further, the development was carried out according to the above processing conditions A, and the color reproduction was estimated by visual inspection.

As a result, it was found that the samples 301 and 302 exhibited enhanced color discrimination from yellow to orange and further to red as compared with that of the sample 108. It was also found that, when, as realized in the sample 303, the weight-averaged wavelength of spectral sensitivity distribution of emulsion employed in a high-speed red-sensitive layer was larger than the weight-averaged wavelength of spectral sensitivity distribution of emulsion employed in a low-speed red-sensitive layer, preferred color discrimination could be attained.

EXAMPLE 4

Sample 401 was prepared in the same manner as the sample 302 of Example 3, except that the sensitizing dyes added to the emulsions G to K used in the 9th to 11th layers were changed as specified in Table 14. As a result, the weight-averaged wavelength of spectral sensitivity distribution of green-sensitive emulsion layer became 546 nm.

TABLE 14

| Sample | Emulsion | Layer | Added sensitizing dye and addition amount thereof (g) per mol of silver halide S-5 | S-6 | S-7 | S-8 |
|---|---|---|---|---|---|---|
| Sample 401 | G | Low-speed green-sensitive emulsion layer (9th layer) | 0.61 | 0.00 | 0.10 | 0.20 |
| | H | Low-speed green-sensitive emulsion layer (9th layer) | 0.27 | 0.24 | 0.07 | 0.14 |
| | I | Low-speed and Medium speed Green-sensitive emulsion layer (9th layer and 10th layer) | 0.45 | 0.00 | 0.08 | 0.14 |
| | J | Medium-speed green-sensitive emulsion layer (10th layer) | 0.37 | 0.00 | 0.10 | 0.14 |
| | K | High-speed green-sensitive emulsion layer (11th layer) | 0.46 | 0.00 | 0.13 | 0.18 |

The obtained sample was cut into 60 mm width Brownie size, processed, charged in a Brownie camera, and used to photograph a Macbeth color chart under daylight. Further, the development was carried out according to the above processing conditions A, and the color reproduction was estimated by visual inspection.

As a result, it was found that the sample 401 exhibited enhanced saturation from bluish green to yellow green as compared with that of the sample 302.

EXAMPLE 5

Sample 501 was prepared in the same manner as the sample 401 of Example 4, except that a short wave blue-sensitive interimage effects imparting layer (obtained by coating with a silver iodobromide emulsion of 12.0 mol % silver iodide content, 0.5 $\mu$m equivalent sphere average grain diameter, 17.6% equivalent sphere diameter variation coefficient and 442 nm in weight-averaged wavelength of spectral sensitivity distribution so that the coating amounts of silver, gelatin and compound Cpd-Q were 0.27 g/m$^2$, 0.40 g/m$^2$ and 0.20 g/m$^2$, respectively) was provided between the 12th layer (yellow filter layer) and the 13th layer (interlayer).

The obtained sample was cut into 60 mm width Brownie size, processed, charged in a Brownie camera, and used to photograph a Macbeth color chart under daylight. Further, the development was carried out according to the above processing conditions A, and the color reproduction was estimated by visual inspection.

As a result, it was found that the sample 501 exhibited enhanced color discrimination from bluish green to purple as compared with that of the sample 401.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide color reversal photographic material comprising, on a support, at least one blue-sensitive silver halide emulsion layer containing a yellow-forming coupler, at least one green-sensitive silver halide emulsion layer containing a magenta-forming coupler and at least one red-sensitive silver halide emulsion layer containing a cyan-forming coupler, wherein the material comprises a layer capable of imparting interimage effects which comprises a lightsensitive silver halide emulsion comprising silver halide grains satisfying the following conditions (i) to (iii):

(i) The silver halide grains have an average silver iodide content of more than 6 to 39 mol %.

(ii) Grains occupying 60% or more of a projected area of all the silver halide grains are those of triple or greater multiplicity structure having at least one layer of high silver iodide content, the silver iodide content being 8 mol % or more, which layer of high silver iodide content is one formed using silver in an amount of 15 to 80 mol % based on that used in obtaining final grains;

(iii) All the silver halide grains have surfaces having an average silver iodide content of 10 mol % or less.

2. The silver halide color reversal photographic material according to claim 1, wherein the lightsensitive silver halide emulsion comprises silver halide grains satisfying not only the above conditions (i) to (iii) but also the following conditions (iv) and (v):

(iv) All the silver halide grains have equivalent circle diameters whose variation coefficient is 40% or less;

(v) The grains occupying 60% or more of a projected area of all the silver halide grains are tabular grains of quintuple or greater multiplicity structure wherein, with respect to a silver iodide distribution thereof, there are at least two maximums in zones extending from a grain center to grain side, a first maximum of said at least two maximums is in the range of 1 to 40% of the total silver amount which silver amount counting from the grain center to grain sides, while a second maximum of said at least two maximums is in the range of 50 to 85% of the total silver amount which silver amount counting from the grain center to grain sides.

3. The silver halide color reversal photographic material according to claim 1, wherein the lightsensitive silver halide emulsion has a spectral sensitivity distribution whose weight-average sensitivity wavelength λi is positioned intermediate between respective spectral sensitivity distribution weight-average wavelengths λb and λg of the blue-sensitive silver halide emulsion layer and the green-sensitive silver halide emulsion layer, and wherein the lightsensitive silver halide emulsion is spectrally sensitized so as to simultaneously satisfy the following relationships of formulae (1) and (2):

$$490\ \text{nm} \leqq \lambda i \leqq 560\ \text{nm} \quad (1)$$

wherein λi represents the weight-averaged wavelength (nm) of spectral sensitivity distribution of the lightsensitive silver halide emulsion, $$\lambda g \geqq \lambda i + 10 \quad (2)$$

wherein λg represents the weight-averaged wavelength (nm) of spectral sensitivity distribution of the green-sensitive silver halide emulsion layer.

4. The silver halide color reversal photographic material according to claim 2, wherein the lightsensitive silver halide emulsion has a spectral sensitivity distribution whose weight-average sensitivity wavelength λi is positioned intermediate between respective spectral sensitivity distribution weight-average wavelengths λb and λg of the blue-sensitive silver halide emulsion layer and the green-sensitive silver halide emulsion layer, and wherein the lightsensitive silver halide emulsion is spectrally sensitized so as to simultaneously satisfy the following relationships of formulae (1) and (2):

$$490\ \text{nm} \leqq \lambda i \leqq 560\ \text{nm} \quad (1)$$

wherein λi represents the weight-averaged wavelength (nm) of spectral sensitivity distribution of the lightsensitive silver halide emulsion, $$\lambda g \geqq \lambda i + 10 \quad (2)$$

wherein λg represents the weight-averaged wavelength (nm) of spectral sensitivity distribution of the green-sensitive silver halide emulsion layer.

5. The silver halide color reversal photographic material according to claim 1, wherein the interimage effects imparting layer substantially does not contribute to formation of dye images.

6. The silver halide color reversal photographic material according to claim 2, wherein the interimage effects imparting layer substantially does not contribute to formation of dye images.

7. The silver halide color reversal photographic material according to claim 3, wherein the interimage effects imparting layer substantially does not contribute to formation of dye images.

8. The silver halide color reversal photographic material according to claim 4, wherein the interimage effects imparting layer substantially does not contribute to formation of dye images.

* * * * *